US005678521A

United States Patent [19]

Thompson et al.

[11] Patent Number: 5,678,521

[45] Date of Patent: Oct. 21, 1997

[54] SYSTEM AND METHODS FOR ELECTRONIC CONTROL OF AN ACCUMULATOR FUEL SYSTEM

[75] Inventors: Scott A. Thompson; Jeffrey Daiker; Jonathon A. Stavnheim; William Meyer; Greg Fridholm; Zhong Sang, all of Columbus, Ind.; George Studtman, Mt. Prospect, Ill.; Mark G. Thomas; W. Beale Delano, both of Columbus, Ind.

[73] Assignee: Cummins Engine Company, Inc., Columbus, Ind.

[21] Appl. No.: 633,510

[22] Filed: Apr. 17, 1996

Related U.S. Application Data

[63] Continuation of Ser. No. 238,859, May 6, 1994, abandoned, which is a continuation-in-part of Ser. No. 57,489, May 6, 1993, abandoned.

[51] Int. Cl.[6] ..... F02M 7/00

[52] U.S. Cl. ..... 123/447; 123/446; 123/501

[58] Field of Search ..... 123/447, 456, 123/458, 446, 506, 496, 357, 501, 502; 364/431.05

[56] References Cited

U.S. PATENT DOCUMENTS

| | | |
|---|---|---|
| Re. 33,270 | 7/1990 | Beck et al. . |
| 2,274,224 | 2/1942 | Vickers . |
| 2,867,198 | 1/1959 | Peras . |

(List continued on next page.)

FOREIGN PATENT DOCUMENTS

| | | |
|---|---|---|
| 0501463 | 9/1992 | European Pat. Off. . |
| 57-68532 | 4/1982 | Japan . |
| 5106495 | 4/1993 | Japan . |

OTHER PUBLICATIONS

SAE article No. 910252 entitled Development of New Electronically Controlled Fuel Injection Systems ECD–U2 for Diesel Engines by Miyaki, et al.

(List continued on next page.)

*Primary Examiner*—Carl S. Miller

*Attorney, Agent, or Firm*—Sixbey, Friedman, Leedom & Ferguson; Charles M. Leedom, Jr.; Evan R. Smith

[57] ABSTRACT

An electronic digital control system monitors and controls the operation of an engine fueling system. Signals activating injection for a plurality of cylinders are transmitted through a single line to a driving circuit for a single injector solenoid valve, while signals controlling accumulator fuel pumps are transmitted to pumping control solenoids. Injection signals are controlled to vary fuel delivery rate during an injection event. A back EMF sensing circuit measures valve opening delay and the control system compensates for valve delay. Variable cylinder-specific delays in the injection solenoid output signal pulses are programmed to compensate for a varying fuel line length to each injector nozzle. At startup, the control system pulses the pumping control solenoids to begin pressurizing the accumulator before engine angular position sensors provide an accurate indication of engine angular position to allow precise timed control of the pump. Pressure variations in the high pressure accumulator are monitored by the control system in conjunction with injection events, and pump equipment failures or weaknesses are detected based on the pressure variations. In alternative embodiments of the invention, a pre-biasing current using battery voltage is provided to the injection control valve prior to the desired time of an injection event, and the current is increased at the desired time of opening. An input allows signaling the control system when a load is to be applied to cause an immediate change in fueling levels, to prepare for load increases in electrical generation and other non-motive-power applications.

33 Claims, 35 Drawing Sheets

U.S. PATENT DOCUMENTS

| | | |
|---|---|---|
| 2,914,053 | 11/1959 | Hittell . |
| 3,598,507 | 8/1971 | Voit et al. . |
| 3,718,283 | 2/1973 | Fenne . |
| 3,747,857 | 7/1973 | Fenne . |
| 3,759,637 | 9/1973 | Vuaille . |
| 4,236,877 | 12/1980 | Curtis . |
| 4,331,119 | 5/1982 | Chadwick . |
| 4,357,925 | 11/1982 | Woodruff . |
| 4,440,134 | 4/1984 | Nakao et al. . |
| 4,469,068 | 9/1984 | Kuroyanagi et al. . |
| 4,498,442 | 2/1985 | Tissot . |
| 4,502,445 | 3/1985 | Roca-Nierga et al. . |
| 4,541,394 | 9/1985 | Schechter et al. . |
| 4,586,480 | 5/1986 | Kobayashi et al. . |
| 4,624,231 | 11/1986 | Fenne . |
| 4,633,837 | 1/1987 | Babitzka et al. . |
| 4,681,513 | 7/1987 | Saito et al. . |
| 4,712,528 | 12/1987 | Schaffitz . |
| 4,777,921 | 10/1988 | Miyaki et al. . |
| 4,788,960 | 12/1988 | Oshizawa . |
| 4,811,715 | 3/1989 | Djordjevic et al. . |
| 4,838,232 | 6/1989 | Wich . |
| 4,884,549 | 12/1989 | Kelly . |
| 4,940,037 | 7/1990 | Eckert . |
| 5,029,568 | 7/1991 | Perr . |
| 5,042,445 | 8/1991 | Peters et al. . |
| 5,044,345 | 9/1991 | Collingborn . |
| 5,058,553 | 10/1991 | Kondo et al. . |
| 5,070,832 | 12/1991 | Hapka et al. . |
| 5,078,113 | 1/1992 | Haag et al. . |
| 5,094,216 | 3/1992 | Miyaki et al. . |
| 5,109,822 | 5/1992 | Martin . |
| 5,133,645 | 7/1992 | Crowley et al. . |
| 5,137,000 | 8/1992 | Stepper et al. . |
| 5,176,122 | 1/1993 | Ito . |
| 5,197,438 | 3/1993 | Yamamoto . |
| 5,199,402 | 4/1993 | Melchior . |
| 5,201,294 | 4/1993 | Osuka . |
| 5,203,303 | 4/1993 | Collingborn et al. . |
| 5,230,613 | 7/1993 | Hilsbos et al. . |
| 5,277,156 | 1/1994 | Osuka et al. . |
| 5,363,824 | 11/1994 | Bonse . |
| 5,364,240 | 11/1994 | Salecker . |

OTHER PUBLICATIONS

"Development Of High Speed Solenoid Valve–Investigation Of The Energizing Circuits", By Kajima, T.; Nakamura Y.; Sonoda, K; Proceedings Of The 1992 International Conference On Industrial Electronics, Control, Instrumentation, And Automation Power Electronics And Motion Control, pp. 564–569, vol. 1, Nov. 1992.

SYSTEM AND METHODS FOR ELECTRONIC CONTROL OF AN ACCUMULATOR FUEL SYSTEM

This application is a Continuation of Ser. No. 08/238,859, filed May 6, 1994, now abandoned, which is a continuation-in-part of U.S. application Ser. No. 08/057,489 entitled *Compact High Performance Fuel System With Accumulator* filed May 6, 1993 now abandoned.

This application includes a microfiche software appendix having 1 fiche containing 66 frames, which is subject to copyright protection. The copyright owner has no objection to the facsimile reproduction by anyone of the patent disclosure, as it appears in the Patent and Trademark Office files or records, but otherwise reserves all copyright rights whatsoever.

TECHNICAL FIELD

This invention relates to a system and methods for controlling fuel provision to the combustion chambers of an internal combustion engine, and in a preferred embodiment, to systems and methods for use with a multi-cylinder compression ignition engine including a high pressure fuel pump and fuel accumulator.

BACKGROUND OF THE INVENTION

For well over 75 years, the internal combustion engine has been mankind's primary source of motive power. It would be difficult to overstate its importance or the engineering effort expended in seeking its perfection. So mature and well understood is the art of internal combustion engine design that most "new" engine designs are designs made up of choices among a variety of known alternatives. For example, an improved output torque curve can easily be achieved by sacrificing engine fuel economy. Emissions abatement or improved reliability can also be achieved with an increase in cost. Still other objectives can be achieved, such as increased power and reduced size and/or weight, but normally at a sacrifice of both fuel efficiency and low cost.

An engine's fuel system is the component which often has the greatest impact on performance and cost. Accordingly, fuel systems for internal combustion engines have received a significant portion of the total engineering effort expended to date on the development of the internal combustion engine. For this reason, today's engine designer has an extraordinary array of choices and possible permutations of known fuel system concepts. Design effort typically involves extremely complex and subtle compromises among cost, size, reliability, performance, ease of manufacture and backward compatibility with existing engine designs.

The challenge to contemporary designers has been significantly increased by the need to respond to the popular demand, reflected in government mandates, for both improved fuel efficiency and a cleaner environment. In view of the mature nature of fuel system designs, it is extremely difficult to extract both improved engine performance and emissions abatement from further innovations in the fuel system art. Yet the need for such innovations has never been greater in view of broad concern for the environment and standards prompted by this concern. Meeting these standards, especially those for ignition compression engines, will require substantial innovations in fuel systems to avoid burdening consumers with significantly more costly fuel systems and/or costs of engine redesigns.

Cummins Engine Company, the assignee of this patent, has developed a revolutionary fueling system with a novel pumping and distribution configuration to address this need for innovation in meeting conflicting design criteria.

Briefly, in a preferred embodiment, the new fueling system comprises an in-line reciprocating cam driven pump, having one or more high pressure pumping cylinders, which supplies fuel to a high pressure accumulator, from which fuel is directed to a plurality of engine cylinders by a mechanical distributor valve. Dual pump control valves can be opened and closed with variable timing to change the effective pump displacement and maintain accumulator fuel pressure independent of engine speed. One or more injector control valves are provided between the accumulator and distributor, so that the same valve or valves serially controls injection timing and fuel quantity to the cylinders.

In developing this improved fueling system, there has arisen a need for an improved electronic system which is particularly adapted to control this novel system. In fact, the inventors have found that the full promise of this fueling system design (in terms of low cost, fuel efficiency, and pollution control) can only be realized through the provision of an advanced electronic control system that provides integrated control and monitoring of the different fuel flow control mechanisms making up this novel fueling system. By electronically controlling the variation of fuel delivery rates during each injection event, improved control and operating characteristics can be obtained. Further, the particular electronic control system of the present invention, with its particular novel control algorithms and signaling configurations, makes possible the implementation of many of the advantageous design choices of the fueling system in general.

In the same way that the prior art does not provide or suggest a fuel injection system which advantageously combines an in-line reciprocating pump, an accumulator, a single injector control valve and a fuel distributor, previous work in this field fails to suggest an integrated electronic system capable of controlling an in-line reciprocating pump to maintain desired pressure levels in a high-pressure accumulator through firing of all engine cylinders, and simultaneously controlling a single injector control valve to provide precise injection timing and fuel quantity control to each cylinder in sequence.

Of course, the prior art is replete with electronic control systems whose control algorithms and signal outputs are appropriate to other types of fuel injection systems. One method of controlling fuel injection using electronic controls is disclosed in Japanese Patent Application Document 57-68532 of Nakao, assigned to Komatsu. This reference discloses an electronically controlled high pressure pump and an accumulator for receiving the pump output for supply of a plurality of injection nozzles through a distributor type valve and corresponding fuel supply lines. The pressure within the accumulator is regulated by a first electronic control unit based on sensed accumulator pressure and engine position, to control the effective displacement of the high pressure pump. However, in this system, the timing and quantity of injection are varied by a separate electronic unit through control of rotary valve elements in a distributor. Thus, there is no integrated control of injection timing and rate and fuel pressure to provide precise control of fuel in the engine.

Other systems disclosed in the prior art have electronically controlled an accumulator and injection nozzles with a single control unit, but these systems similarly did not provide control of a multi-chamber pump and a single injection solenoid using an integrated electronic control system. U.S. Pat. No. RE 33,270 to Beck et at., U.S. Pat. No. 5,094,216 to Miyaki et al.,and U.S. Pat. No. 5,109,822 to Martin, U.S. Pat. No. 4,777,921 to Miyaki et al., and SAE article no. 910252 entitled *Development of New Electronically Controlled Fuel Injection System* ECD-U2 for Diesel Engines by Miyaki et al. each disclose systems where a fuel rail stores the output of a high pressure pump and distributes fuel to the cylinders through a plurality of injection nozzles, each directly connected to the fuel rail and associated with a cylinder. Each nozzle includes a separate integrated solenoid valve to control the timing and quantity of fuel flow from the accumulator into each cylinder. This system allows the fuel rail pressure (and thus the injection pressure) to be regulated as necessary independent of engine speed. The disclosed electronic control modules have a large number of outputs, each controlling an individual injector valve for each cylinder or activating a pumping mechanism.

Similarly, U.S. Pat. No. 5,201,294 to Osuka (assigned to Nippondenso) discloses a single electronic control unit (ECU) that controls a plurality of high pressure pumps and also provides a plurality of separate output lines, each transmitting control signals to an injector valve associated with an engine cylinder. The Osuka ECU operates the pumps in response to pressure in a common rail using feedback control techniques to maintain desired pressure levels. The cylinder injection control solenoid valves are similarly operated based on control instructions from the ECU in response to engine operating conditions detected by an engine speed sensor and an accelerator sensor. The pressure in the common rail is monitored to detect failure of one or both fuel pumps. Osuka's European patent application 0 501 463 A2 shows a similar system but describes in more detail the synchronous generation of control signals for pumping solenoid valves based on a calculated timing value. The control program has a section initiated by an interruption process based on engine position sensing. Another Nippondenso document, Japanese Application 05-106495, similarly describes a system which provides integrated control of cylinder injection pulses and common rail pressure. However, as in the documents discussed before, all of these Nippondenso control systems generate different injection signals on a plurality of lines connected to individual cylinder injector solenoids.

U.S. Pat. No. 5,133,645 to Crowley et al. shows a fuel injection system with an electronic control module that controls a high pressure fuel pump and a plurality of individual cylinder injector nozzles by sending low voltage, low power signals to a separate electronic distribution unit.

U.S. Pat. No. 5,137,000 to Stepper et al. and U.S. Pat. No. 5,070,832 to Hapka et al. (Cummins Electronics Company) shows an electronic engine control system which controls fuel injection in addition to performing other functions. However, such systems do not provide direct control of fuel pressure in an accumulator, and use a plurality of separately controlled fuel injector solenoids.

In some prior systems, a "boost power" circuit generates a solenoid activation voltage much higher than the system battery voltage to more quickly activate a solenoid in response to a control signal. In order to use boost circuits with control systems of the type noted above which selectively actuate one of a plurality of separate injector valves, it would be necessary to provide a plurality of boost circuits or a distribution switching circuit for channeling the boost voltage to the proper injector solenoid. Either solution would require a substantial number of costly high-power-handling components.

One method of reducing the initial volume of fuel injected during each injection event is to reduce the pressure of the fuel delivered to the nozzle assemblies during the initial stage of injection. Various devices have been developed to control or shape the fuel pressure delivered to the nozzle during the initial phase of fuel injection so as to alter the rate of fuel delivery to the nozzle assemblies. For example, U.S. Pat. Nos. 3,718,283, 3,747,857, 4,811,715 and 5,029,568 disclose devices associated with each injector nozzle assembly for creating an initial period of restricted fuel flow and a subsequent period of substantially unrestricted fuel flow through the nozzle orifice into the combustion chamber. However, these rate control devices are not electronically controlled and also require modifications to each of the fuel injector assemblies in a multi-injector system, thus adding costs and complexity to the injection system. U.S. Pat. No. 4,469,068 to Kuroyanagi et al. discloses a distributor-type fuel injection apparatus including an variable volume accumulator to vary the rate of fuel injection to achieve effective combustion. However, this device uses a complex accumulator control system to vary the rate of injection, and is designed for use with a reciprocating plunger distributor. The Miyaki SAE article noted above discloses controlling the injection rate pattern to create a gradual rise in fueling rate during an injection event, but uses fluidic means for creating this rate shaping, rather than providing a second solenoid and a control circuit for precise sequential activation of the injection solenoid and the second solenoid to create a shaped injection rate. None of these references shows an electronic control system for a fuel injection system that controls valves in series to provide variable rate control during injection.

In general, there is a need for a practical, low cost control system which works in synergy with a novel fuel injection configuration to satisfy the conflicting demands of emissions control and improved engine performance over a wide range of engine conditions.

SUMMARY OF THE INVENTION

It is a general object of the invention to overcome the deficiencies of the prior art and in particular to provide a practical, low cost control system that can be used with an internal combustion engine and fuel system that satisfies the conflicting demands of emissions control and improved engine performance. In particular, the subject invention provides a control system that can be used as part of the fuel system that provides superior emissions control and improved engine performance while requiring minimal modification of pre-existing engine designs.

Another broad object of the invention is to provide an electronic control system and method for controlling a high pressure fuel pump and a single three-way injection control valve.

A further broad object of the invention is to provide an improved electronic control system and method for event-based control of engines in non-vehicular applications.

It is another object of the invention to provide an electronic control system and method for a high pressure fuel pump assembly that includes a pump, accumulator and distributor combined with an electrically operated pump control valve and an injection control valve in a unitized assembly.

Another object of the invention is to provide an electronic control system and method for controlling a high pressure fuel pump and an injection control valve that minimizes the amount of wiring in the engine compartment.

A further object of the invention is to provide an electronic control system and method for controlling a high pressure fuel pump and an injection control valve that minimizes the need for distribution and interface circuitry.

In addition, it is an object of the invention to provide a driver circuit for controlling an injection control valve that measures the back EMF of the solenoid coil to accurately determine the time of opening of the valve, and to predict and control future opening times synchronously with engine rotation.

Another object of the invention is to provide an electronic control system and method for controlling an injection control valve that compensates for uneven fuel line lengths and uneven fuel travel times between the valve and different injector nozzles controlled by the valve.

A further object of the invention is to provide an electronic control system and method for controlling a single injection control valve controlling fuel injection to a plurality of cylinders that compensates for uneven fuel line lengths to the cylinders by varying a delay time for transmission of timing signals depending on which cylinder is to be fueled.

An additional object of the invention is to provide an electronic control system and method that uses battery voltage, rather than a boosted voltage, to precisely control an injection control valve.

Another object of the invention is to provide an electronic control system and method that provides a pre-biasing current at battery voltage to an injection control valve prior to a desired time of an injection event and then provides an increased opening current at the same voltage at a desired time of opening, thus eliminating a need for boosted solenoid opening voltages.

Another object of the invention is to provide a control system and method for startup pressurization of a high pressure fuel accumulator in the first revolution, prior to the first output of an engine angular position indicator during starting of the engine.

Another object of the invention is to provide a control system and method for startup pressurization of a high pressure fuel accumulator which generates a train of pump control signals during initial revolution(s) of the engine until engine angular position sensors provide an accurate indication of engine angular position to allow timed control of the pump.

It is also an object of the invention to provide an improved control system and method for monitoring pressure variations in a high pressure accumulator in conjunction with injection events, and detecting pump failures or weaknesses based on the pressure variations.

Another more specific object of the invention is to provide an improved electronic control system and method for event based control of engines in non-vehicular applications which provides an anticipatory response to an input indication that a load is to be applied.

Another more specific object of the invention is to provide an improved electronic control system and method for event based control of engines which immediately increases engine power upon receiving a signal indicating that an increased load level is being applied.

The invention also has the object of providing an improved electronic control system and method for event based control of engines which monitors a load application control signal and changes fueling levels to increase engine power when the load is to be applied, so that engine power increases synchronously with the increased load level rather than in response to changes in engine operation resulting from an unexpected load application.

Still another object of the invention is to provide a control system for a high performance, high pressure fuel system designed for retrofitting on existing engine designs of the compression ignition type without requiring substantial and costly engine redesign. In particular, the invention provides a control system that operates with a fuel system that has the above characteristics while also improving engine efficiency by minimizing the parasitic losses even though fuel pressure is raised to a very high level.

It is a further object of the invention to provide a highly integrated fuel control system for an internal combustion engine that results in minimal impact on pre-existing engine designs while still providing precise control over injection quantity and timing, redundant fail safe electronic components, and improved engine efficiency at overall reduced costs with respect to competing prior art systems.

Another object of the invention is to provide a control system for a fuel pump assembly providing a pump housing having plural pump chambers and plural solenoid operated pump control valves corresponding in number to the pump chambers for controlling the effective displacement of associated pump plungers operating within each pump chamber. By this arrangement, a pressure signal representative of the pressure of the fuel in the fuel pump accumulator may be used by the control system to control the solenoid operated pump control valves to adjust thereby the effective displacement of the plungers to cause the pressure of fuel in the accumulator to equal a predetermined pressure level.

Still another object of the invention is to provide an electronic control system for a compression ignition engine which is capable of achieving very high injection pressures, e.g. 5000–30,000 psi and preferably 16,000–22,000 psi, with precise control over quantity and timing in response to varying engine conditions.

It is also an object of the invention to provide an electronic control system for a fuel pump assembly characterized by the combination of a pump, distributor, and accumulator.

Another object of the invention is to provide a digital electronic fueling control system for controlling a pair of pump control valves associated with a pump feeding an accumulator, to thereby control displacement of the pump elements so that they share the load and maintain desired fuel pressure. A first injection control valve is provided to control a pre-injection portion of the injection for each cylinder and a second injection control valve associated with the first injection control valve is provided to control a main injection portion of the injection for each cylinder. The electronic control system may also cause a backup valve to take over if one of the control valves (pump or injection) should become disabled.

Another object of the invention is to provide an electronic control system for a novel fuel system having a three-way valve, operable when energized to connect an axial supply passage in a fuel distributor rotor with a high pressure fuel accumulator and operable when de-energized to connect the axial supply passage in the distributor rotor with a low pressure drain.

Yet another object of the present invention is to provide an electronic digital control system with rate-shaping capability for controlling the amount of fuel injected during the initial portion of the injection event by controlling the increase in pressure at the nozzle assembly.

Those skilled in the art will understand further objects of the invention by reviewing the drawings in conjunction with the detailed disclosure of the invention herein.

The objects of the invention are achieved in a preferred embodiment by providing an electronic digital control system, integral with an engine's fuel system, that monitors and controls the operation of the engine and fuel system. The control system is implemented through a combination of digital and analog components and includes a microprocessor used to compute fuel timing and quantity. Signals to activate injection to a plurality of cylinders are transmitted through a single line to a driving circuit for a single injector solenoid valve. The control system also performs other functions related to the fuel system, such as, for example, controlling fuel pressurizing pumps.

The preferred embodiment also provides a variable rate of fuel delivery during each injection event that reduces the level of emissions generated by the diesel fuel combustion process by decreasing the volume of fuel injected during the initial stage of the injection event. A back EMF sensor is provided for the injector solenoid and/or the pump control solenoids to precisely determine opening time delays and to automatically compensate for variations in these delays over time. In addition, variable programmed delays specific to each cylinder are provided, synchronously with the fueling of the respective cylinders, in the output signal pulses transmitted to the injection solenoid activation circuit. These delays compensate for and permit use of varying fuel line lengths between the distributor and the individual cylinder injector nozzles so that the fuel reaches each cylinder at the desired time.

At startup, the system generates a train of pump control signals at a predetermined spacing and duty cycle to activate the pumping control solenoids during initial revolution(s) of the engine, until engine angular position sensors provide an accurate indication of engine angular position to allow precise timed control of the pump. Pressure variations in the high pressure accumulator are monitored by the control system in conjunction with injection events, and pump equipment failures or weaknesses are detected based on the pressure variations.

In an alternative embodiment of the invention, a pre-biasing current at battery voltage is provided to the injection control valve prior to the desired time of an injection event. Then, an increased opening current at the same voltage is provided at the desired time of opening, thus providing precise control and fast reaction of the solenoid to control signals, while eliminating the need for boost circuits to provide a large solenoid opening voltage.

In embodiments of the invention where the engine is not used for vehicular motive power, the electronic control system monitors a load application control signal and changes fueling levels to increase engine power when the load is to be applied, so that engine power increases synchronously in conjunction with the increased load level, rather than in response to a power drain resulting from an unexpected load application.

The control system of the present invention, by integrally controlling both a multi-chamber high pressure pump to maintain a desired pressure range in a high pressure accumulator, and also controlling an injection solenoid by transmitting injection signals for all cylinders through a single solenoid control output, provides numerous unobvious advantages.

First, this control system works synergistically with the novel engine fueling component system described previously to achieve substantial benefits which could not be fully realized by providing either the electronic controls or the novel fuel system component configuration in the absence of the other. Whereas other fueling system options would require adaptive redesign of the engine block and/or cylinder head of an engine, the electronically controlled engine fueling component system described above can be mounted on many diesel and other internal combustion engines without any redesign of the engine block. Also, the electronically controlled system of the present invention provides improved fuel economy while at the same time reducing harmful emissions. In short, the full operational benefits of the engine fueling component system design cannot be obtained without an electronic control system that provides the control signals needed by the fueling system, and at the same time enhances system operation by implementing precision control algorithms that reduce emissions and improve engine performance, economy, and safety.

Second, by combining injector control signals for all cylinders and providing these control signals in a single injector control output, the need for wiring in the engine compartment is substantially reduced. In particular, the system requires only a single relatively short wire leading from the electronic control system to the single injector solenoid valve, rather than six or more wires, each leading to a different cylinder injector nozzle at the cylinder head. In cases where it is desirable to separate the digital computer control function from power driving circuits for the solenoid valves, the provision of a single injector solenoid control output makes it possible to rely on a simple connecting bus between the digital control device and the power driving circuits. Such a bus may use simple binary control signals and may have as few as three or four wires to control timing of all pumping and injection functions. In contrast, such a control bus with an electronic control module of the prior art would have required six or more control lines just to control the individual cylinder injector solenoids, and additional lines to control the accumulator pressure. Minimizing the number of wires in the engine compartment and the length of the wires reduces cost and enhances serviceability be keeping wires out of the way. In the case of essential systems like fuel injection systems, reducing the amount of wiring in the system enhances reliability by minimizing the possibility of these essential connections experiencing heat damage, mechanical damage during engine operation, and damage during engine service. Minimizing the number of wires also reduces both the generation and the reception of electromagnetic interference, and thus reduces the need for shielding and EMF filtering in the control circuits. For all these reasons, the reduction in the number of wires achieved by the present control system is highly advantageous.

Third, the control circuit of the present invention can be more easily and effectively adapted to provide more accurate injection timing and fueling rates by the addition of back EMF sensing functions, compared to prior art circuits with multiple solenoid control outputs. This advantageous result is obtained because the present circuit has only one injector solenoid output for which current flows must be monitored. In the prior art, it would have been necessary either to provide a plurality of back EMF sensing circuits, or to provide an interface circuit allowing a single circuit to sense currents flowing to a plurality of injector solenoids. The present control system, by providing combined control of fuel pump solenoids and transmitting all of its injector solenoid signals to a single output and thence to the single injector solenoid, eliminates the need for multiple wires and switching devices connecting the back EMF sensor to the solenoids. In this way, this electronic control system minimizes both electromagnetic field-type and interfacing circuit-type interference with sensing operations. Further, this design makes it possible to more easily dynamically compensate for manufacturing variations and wear that result in variation in the time period and voltage required for opening a given injection valve, so that the valve opens at a precise desired time. Only a single valve must be sensed, and since this valve is constantly used to control injection to all cylinders, the sensing algorithm can more immediately detect changes in the valve response time during engine operation. The system can store and analyze a single set of data describing valve response to output signals, rather than trying to compensate for different variations in a plurality of different valves.

Fourth, the control circuit of the present invention can be more easily and effectively adapted for rate shaping of fuel injection, compared to prior art circuits with multiple solenoid control outputs. This advantageous result is obtained because the present circuit has only one injector solenoid control. Therefore, rate shaping operations, which require accurate prediction of valve response and uniformity of response across the plurality of cylinders, can be accomplished more accurately when only one valve control signaling circuit must be activated. Variations in the response of different signaling circuits, and variations in response of a plurality of solenoids, are eliminated by the configuration of the present invention. The present control system, by providing combined control of fuel pump solenoids and transmitting all of its injector solenoid signals to a single output and thence to the single injector solenoid, eliminates the need for multiple wires and switching devices transmitting the rate shaping commands to the solenoids. In this way, the electronic control system minimizes both electromagnetic field-type and interfacing circuit-type interference with precision solenoid pulsing operations. Further, as noted above, this design makes it possible to dynamically compensate for manufacturing variations and wear that result in variation in the time period and voltage required for opening the injection valve using back EMF techniques. A combination of back EMF and rate shaping techniques can be applied using the present invention to achieve a level of precision and repeatability in fuel injection that could not be easily achieved with the prior art multiple valve control systems. In particular, the system can store and analyze a single set of data describing valve response to output signals, rather than trying to compensate for different variations in a plurality of different valves, and can use this information on response of the single valve to perform desired rate shaping functions.

Thus, the electronic control system disclosed herein makes possible significant improvements in engine operation, fuel economy, emissions, and production economy.

DESCRIPTION OF THE PREFERRED EMBODIMENTS

Figure 1:
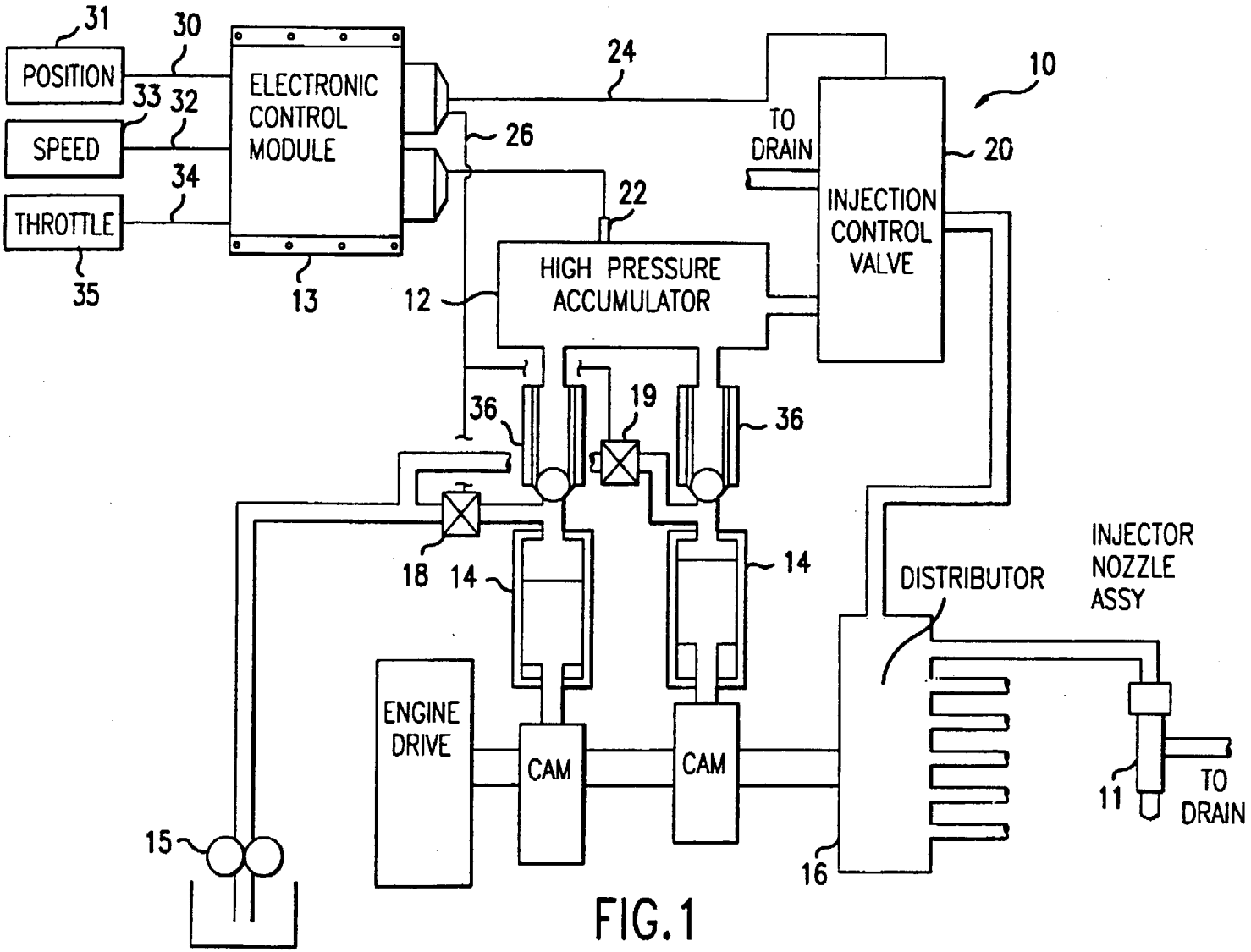
FIG. 1 is a schematic block diagram showing a fuel system and control system in accordance with the present invention.

FIG. 1 shows the unitized fuel delivery assembly and control system controlled by the present invention in schematic form, indicated generally at 10. The system includes a high pressure accumulator 12 for receiving high pressure fuel for delivery to fuel injectors of an associated engine, a high pressure pump 14 for receiving low pressure fuel from a low pressure supply pump 15 and delivering high pressure fuel to accumulator 12 and a fuel distributor 16 for providing periodic fluidic communication between accumulator 12 and each injector nozzle 11 associated with a respective engine cylinder (not shown).

The assembly also includes one or more injection control valves 20 positioned along the fuel supply line from the accumulator 12 to the distributor 16 for controlling the timing and quantity of fuel injected into each engine cylinder in response to control signals received from an electronic control module (ECM) 13. Also, at least one pump control valve 18, 19 positioned along the fuel supply line to pump 14 is provided for controlling the amount of fuel delivered to accumulator 12 so as to maintain a desired fuel pressure in accumulator 12. Pressure sensor 22 is provided to measure the pressure of the fuel in accumulator 12.

The components of the fuel system may be constructed according to the disclosure in copending U.S. patent application Ser. No. 08/057,489 entitled *Compact High Performance Fuel System With Accumulator* filed May 6, 1993 and preferably according to the disclosure of its copending continuation-in-part application of the same title filed May 6, 1994 as a PCT application in the U.S. Receiving Office, Ser. No. PCT/US94/05108, both of which are incorporated herein by reference. The injection control valve 20 is preferably constructed according to the disclosure of copending U.S. patent application Ser. No. 08/034,841 entitled Force Balanced Three-way Solenoid Valve filed March 19, 1993 (now U.S. Pat. No. 5,396,926) or U.S. patent application Ser. No. 08/041,424 entitled *Compact Pin-Within-A-Sleeve Three-way Valve* filed March 31, 1993 both of which are incorporated herein by reference. The high pressure pumping mechanism 14, 18, 19 may be constructed according to the disclosure of copending U.S. Pat. No. application Ser. No. 08/057,510 entitled *Variable Displacement High Pressure Pump For Fuel Injection Systems* filed May 6, 1993 (now U.S. Pat. No. 5,404,855) which is incorporated herein by reference. The distributor 16 is preferably constructed according to the disclosure of copending U.S. patent application Ser. No. 08/117,697 entitled *Distributor For High Pressure Fuel Injection System* filed Sep. 8, 1993, now U.S. Pat. No. 5,353,766, the contents of which is incorporated herein by reference.

ECM 13 controls the operation of the pump control valves 18, 19 and the injection control valve 20 based on various engine operating conditions to accurately control the amount of fuel delivered by the distributor 16 to the injector nozzle 11 thereby effectively controlling fuel timing, delivery and metering. ECM 13 is connected with injection control valves 20 through injection control line 24. Injection control line 24 allows ECM 13 to monitor and control the operation of injection control valve 20, as described in more detail below. ECM 13 is also connected with pump control valves 18 and 19 and pressure sensor 22. ECM 13 can monitor the pressure in accumulator 12 using pressure sensor 22 and control the operation of pump control valves 18 and 19 to ensure that accumulator 12 contains fuel at a desired pressure. The operation of this function of the present invention is also described in more detail below.

The external connections of ECM 13 that are used to sense the operating characteristics of the internal combustion engine are also shown in FIG. 1. ECM 13 is connected to external engine monitoring devices through input lines 30, 32 and 34. Although only three lines are shown in FIG. 1, any number of lines could be provided to connect ECM 13 with appropriate engine sensors. As shown, input line 30 is connected with an engine position sensor 31 that provides information about the position of an internal combustion engine to ECM 13. For example, the position sensor could be placed on the camshaft of the internal combustion engine and configured to provide a single electrical pulse to ECM 13 indicating when cylinder number 1 of the engine is at a top dead center (TDC) position. In this manner, an accurate determination of the rotational position of the internal combustion engine can be made within a single revolution of the engine camshaft. Of course, other position sensing means could be employed with the present engine control system to achieve the purposes of the present invention.

Input line 32 is connected with a speed sensor 33 that provides information concerning the speed of the internal combustion engine to ECM 13. For example, the speed sensor may be a Hall effect type sensor that generates and transmits a single pulse to ECM 13 for each tooth on a crankshaft gear that passes the sensor. If the crankshaft gear has, for example, 72 teeth, then 72 pulses would be provided to ECM 13 for each complete revolution of the engine crankshaft. By measuring the time between these pulses, ECM 13 can easily and accurately determine the rotational speed of the internal combustion engine. Of course, other speed sensors could also be used with the present invention.

Input line 34 is connected with a throttle position sensor 35 that provides information concerning the present throttle position of the internal combustion engine to ECM 13. The throttle position sensor 35 could be any standard sensor employed to detect the throttle position of an internal combustion engine.

Using the information received from engine position sensor 31 and speed sensor 33, ECM 13 can also easily and accurately determine the rotational position of the internal combustion engine at any point in time. Specifically, engine position sensor 31 provides an indication of a predetermined engine position for every full rotation of the engine camshaft. For example, engine position sensor 31 could provide a pulse at each occurrence of the top dead center of engine cylinder number 1. As discussed above, this provides a positive indication to ECM 13 of the exact rotational position of the engine at the time that the pulse is received. Furthermore, as discussed above, engine speed sensor 33 provides a series of pulses for each tooth on the engine crankshaft gear. Therefore, if the number of teeth on the crankshaft gear is known, it is possible to determine the amount of rotation of the crankshaft gear by counting the number of pulses and comparing that to the total number of pulses for a full revolution of the crankshaft.

To illustrate, if the crankshaft gear has 72 teeth, then 72 pulses will be received from speed sensor 33 by ECM 13 for each revolution of the engine crankshaft. Furthermore, since the engine crankshaft will complete two complete revolutions (720°) for each single revolution (360°) of the engine camshaft, then 144 pulses will be received from speed sensor 33 by ECM 13 for each revolution of the internal combustion engine camshaft. Therefore, ECM 13 can begin counting pulses received from speed sensor 33 after the position indicating pulse is received from position sensor 31. If for example, ECM 13 receives 36 pulses (representing engine crankshaft gear teeth) since the last position pulse (representing TDC of cylinder number 1) was received from position sensor 31, then ECM 13 can mathematically calculate the position of the internal combustion engine. Since 36 divided by 144 equals 0.25, the engine camshaft has rotated one quarter turn beyond the top dead center of engine cylinder 1. Similarly, since the engine crankshaft makes two complete revolutions for each single revolution of the camshaft, 36 pulses would indicate that the engine crankshaft has completed one half revolution since the last pulse was received from position sensor 31.

As discussed above, position sensor 31 could be connected to the camshaft of an internal combustion engine and provide a single pulse at a predetermined position to indicate the exact rotational position of the engine. Due to manufacturing and operating tolerances, the engine crankshaft will provide a more accurate measure of the engine's rotational position. However, due to space and size constraints, it may not be possible or desirable to place an additional position sensor on the engine crankshaft. Therefore, to overcome these problems, position sensor 31 can be designed to connect with the engine camshaft and to provide a single pulse at some time just prior to a pulse from speed sensor 33, which pulse represents a known predetermined engine position. Therefore, when ECM 13 receives a pulse from position sensor 31, it knows that the next pulse received from speed sensor 33 will occur when the engine is at a predetermined position, such as the TDC of cylinder number 1. This allows the control system to take advantage of the more accurate position measurement that can be made from the engine crankshaft without the necessity of providing an additional sensor on the crankshaft or crankshaft gear itself.

From the above example it will be apparent to those of skill in the art that the exact rotational position of the internal combustion engine can be determined simply from the engine position sensor 31 and the speed sensor 33 described above. Furthermore, other methods of determining the engine position and speed from the use of these two sensors will be apparent to those of skill in the art.

The operation of ECM 13 in monitoring the pressure in accumulator 12 using pressure sensor 22 and in controlling the operation of pump control valves 18 and 19 to ensure that accumulator 12 contains fuel at the proper pressure will now be described in more detail. Referring first to FIG. 1, it can be seen that high pressure pumps 14 receive fuel from a low pressure supply pump 15 through pump control valves 18 and 19.

Generally, pump control valves 18 and 19 remain open so that fuel from low pressure supply pump 15 may be delivered during the downstroke of each pump 14. During the compression stroke of each pump 14, with pump control valves 18 and 19 open, fuel will be forced back to low pressure supply pump 15 or to a drain (not shown) and returned to a fuel reservoir. If, however, it is desired to supply additional pressurized fuel to the accumulator 12, then pump control valve 18 or 19 will be closed during the compression stroke of the respective high pressure pump 14. With pump control valve 18 or 19 closed, pressure will build in the chamber of high pressure pump 14 until it is sufficiently great to overcome the pressure in accumulator 12 and thereby open the respective check valve 36. As high pressure pump 14 continues to pressurize the fuel, it will pass through check valve 36 and into high pressure accumulator 12.

Because of the extremely high pressure generated by pumps 14, pump control valves 18 and 19 will remain closed even though a control signal from ECM 13 is no longer present. Control valves 18 and 19 can be such that the pressure from the chamber of the corresponding high pressure pump 14 will hold the valve in a closed position, despite the absence of a control signal commanding the valve to remain closed. In the most preferred embodiment of the invention, it is not necessary to use costly, high pressure valves for pump control valves 18 and 19. Rather, a lower cost solenoid actuated valve can be used that will remain closed due to the pressure generated by high pressure pumps 14 despite the absence of the control signal from ECM 13. This has the further advantage in the present invention of allowing ECM 13 to calculate the desired initiation time of a pumping event, command that pumping event to initiate, and to continue processing other tasks. It is not necessary for ECM 13 to positively indicate the end of the pumping event, since the pumping event will automatically terminate when the piston of high pressure pump 14 begins its downward travel and thus relieves pressure from pump control valves 18 and 19.

Therefore, as will be discussed in more detail below in connection with the software used by the present control system, ECM 13 needs merely to determine at which point in the compression stroke of high pressure pump 14 the appropriate pump control valve 18 or 19 should be closed. To facilitate this determination, ECM 13 monitors the pressure in accumulator 12 using pressure sensor 22. When the analysis of the pressure signal from pressure sensor 22 indicates that additional pressurized fuel should be added to accumulator 12, ECM 13 calculates at which point in the compression stroke of the high pressure pumps 14 the respective pump control valve 18 or 19 should be closed. ECM 13 then generates an appropriate timing signal to ensure that an adequate amount of pressurized fuel is added to accumulator 12.

As discussed above, once ECM 13 closes pump control valve 18 or 19, the pressure generated by high pressure pumps 14 will keep pump control valves 18 or 19 closed until the end of the pumping event. This allows ECM 13 to benefit from an automatic termination of the pumping event. However, when ECM 13 issues a control signal to pump control valves 18 or 19, the duration of this signal must be sufficient to ensure that the pressure produced by high pressure pumps 14 is adequate to hold pump control valves 18 or 19 closed. In a less preferred embodiment of the present invention, ECM 13 generates a signal of a fixed time duration and uses that fixed time signal to control pump control valves 18 or 19. However, since high pressure pumps 14 are mechanically interfaced with the internal combustion engine, the speed of pumps 14 vary with the engine speed. This results in the pressure developed in the chamber of the pumps 14 to vary with the speed of the engine. Therefore, an unnecessary long fixed time must be used by ECM 13 in order to ensure that adequate pressure is produced by high pressure pumps 14 to hold the pump control valves 18 and 19 closed when the internal combustion engine is operating at a low speed. This fixed duration signal is not necessary however when the internal combustion engine is operating at a high rpm.

Therefore, in the most preferred embodiment of the present invention, ECM 13 generates a control signal to pump control valves 18 and 19 that has a duration that is related to the rotational position of the internal combustion engine. For example, ECM 13 could generate a control signal to valve 18 or 19 having, for example, a duration approximately equivalent to the time required for 40° of engine crankshaft rotation. Pumps 14 will generate substantially the same pressure in the pumping chamber during the time required for 40° of crankshaft rotation to occur independent of the rotational speed of the engine. In this manner, ECM 13 can generate a control signal to pump control valves 18 and 19 having a duration that is the minimum required to ensure that adequate pressure is developed by high pressure pumps 14 to maintain pump control valves 18 and 19 closed independent of engine speed.

ECM 13 also operates pump control valves 18 and 19 in a unique manner during engine start up in order to facilitate pressurization of accumulator 12. This operation is discussed in more detail below in connection with the engine position sensor operation.

Figure 2A:
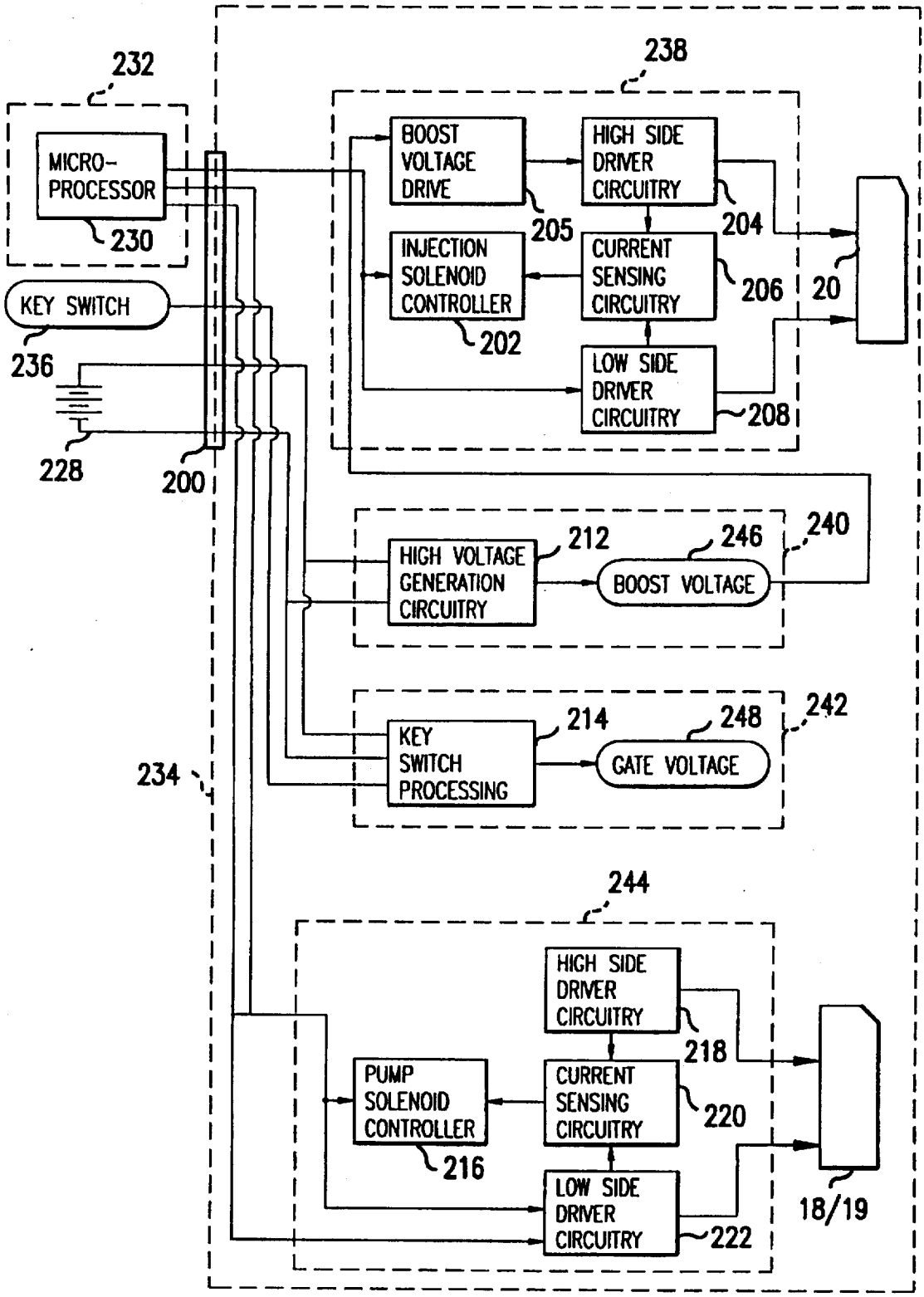
FIG. 2*a* is a block schematic diagram of the electronic control system of the fueling system of FIG. 1 according to the present invention.

A block diagram of the control system of the present invention is shown in FIG. 2*a*. As can be seen in that Figure, the control system in the most preferred embodiment of the present invention includes a digital control portion 232 and a driver portion 234 that are connected through connector 200. It is thought that the digital control portion 232 and driver portion 234 should be separated to avoid electromagnetic interference (EMI) between the respective components thereof. However, if EMI problems can be eliminated or reduced, space considerations may dictate that the two portions be combined into a single, integrated unit.

Also connected to the driver portion 234 through connector 200 are battery 228 positive and negative terminals and a vehicle keyswitch indication 236. The provision of the battery terminals provides power to the driver portion 234 and the terminals are used by the driver portion 234 to control the operation of the fueling and pumping elements of the fuel system. Furthermore, the keyswitch indication 236 provides an indication that the vehicle switch is activated, thus provided a fail-safe mechanism to prevent erroneous operation of the fueling or pumping circuitry when the vehicle switch is in an OFF position.

Digital portion 232 includes a microprocessor 230, which may be a 68331 or 68332 commercially manufactured by Motorola. Also, digital portion 232 includes the respective supporting integrated circuits (not shown) for operation of microprocessor 230. Furthermore, if desired for the operation of microprocessor 230, digital portion 232 could include additional memory or diagnostic circuitry.

Generally, the interface between the digital portion and the driver portion 234 through connector 200 is particularly simple in the present invention. This results from the design of the fuel system and particularly from the use of a single injection solenoid. In the most preferred embodiment of the invention, the digital portion 232 provides a pump command, pump select, and a injection command signal to the driver portion 234. The pump select signal directs the driver circuitry to select a given high pressure pump 14 to be used in a pumping event to pressurize accumulator 12. The pump command signal directs the driver circuit to close the pump control solenoid valve 18 or 19 associated with the selected pump 14, thereby initiating a pumping event. The injection command signal directs the driver circuitry to open the injection control valve 20, thus supplying fuel from the high pressure accumulator to the appropriate engine cylinder selected by distributor 16.

From the above description it will be apparent that the control system of the present invention has a simple interface between a digital portion and a driver portion. Since this separation is desirable, or even necessary, to avoid EMI between the two portions, the reduced number of interconnections required with the present invention will substantially reduce the cost and complexity of the present control system.

From FIG. 2*a*, it can be seen that driver portion 234 includes injection solenoid driver circuitry 238, high voltage boost generation circuitry 240, keyswitch processing circuitry 242 and pump solenoid driver circuitry 244. Generally, the battery terminals will be provided to the high voltage boost generation circuitry 240 and keyswitch processing circuitry 242. The high voltage boost generation circuitry 240 uses this battery voltage to generate a boost voltage output 246 that is supplied to the injection solenoid driver circuitry 238 and pump solenoid driver circuitry 244 (if required). Because the present invention only has a single injection solenoid, it is not necessary that a plurality of boost circuits or complex high-power switching arrangements be used to supply a boost voltage to a plurality of injector solenoids. This greatly reduces the cost and complexity of the present system. The keyswitch processing circuitry 242 uses the battery voltage to generate a gate voltage provided on a gate voltage output 248 that is used to power the circuitry in the injection solenoid driver circuitry 238 and pump solenoid driver circuitry 244. In this manner, unless the keyswitch processing circuitry 242 generates an appropriate gate voltage provided on gate voltage output 248 in response to a valid keyswitch indication 236, then injection solenoid driver circuitry 238 and pump solenoid driver circuitry 244 will not operate. Thus, keyswitch processing circuitry 242 acts as a fail-safe circuit prevent erroneous operation of the control system.

Injection solenoid driver circuitry 238 is connected to microprocessor 230 through a single injection command signal line. Pump solenoid driver circuitry 244 is connected to microprocessor 230 through a pump select signal line and a pump command signal line. These three lines provide the signals to control the operation of the injection solenoid driver circuitry 238 and pump solenoid driver circuitry 244.

Injection solenoid driver circuitry 238 includes injection solenoid controller 202, high side driver circuitry 204, current sense circuit 206 and low side driver circuit 208. Injection solenoid controller 202 is connected with the injection command signal line through connector 200 for receiving an injection command signal; with boost driver circuitry 205 for controlling the application of a high voltage control signal to injection solenoid valve 20; with current sense circuitry 206 for receiving an indication of the value of the current being supplied to injection solenoid valve 20; and with low side driver circuitry 208 for receiving a injection command. High side driver circuitry 204 and low side drive circuitry 208 are connected to injection solenoid valve 20 and to current sensing circuitry 206 to allow for the sensing of the solenoid current.

High voltage boost generation circuitry 240 includes high voltage generation circuitry 212 and boost voltage output 246. The high voltage generation circuitry 212 receives battery voltage from battery 228 through connector 200 and generates a high voltage boost signal that is provided on boost voltage output 246. Typically, this boost voltage is in the range of 100 to 250 Vdc and preferably in the range of 150 to 200 Vdc. The boost voltage generated by high voltage boost generation circuitry 240 is provided to injection solenoid driver circuitry 238 for use in operating the injection solenoid valve.

Pump solenoid driver circuitry 244 includes pump solenoid controller 216, high side driver circuitry 218, current sense circuit 220 and low side driver circuit 222. Pump solenoid controller 216 is connected with the pump command signal line through connector 200 for receiving a pump command signal; with high side driver circuitry 218 for controlling the application of a voltage control signal to pump control valves 18/19; with current sense circuitry 220 for receiving an indication of the value of the current being supplied to pump solenoid control valves 18/19; and with low side driver circuitry 222 for receiving a pump command. High side driver circuitry 218 and low side drive circuitry 222 are connected to pump solenoid control valves 18/19 and to current sensing circuitry 220 to allow for the sensing of the solenoid current.

Figure 2B:
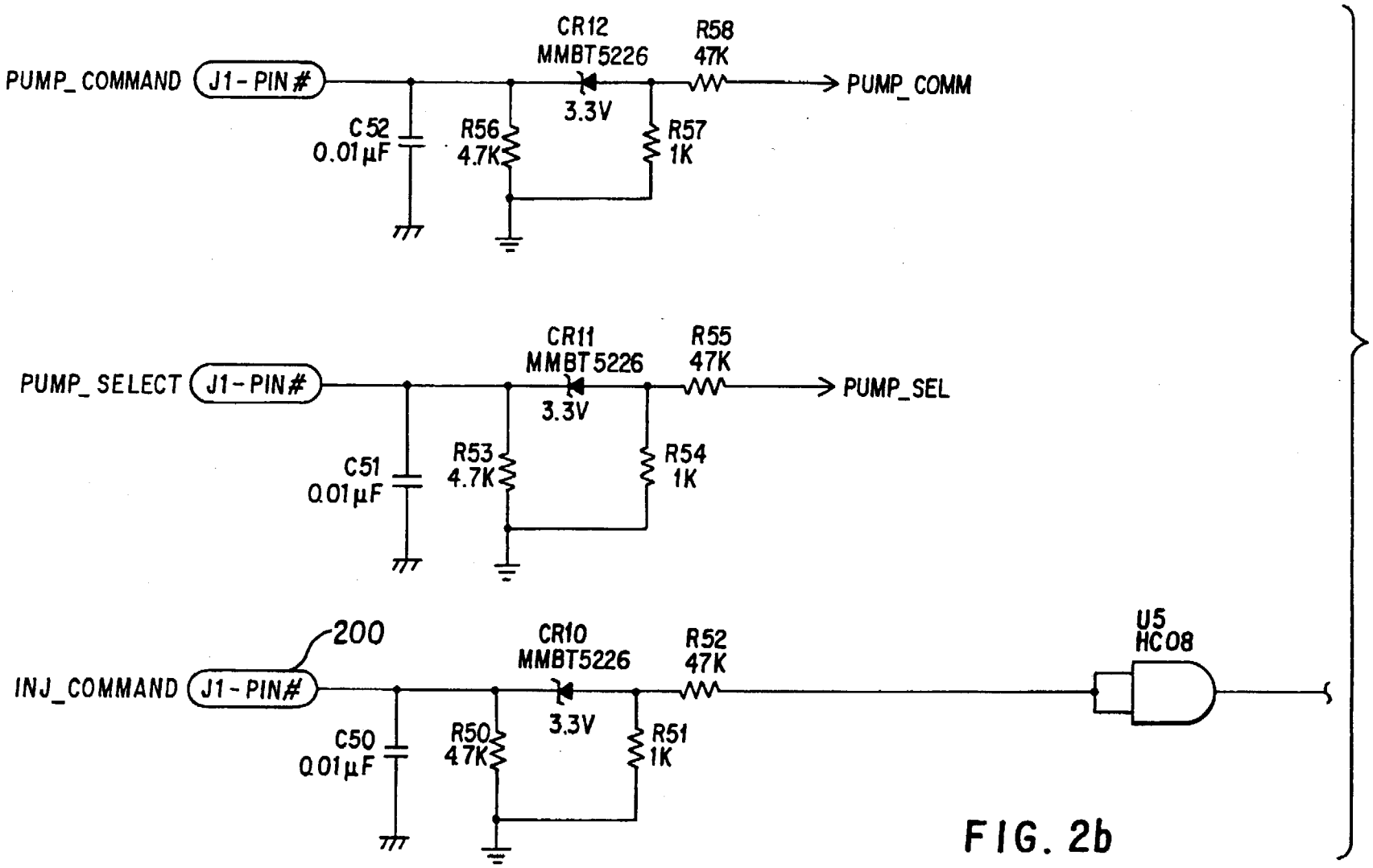
FIGS. 2*b* through 2*e* are circuit diagrams showing detailed construction of interface and power components of the electronic control system of FIG. 2*a*.
Figure 2C:
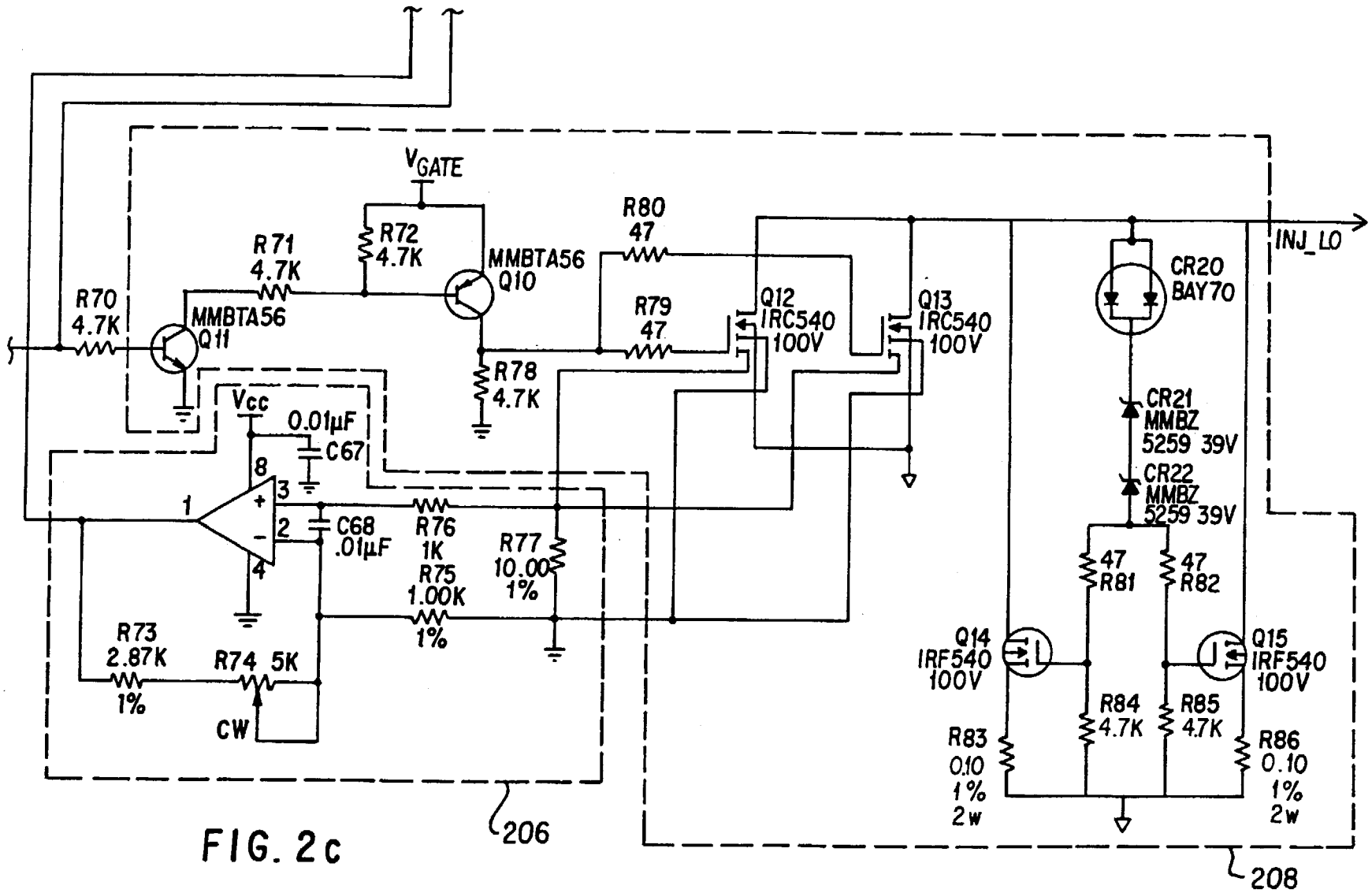
Figure 2D:
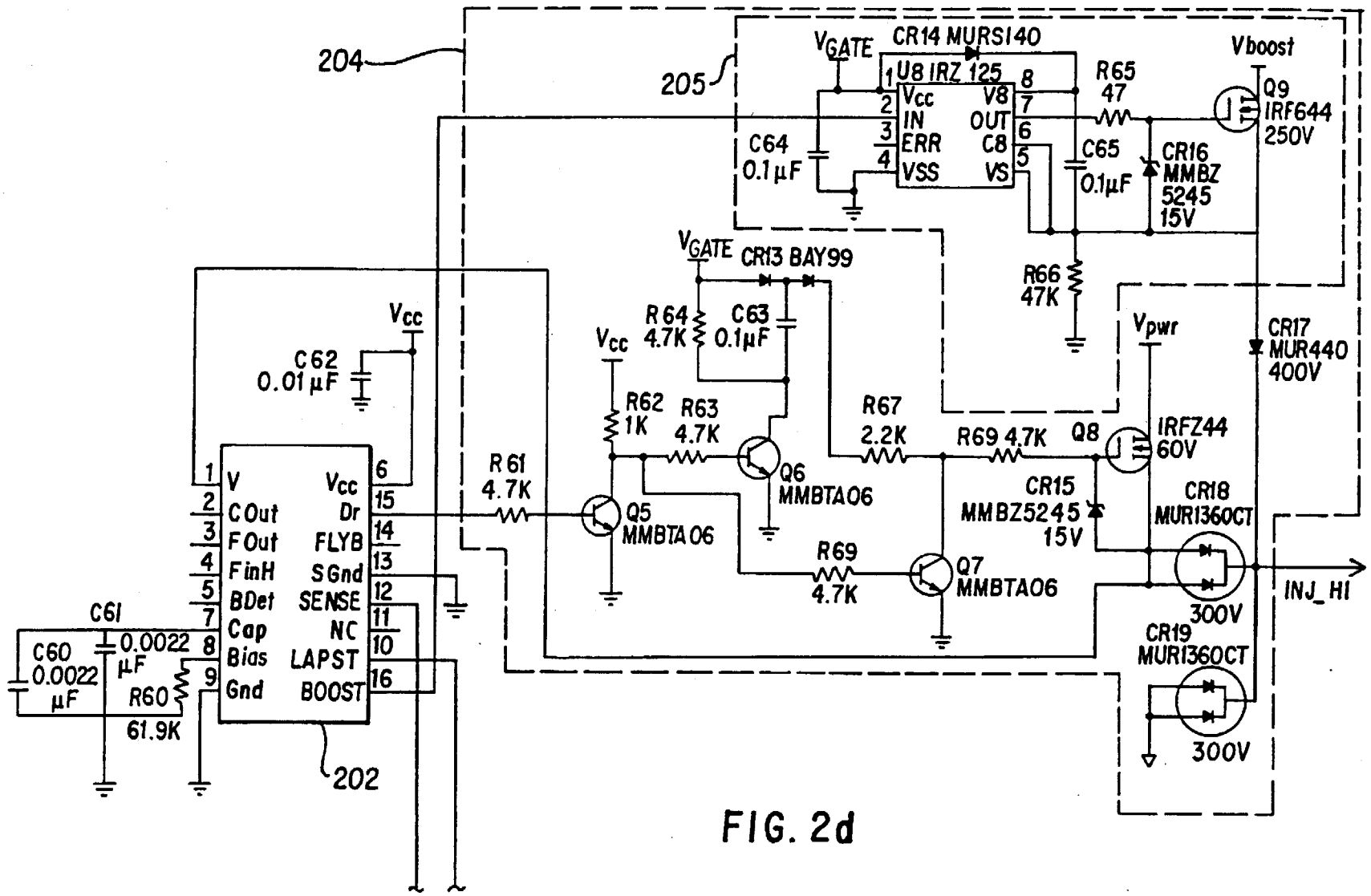
Figure 2E:
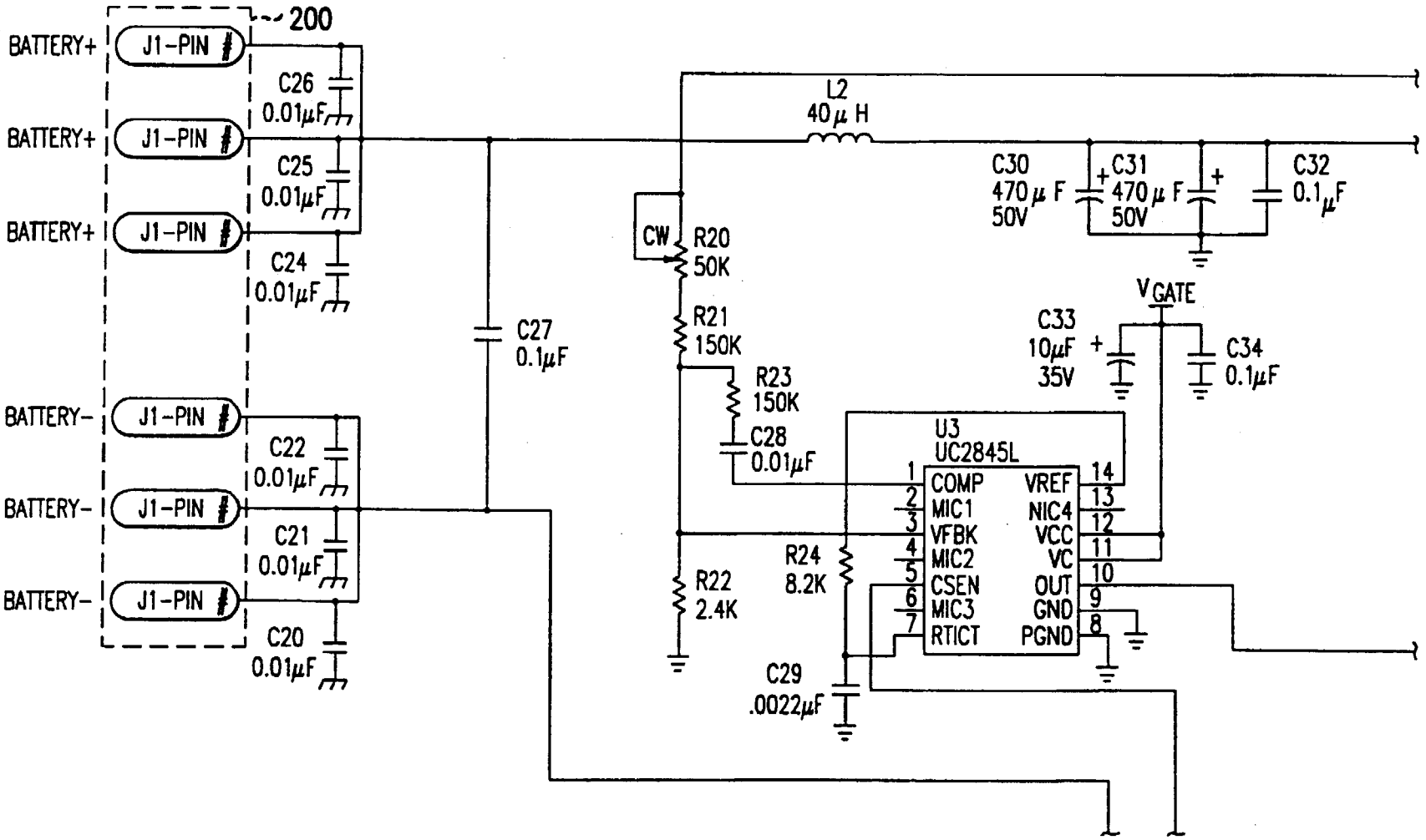
Figure 2F:
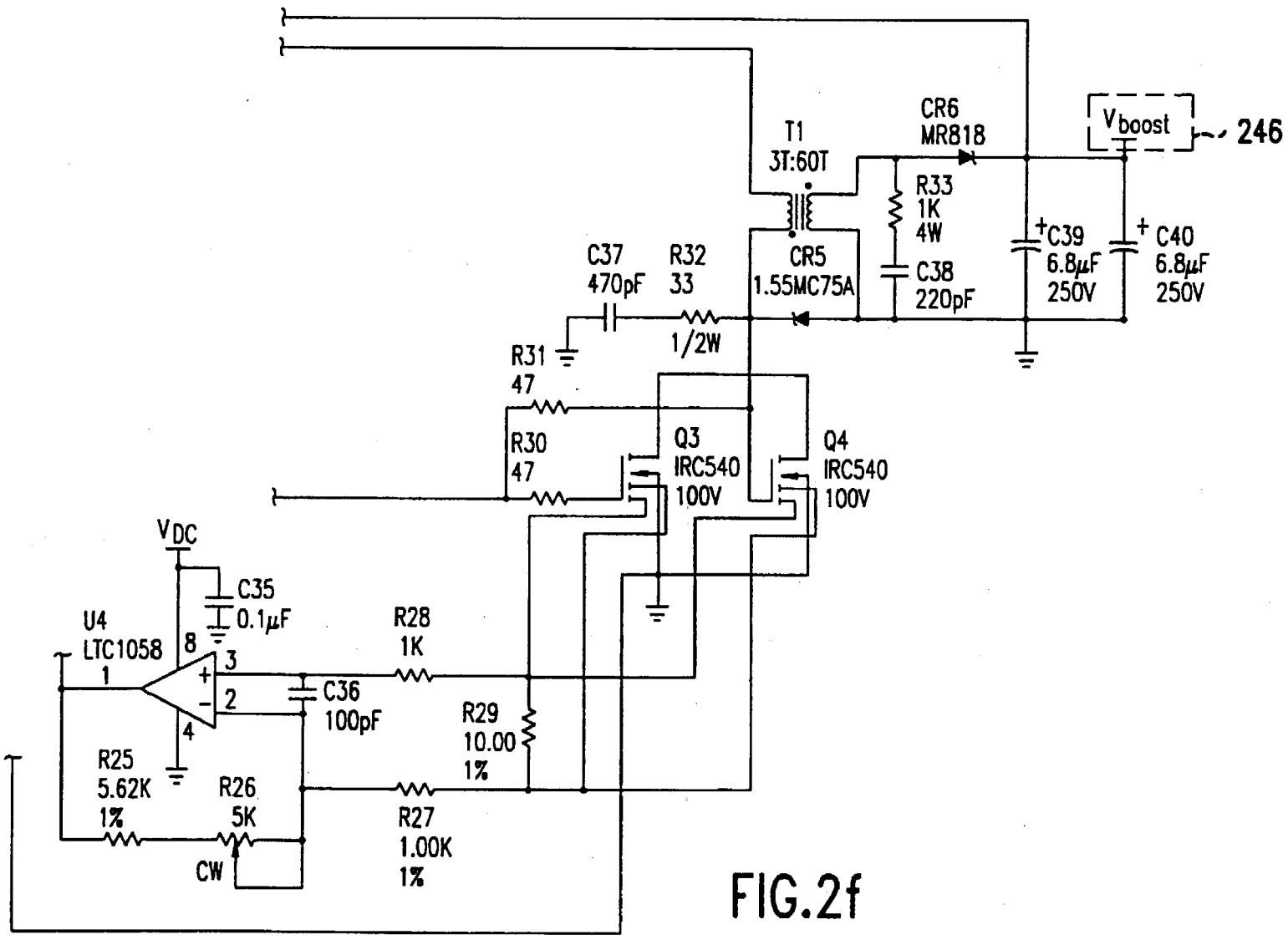
Figure 2G:
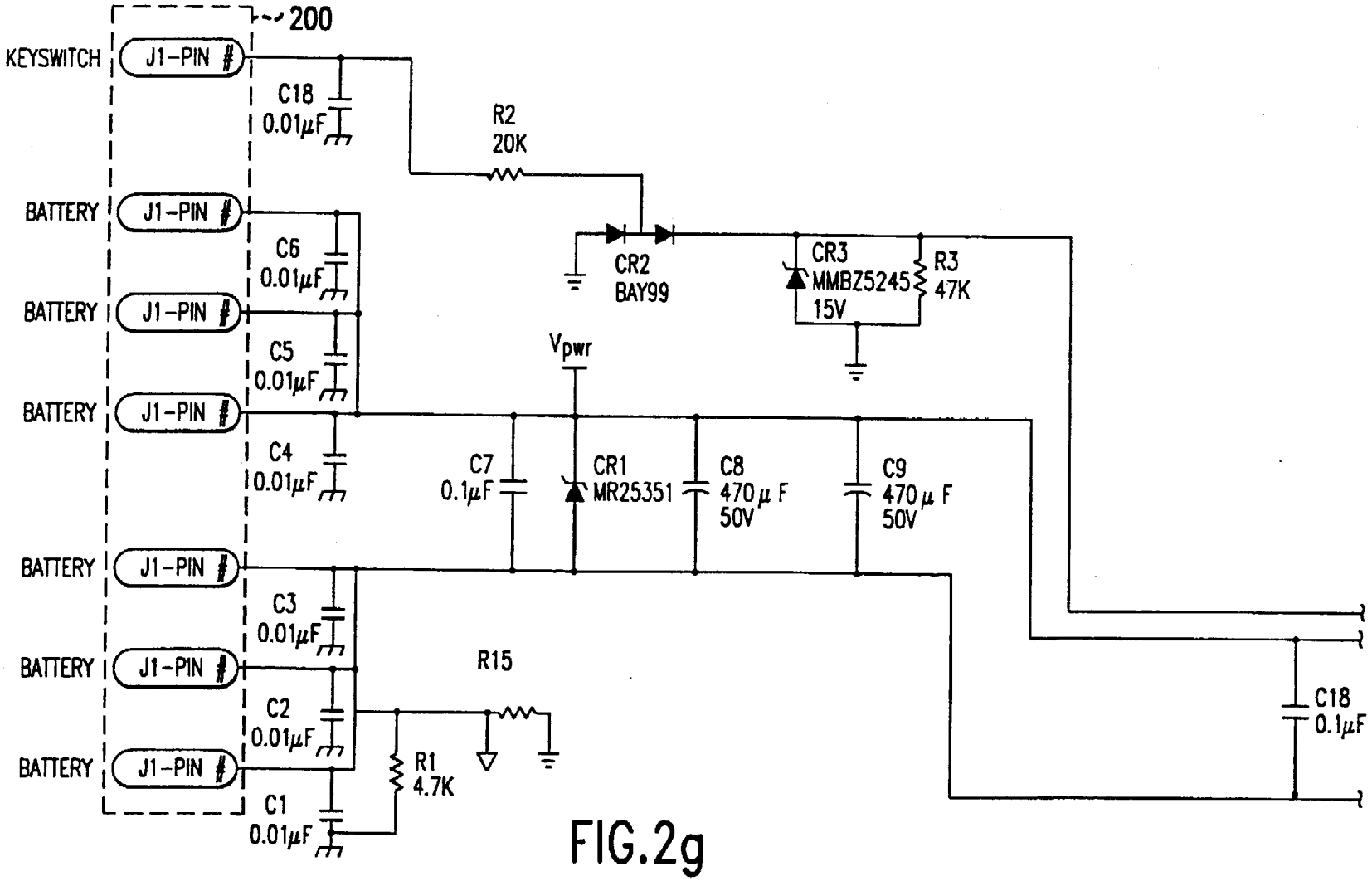
Figure 2H:
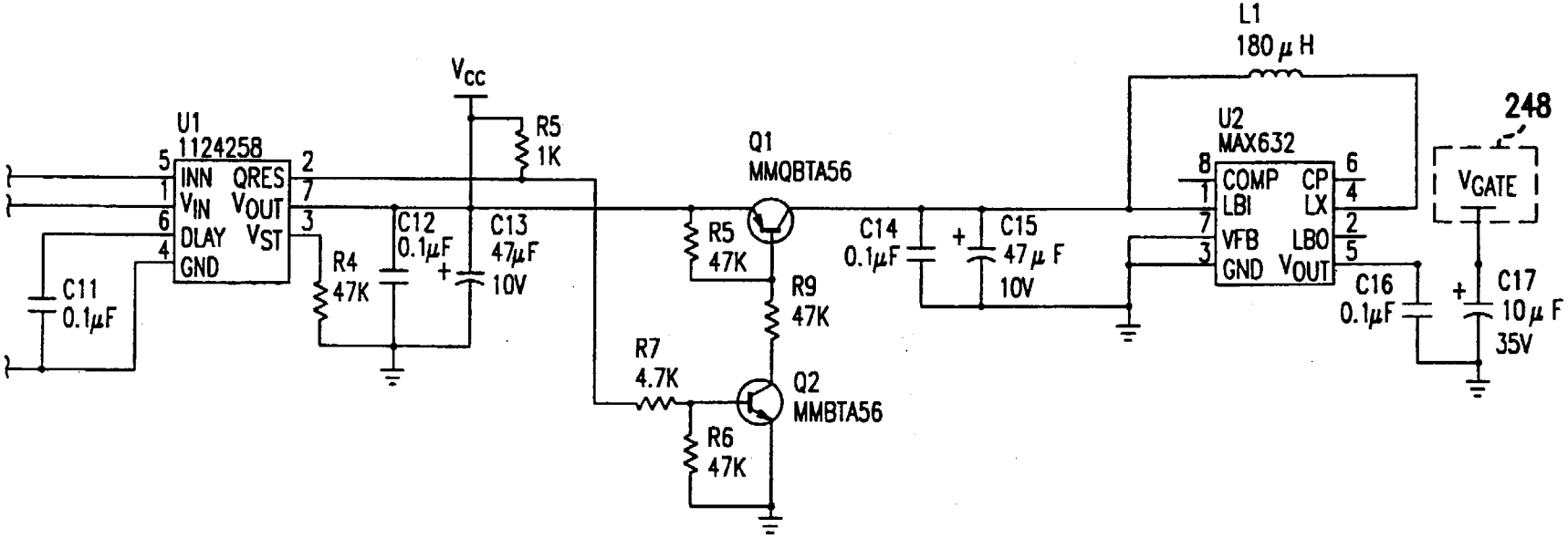
Figure 2I:
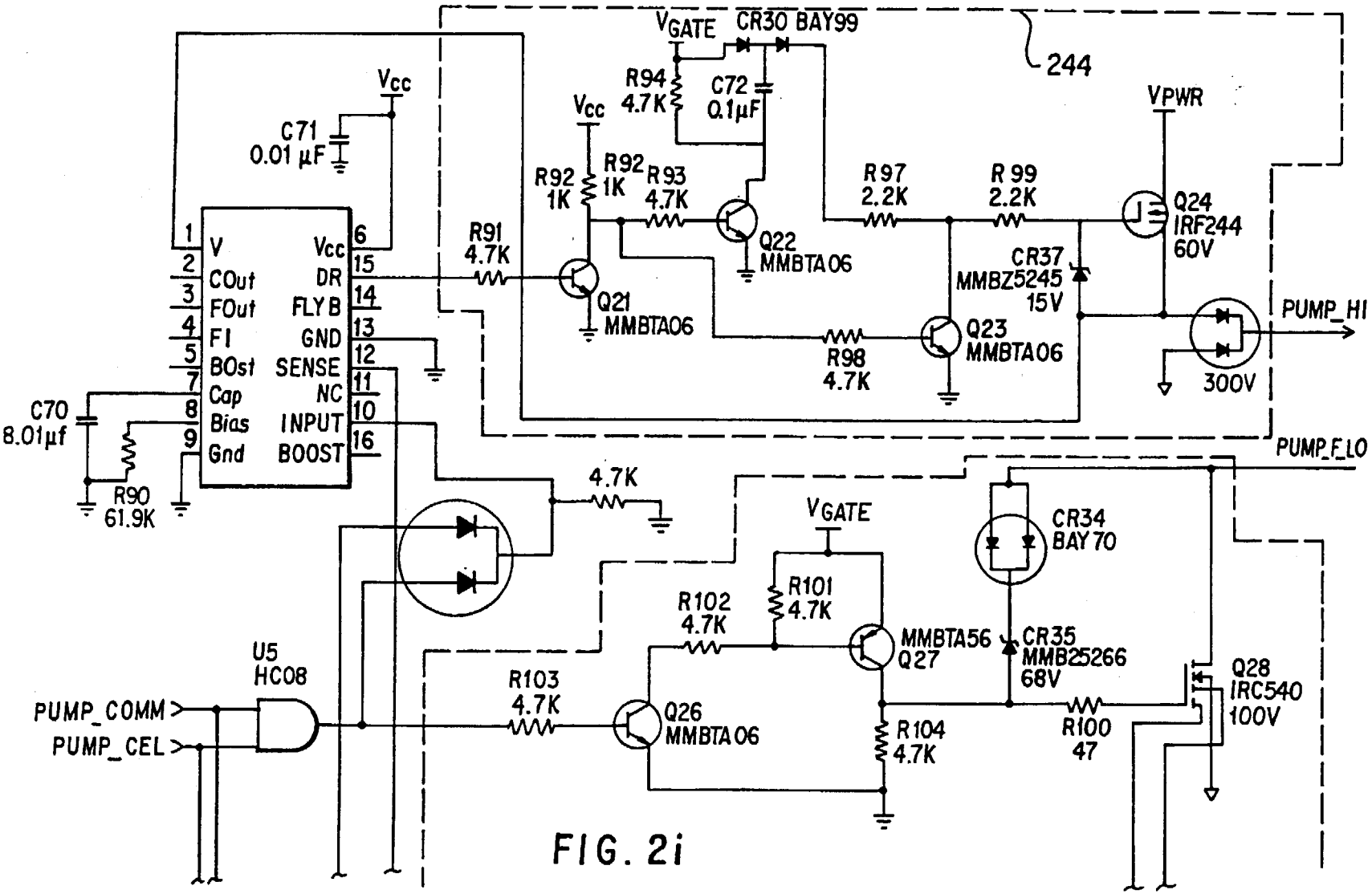
Figure 2J:
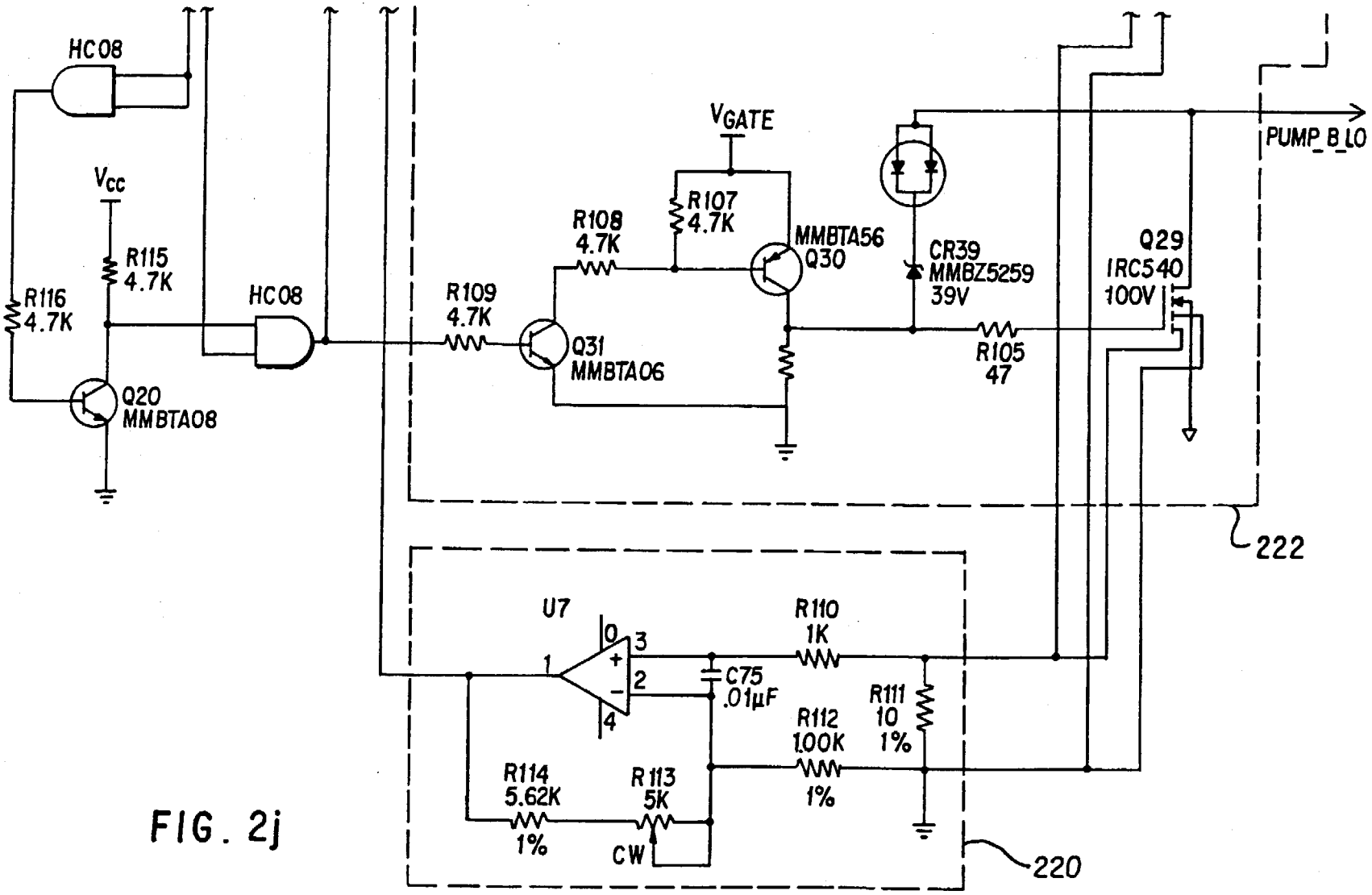

Referring next to FIGS. 2b–2e, electrical schematic diagrams of one circuit that can be used to implement the control circuitry are shown. Specifically, FIG. 2b illustrates a circuit that can be used to implement injection solenoid driver circuitry 238; FIG. 2c illustrates a circuit that can be used to implement high voltage boost generation circuitry 240; FIG. 2d illustrates a circuit that can be used to implement keyswitch processing circuitry 242; and FIG. 2e illustrates a circuit that can be used to implement the pump solenoid driver circuitry 244. The same reference numbers used in FIG. 2a are used in FIGS. 2b–2e for clarity.

Referring first to FIG. 2b, the injection solenoid driver circuitry 238 is shown. Injection solenoid driver circuitry 238 serves to provide the necessary electrical signals to operate the injection control valve 20. These electrical control signals include a high voltage boost signal, a high current solenoid pull-in signal and a low current solenoid holding signal. Typically, the high voltage boost signal would consist of a 150–200 volt pulse having a duration of approximately 100 microseconds (for the rising edge only). After the application of such boost signal, then the high current pull-in signal is applied for approximately 500 microseconds. Finally, the low current holding signal, typically generated by a 12 volt battery voltage, would be applied for the duration of the injection event to maintain injection solenoid valve 20 in an open position. As can be seen in the Figure, injection solenoid controller 202 includes an integrated circuit solenoid controller. This integrated circuit controller is a application specific integrated circuit (ASIC) that is programmed to perform the generation and application of the driving signals as discussed above. Furthermore, controller 202 includes a current sensor that monitors the current through the injection solenoid and provides a pulse width modulated activating signal to the injector solenoid to maintain the current within a predetermined current range, such as, for example, 18–22 amperes during the pull-in voltage application and 9–11 amperes during the application of the holding current. The remainder of FIG. 2b, including high side driver circuitry 204, current sensing circuitry 206 and low side driver circuitry 208, can be readily understood by one of skill in the art upon inspection.

Referring to FIG. 2c, connector 200 and boost voltage output 246 are indicated. The remainder of FIG. 2c constitutes high voltage generation circuitry 212 and is readily understood by one of skill in the art. Similarly, with reference to FIG. 2d, connector 200 and gate voltage output 248 are indicated while the remainder of FIG. 2d constitutes key switch processing circuitry 214 and is readily understood by one of skill in the art. In FIG. 2e, pump solenoid controller 216, high side driver circuitry 218, current sensing circuitry 220 and low side driver circuitry 222 are indicated. Pump solenoid controller 216 again includes an ASIC having similar operation to that described above with respect to the injector solenoid driver including current sensing operation and pulse width modulation to maintain the solenoid current within prescribed limits. No boost driver circuitry is required, however, for the operation of the pump control valves.

Next, the software used in ECM 13 and incorporated into digital portion 232 to perform engine control functions will be described in detail. In is important to recognize the ECM 13 includes a microprocessor such as, for example, a 68331 or 68332 commercially available from Motorola. This microprocessor can perform a variety of computer related functions related to the operation of the internal combustion engine, or the vehicle or device in which the internal combustion engine is mounted. For example, in addition to controlling the fueling of the engine, the microprocessor can also perform vehicle diagnostic tests and/or forward information concerning vehicle performance to the driver or other remote location.

The fueling of an internal combustion engine, however, requires precise timing operations to be performed in order to adequately execute engine fueling procedures. Therefore, in order to perform this plurality of operations, the microprocessor of the present invention is interrupt driven for engine fueling operation. At the occurrence of each interrupt (which will occur for each position pulse from position sensor 31 and for each speed pulse for speed sensor 33) the ECM 13 executes a series of algorithms that provide for engine fueling and accumulator pressurization. By making the microprocessor interrupt driven, it is possible to reduce the number of microprocessors or other controllers needed on the vehicle, while still achieving accurate engine fuel control.

Furthermore, although the 68331 microprocessor is discussed herein and the programs set forth in the software appendix have been designed to operate on the 68331 processor, it will be much preferred in the commercial implementation of the subject invention to employ a microprocessor such as the 68332 or the like. The 68332 processor is preferred because it supports more advanced timing operations than the 68331 processor. Specifically, the 68332 processor includes a time processing unit, or TPU, while the 68331 processor includes only a general purpose timer, or GPT. Because the control of fuel injection and pumping events requires extremely accurate timing control, for which the TPU is better suited, the 68332 processor is preferable. The accompanying discussion and programs set forth for the 68331 microprocessor will enable those of skill in the art to adapt the concepts of the present invention to the 68332 or other processors.

In the present implementation of the fuel control system discussed herein and illustrated in the software appendix, the 68331 processor having a GPT is used. The GPT of the 68331 processor simply operates to count timing pulses occurring at a predetermined rate. For example, the GPT could be programmed to count pulses occurring every 10 milliseconds. In this manner, the GPT can be used to determine the time between events by calculating the difference in the GPT between the two events, or to initiate an event at a predetermined time by utilize the output comparator operation of the 68331 processor that will be familiar to those of skill in the art.

Figure 3:
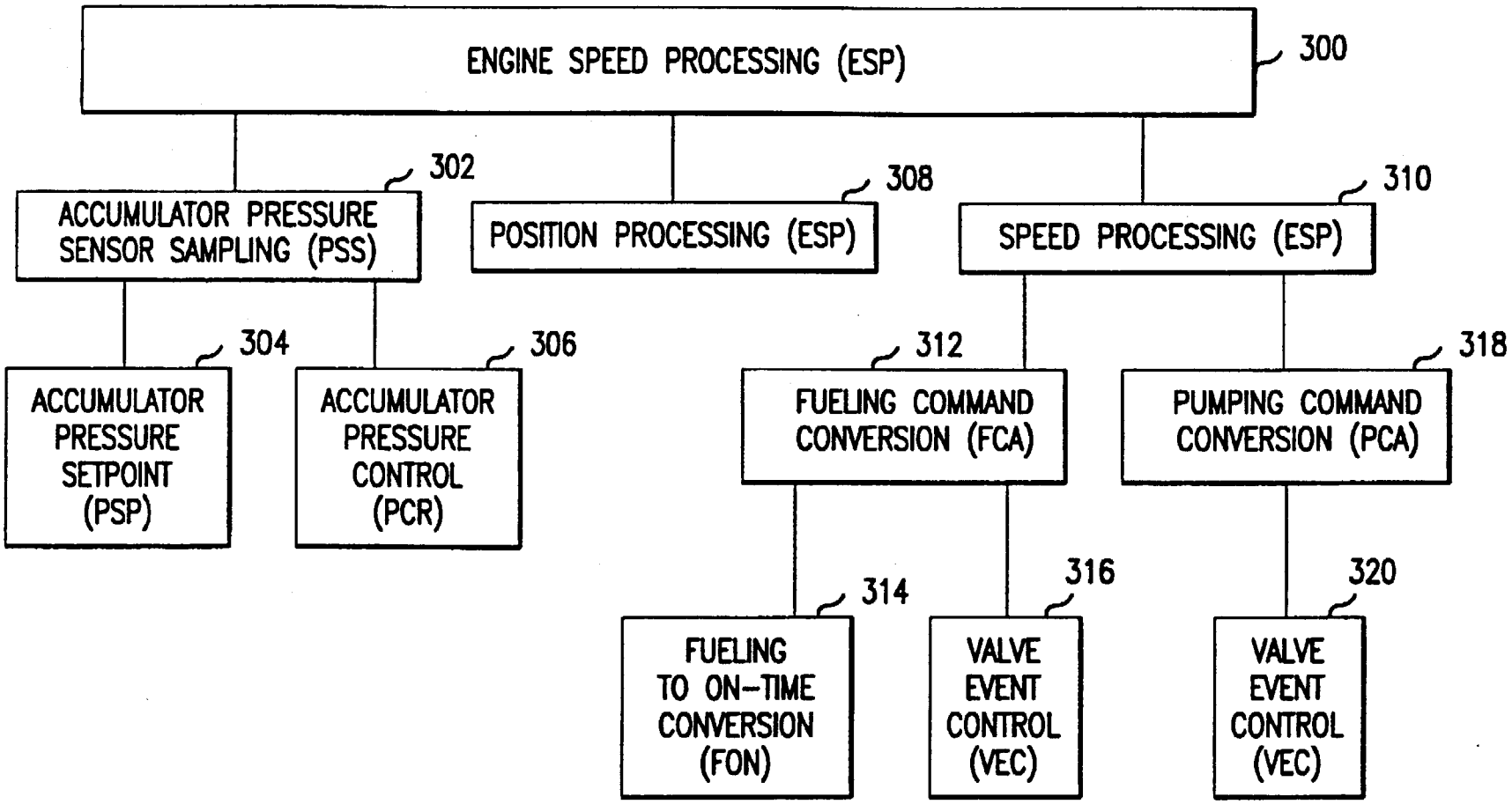
FIG. 3 is a general block diagram showing the hierarchical relationship of the algorithms discussed in FIGS. 4 through 10.

The software used to implement the control system of the present invention will now be described in detail. FIG. 3 is a block diagram illustrating the hierarchial relationship of the software control algorithms used in the present invention. As noted above, the fueling control system of the present invention is primarily interrupt driven. The main interrupt handling routine is the engine speed processing (ESP) routine 300. This routine processes all interrupts generated by speed sensor 33 and position sensor 31 of the internal combustion engine. The source code for the ESP algorithm is set forth in part A of the software appendix. Also, the variable definitions used for all of the software algorithms in the software appendix are set forth in part I of the appendix.

There are three subroutines or sub-algorithms that are executed by the ESP algorithm. The accumulator pressure sensor sampling (PSS) algorithm 302 performs all of the engine speed synchronous activities used to control the fuel pressure in the accumulator 12. The PSS algorithm is integral with the ESP algorithm and is set forth in the software appendix with the ESP algorithm in part A. The accumulator pressure set point (PSP) algorithm 304 and accumulator pressure control (PCR) algorithm 306 are used by PSS algorithm 302 during this pressure processing. The source code for PSP and PCR algorithms is set forth as parts B and C respectively in the software appendix.

The position processing algorithm 308 is currently implemented as a part of the ESP routine 300 (software appendix, part A). The function of the position processing algorithm 308 is to provide specific processing for interrupts generated by position sensor 31.

The speed processing algorithm 310 is also currently implemented as part of the ESP routine 300 (software appendix, part A). The speed processing algorithm 310 provides processing support for interrupts generated by speed sensor 33. The speed processing algorithm is executed once for every interrupt generated by speed sensor 33, which may be from about 10° to 50° of engine crankshaft rotation. Therefore, the speed processing algorithm 310 acts as an entry point for all further fueling and pumping controls.

Control of the engine fueling system are performed by the fueling command conversion (FCA) algorithm 312. This algorithm determines if a fueling event is necessary and, if so, the start and duration of the fueling event. The fueling to on-time conversion (FON) algorithm 314 is used by FCA algorithm 312 to calculate the duration of a fueling event. The valve event control (VEC) algorithm 316 provides specific control signals to the fueling valves used by the engine control system. The source code for the FCA, FON and fueling VEC algorithms is set forth as parts D, E and F respectively in the software appendix.

Control of the accumulator fuel supply pumping system is performed by the pumping command conversion (PCA) algorithm 318. PCA algorithm 318 calculates the appropriate valve close angle for pumps 14 and converts this angle to an appropriate timer reference for processing the valve event control (VEC) algorithm 320. VEC algorithm 320 controls the pump control valves 18 and 19 to cause high pressure pumps 14 to supply fuel to the accumulator 12. The VEC algorithm 316 used for fueling valve control, and the VEC algorithm 320 used for pumping valve control are substantially similar. However, since these algorithms may both be active at the same time, they are implemented as two separate software programs. Accordingly, the source code for the PCA and VEC pumping algorithms is set forth as parts G and H respectively in the software appendix.

Each of the above algorithms will now be discussed in more detail. Upon the receipt of an interrupt, the fuel system controller executes a series of computer software programs for monitoring and controlling the fuel system. A detailed discussion of the various programs is provided below in conjunction with reference to the appropriate Figures, which depict flowcharts of the program operation. Additionally, as noted above, the source code for the software programs represented by these flowcharts is reproduced in the microfiche appendix.

Figure 4:
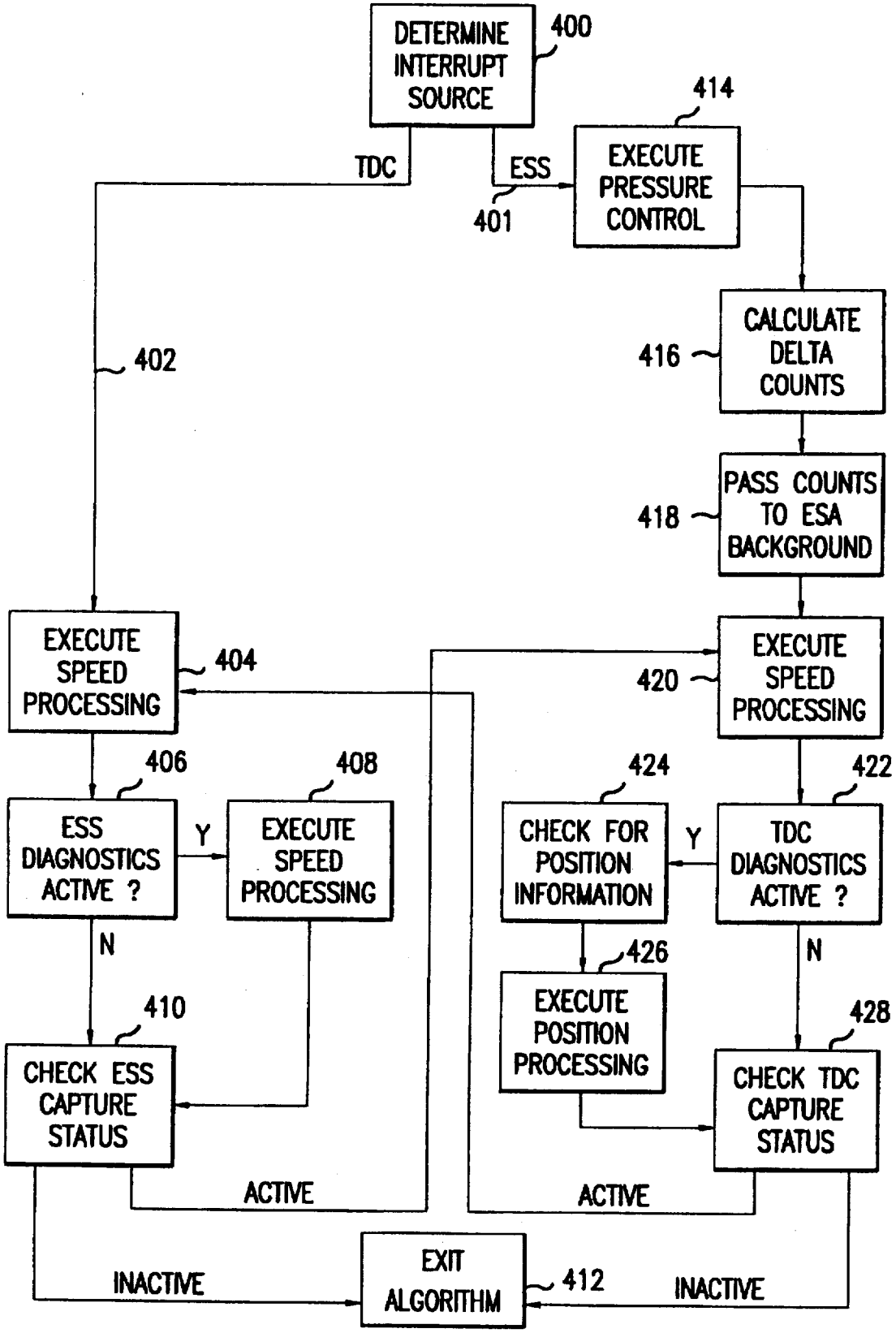
FIG. 4 is a flowchart of an engine speed processing algorithm (ESP) according to the present invention.

FIG. 4 is a flowchart of an engine speed processing algorithm (ESP) used in the present invention. Processing starts in block 400 of FIG. 4 in which the source of the interrupt currently being processed is determined. As discussed above, the ESP algorithm shown in FIG. 3 is executed whenever an interrupt is received from an engine sensing system (i.e. a speed or position sensor). Referring to FIG. 1 and the discussion associated therewith, an interrupt can occur either from position sensor 31 or speed sensor 33. Therefore, block 400 in FIG. 4 first determines whether the current interrupt being processed resulted from the engine position sensor 31 or from the engine speed sensor 33. If the interrupt is a result of engine position sensor 31, processing proceeds along path 402 to block 404 where a position processing algorithm is executed. The position processing algorithm shown in block 404 is shown in more detail in FIG. 5 and will be discussed below in connection that Figure.

Following completion of the position processing, execution continues in block 406. In block 406 the Engine Speed Processing algorithm checks to see if engine speed sensor (ESS) diagnostics have been activated. ESS diagnostics would be activated, for example, if the system detects an error or fault with the engine speed sensor. The diagnostics could include special processing routines to correct or compensate for the sensor defect, or simply the provision of an error indication so that service personnel would be notified of the defect during a routine maintenance inspection. If an error consistently occurs, the ECM 13 could easily compensate for the defect until the sensor could be repaired.

If the ESS diagnostics are active, indicating an error or fault condition with the speed sensor, then the speed processing algorithm is executed in block 408. This allows the engine to operate at a reduced capacity, or in a "limp home" mode if the engine speed sensor fails. The control system will interpolate the engine position sensor data based on the data received from the engine position sensor. The result is an approximate engine speed that can be used in place of the exact data received from the engine speed sensor. This approximated engine speed can then be used to control fueling and pumping events. The detailed operation of the speed processing algorithm will be discussed in more detail below in connection with FIG. 6. If the ESS diagnostics are not active, or following the completion of the execution of the speed processing algorithm, control returns at block 410.

Block 410 represents an optional control algorithm that could be used in the present invention, but is not necessary for the proper operation of the fuel control system. In block 410 the fuel system determines if the engine speed sensor data should also be processed in addition to the engine position sensor data. It may be desirable, for example, to process the engine speed sensor data at this point in the program to avoid an unnecessary delay in processing the data resulting from the need for the program to await a speed sensor interrupt signal. If the capture status is inactive, indicating that the engine speed sensor information should not be processed, control passes to block 412 and the engine speed processing algorithm ends. If, however, the ESS capture status is active, indicating that the engine speed sensor data should be processed, control transfers to block 420 and speed processing is executed normally, as discussed in detail below.

Returning to block 400 in FIG. 4, if it is determined that the interrupt resulted from the engine speed sensor 33 (FIG. 1), then processing follows path 401 to block 414, where a pressure control algorithm is executed. A detailed discussion of the pressure control algorithm shown in block 414 is set forth below in connection with FIG. 10. Following completion of the pressure control algorithm, processing continues in block 416, where the difference in present value of the general purpose timer and the value at the last speed processing interrupt is determined. As discussed above, this difference in the GPT can be used to determine the time between two events in the fuel control system. The difference in the GPT counter value (or "delta counts") represents the time between speed sensor interrupts; that is, the number of pulses received multiplied by the time between GPT pulse repetitions represents the time that has elapsed since the last speed interrupt occurred. By knowing the time since the last interrupt occurred, and the number of crank degrees between speed sensor interrupts, it is possible to easily calculate actual engine speed.

The value calculated in block 416, the difference in the GPT counter value between speed sensor interrupts, can also optionally be passed to an engine speed algorithm (ESA) in block 418. The ESA operates in the background (i.e. is not required to be in synchronism with the engine rotation, but is continuously executed) and serves to provide engine speed information to other algorithms within the engine control system and to other vehicle systems. As discussed below, more detailed processing of this raw speed data is performed by a speed processing algorithm for use by the fuel control system.

Processing continues in block 420 with the execution of the speed processing algorithm. The speed processing algorithm is discussed in more detail below in connection with FIG. 6 and the accompanying description thereof.

Upon completion of the engine speed processing algorithm, the control system checks to see if any TDC diagnostics are active in block 422. TDC diagnostics could be active, for example, where an engine position sensor error or failure has occurred. For example, as will be discussed below in connection with the engine position processing algorithm, if the number of speed sensor interrupts exceeds a predetermined number, then a position sensor fault is detected and TDC diagnostics are activated. If the TDC diagnostics are active, processing continues in block 424 and the availability of position information is checked. In this manner, the control system can continue to operate despite the fact that the position sensor has failed. This allows the engine to be operated until the position sensor can be repaired. If the engine is shut down, however, it may not be possible to restart the engine since the control system will lack any position information and therefore will not be able to correctly fuel the engine cylinders. In the most preferred embodiment of the present invention, however, it is possible to derive the position information from the speed sensor signal and thus allow the engine to be restarted. Even under these circumstances, however, the engine is operating in a corrective mode, since the exact engine position will not be able to be derived from the crankshaft speed sensor alone.

Next, in block 426, the position processing algorithm is executed. As noted above, the position processing algorithm is shown and discussed in more detail in connection with FIG. 5 below. If the TDC diagnostics are not active in block 422, or following the completion of the execution of the position processing algorithm in block 426, processing continues in block 428.

In block 428 the TDC capture status is checked. If the TDC capture status is active, processing is transferred to block 404 where normal position processing is performed. If, however, the TDC capture status is inactive in block 428, processing transfers to block 412 and the algorithm ends.

Block 428 is similar in purpose to block 410 and represents an optional control algorithm that could be used in the present invention, but is not necessary for the proper operation of the fuel control system. In block 428 the fuel system determines if the engine position sensor data should also be processed in addition to the engine speed sensor data. As in block 428, it may be desirable, for example, to process the engine speed sensor data at this point in the program to avoid an unnecessary delay in processing the data that results from the need for the program to await a position sensor interrupt signal. If the TDC capture status is inactive, indicating that the engine position sensor information should not be processed, control passes to block 412 and the engine speed processing algorithm ends. If, however, the TDC capture status is active, indicating that the engine position sensor data should be processed, control transfers to block 404 and speed processing is executed normally as discussed above.

Next, the position processing algorithm shown in blocks 404 and 426 of FIG. 4 will be discussed in more detail with reference to FIG. 5, which illustrates a more detailed depiction of the algorithm. The primary purpose of the position processing algorithm is to synchronize the execution of the control system software with the rotational position of the internal combustion engine. The position processing algorithm will only be executed when a TDC reference has been detected from position sensor 31 (shown in FIG. 1). As noted above, this TDC reference could be direct (i.e. an actual indication from the position sensor that the TDC condition exists) or indirect (i.e. an indication from the position sensor that the next speed sensor pulse represents a TDC condition).

Processing begins in block 500 where it is determined whether or not a position reference has been previously established by the control system. This determination ascertains whether an initial pulse from position sensor 31 has already been received, or whether this is the first pulse to be received from the sensor. This is critical during engine start-up. If no determination is made that this is the first pulse received from the position sensor, then the counter check in block 504 could fail and result in an erroneous position (or TDC) diagnostic being issued in block 506.

If a position reference has been established, processing continues at block 504, where the position counter-status is verified. In block 504, the control system compares the number of pulses received from speed sensor 33 to a predetermined correct amount or verification value representing the number of pulses that should be received for each revolution of the engine crankshaft. This correct amount or verification value is typically equal to the number of teeth on the gear used to sense engine speed by speed sensor 33. In operation, the algorithm of FIG. 5 should be executed every 720° of crank rotation, or 360° of camshaft rotation, since at that time a position indicating pulse will typically be issued by position sensor 31. During this rotation, the position counter should receive a number of pulses equal to the number of teeth on the crankshaft gear. Therefore, this comparison in block 504, serves to verify that a counting error has not occurred by speed sensor 33 during the revolution since a position pulse was received from position sensor 31.

If the position counter status is found to be correct, processing flows to block 508 where the diagnostic flags are cleared indicating that the system is operating correctly. If, however, the counter status is determined to be faulty, then processing is transferred to block 506 where a position (or TDC) diagnostic is initiated. After the issuance of a TDC diagnostic in block 506, or the clearing of the diagnostic flags in block 508, execution is transferred to block 510. In block 510, the position counter is cleared, or reset, to zero to begin counting position pulses for the next revolution of the engine crankshaft.

Execution continues in block 512, and the pulse accumulator (PAI) is reset to FE hexadecimal. The purpose of the pulse accumulator is to facilitate the counting of the speed sensor pulses. The pulse accumulator is used to count every second or third pulse that is received from the engine speed sensor. This is accomplished by incrementing the pulse accumulator for every pulse from the speed sensor, and providing an interrupt when an overflow of the pulse accumulator occurs. The engine speed sensor generates a pulse for every tooth of the crankshaft gear that passes the sensor. Typically this results in a pulse for every 10° of engine crankshaft rotation. However, the present invention only needs to process a interrupt for every 30° of engine crankshaft rotation. The pulse accumulator assists in accomplishing this objective by providing a means by which every third pulse from the speed sensor is counted by the control system.

The pulse accumulator also serves to maintain the control system in synchronism with engine rotation. When a position pulse is indicated, the pulse accumulator is reset to FE hexadecimal. Thus, on the second speed sensor pulse received thereafter, an overflow condition will result. Furthermore, the position sensing circuitry will interpret the interrupt generated as a result to indicate a positive engine position, such as the TDC of cylinder number 1. The system then resets the pulse accumulator to continue counting every third pulse from the speed sensor.

Execution then flows to block 514, where the position processing algorithm is complete, and returns to either block 404 or block 426 depending on which block was responsible for calling the position processing algorithm.

Figure 5:
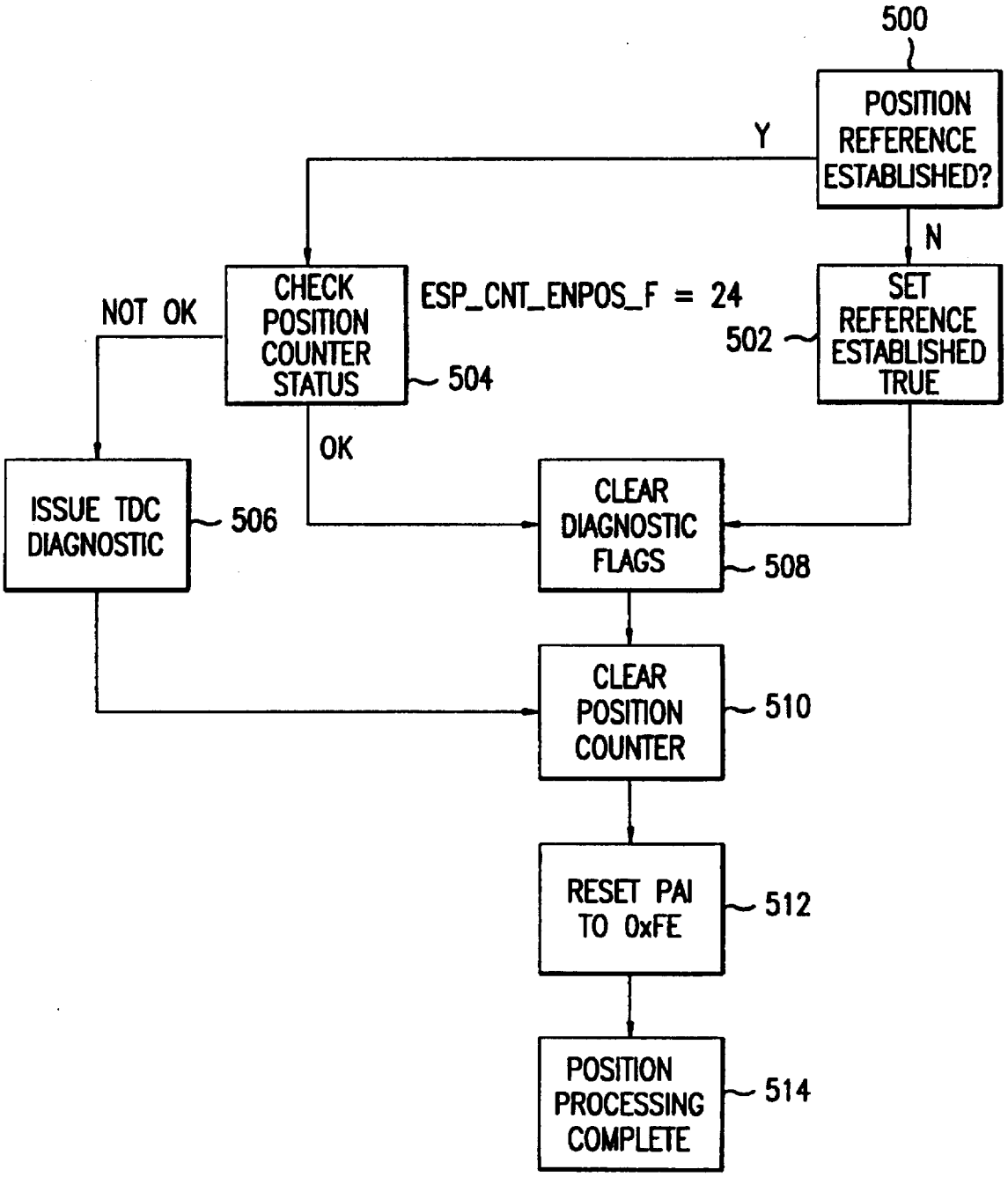
FIG. 5 is a flowchart of an engine position processing portion of the engine speed processing algorithm according to the present invention.

Referring back to block 500 in FIG. 5, if a position reference has not been established, execution transfers to block 502. This will occur where an initial position indicating pulse has not previously been received from position sensor 31. For example, during engine start up, the rotational position of the engine will be unknown and a length of time will pass before a first position pulse is received from position sensor 31. If the position pulse being processed is the initial pulse to be received it establishes a reference value, and execution will continue with block 502 where this reference value is established. Execution then transfers to block 508 and continues in blocks 510, 512 and 514 in the matter discussed above.

Figure 6:
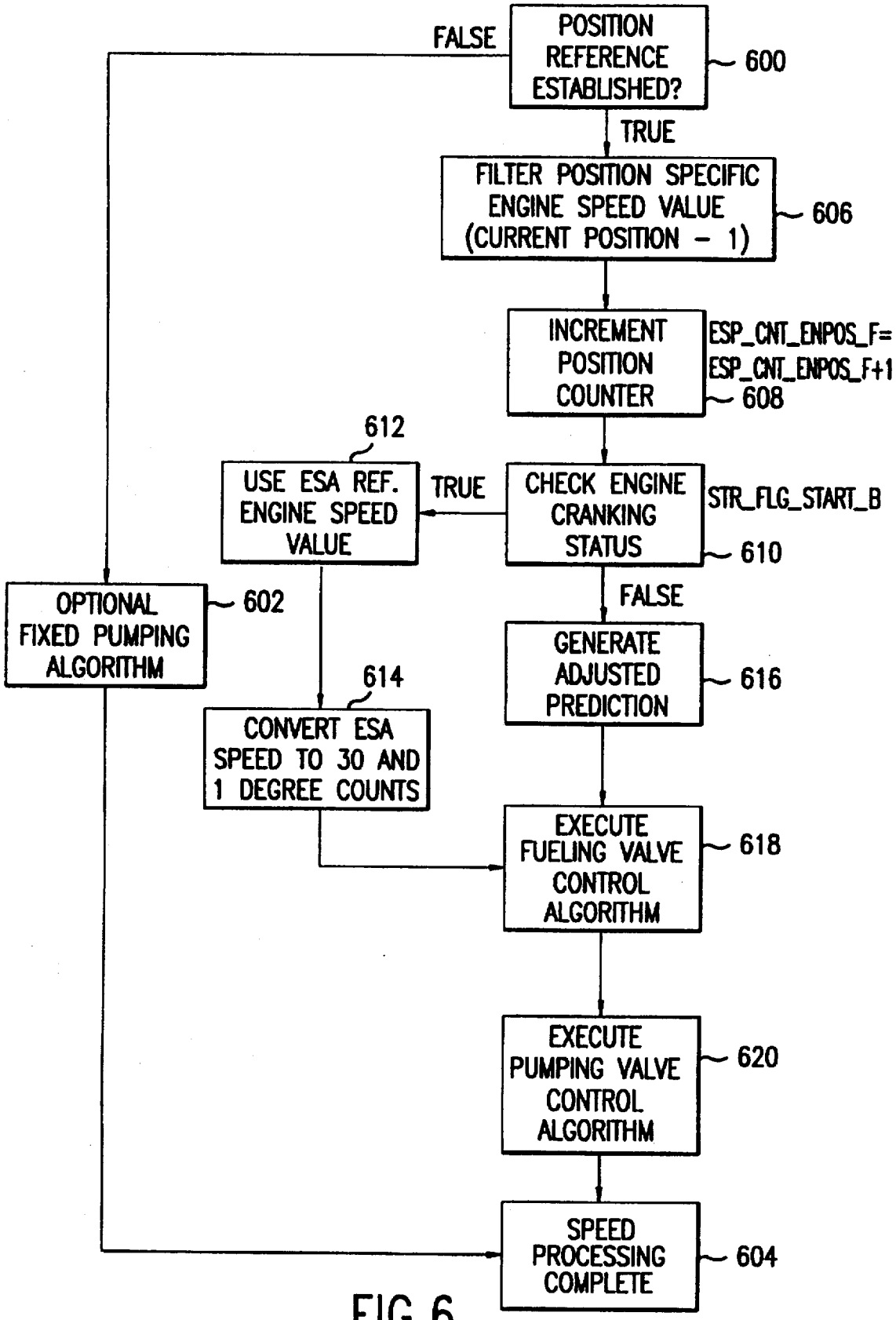
FIG. 6 is a flowchart of a speed processing portion of the engine speed processing algorithm according to the present invention.

Referring next to FIG. 6, the speed processing algorithm shown in blocks 420 and 408 of FIG. 4 is discussed in more detail. The speed processing algorithm begins in block 600 with a determination of whether a position reference has been established or not. If no position reference has been established, execution may be transferred to block 602, which represents an optional fixed pumping algorithm. Otherwise, if the optional fixed pumping algorithm is not present in block 602, the speed processing algorithm is complete and terminates in block 604.

Since a position reference has not yet been established, no fueling can be done. Without a position reference it is not possible for the control system to determine the exact rotational position of the engine. Therefore, the control system does not have sufficient information to determine which cylinder should be fueled or when such fueling event should take place. This situation, where a position reference has not been established, should occur only during engine start up and specifically during engine cranking before the engine camshaft has completed one full revolution. After one full revolution of the engine camshaft, a position pulse should be received from position sensor 31 and a position reference established as discussed above. It is during engine cranking when no position pulse has been received that the optional fixed pumping algorithm can be implemented to facilitate proper engine starting.

Co-pending application Ser. No. 08/057,489 entitled *Compact High Performance Fuel System With Accumulator* and its copending continuation-in-part application of the same title filed May 6, 1994, discuss the mechanical structure and operation of a fuel system for which the present control system is adapted to operated. As can be seen from that application, the fuel in the accumulator is required to be at very high pressure (between approximately 16,000 and 22,000 psi) in order to achieve proper fuel injection. However, for safety and other concerns this pressure is not maintained in the accumulator while the engine is not being operated. Therefore, during engine start-up, there is a need to quickly pressurize accumulator 12 so that fuel injection can be initiated as soon as a position sensor signal is received.

The fixed pumping algorithm shown in block 602 can be used to achieve this objective. As noted above, when ECM 13 closes pumping control valves 18 or 19, the pressure from high pressure pumps 14 maintains valves 18 and 19 in a closed position until the respective pressure pump 14 begins a downward stroke. However, since no engine position signal has been received, it is not possible to accurately determine when to close valves 18 or 19 in order to achieve a pumping event. Furthermore, it is not possible to simply hold valves 18 or 19 closed, since it will then be impossible for pumps 14 to draw fuel from low pressure pump 15.

Figure 26:
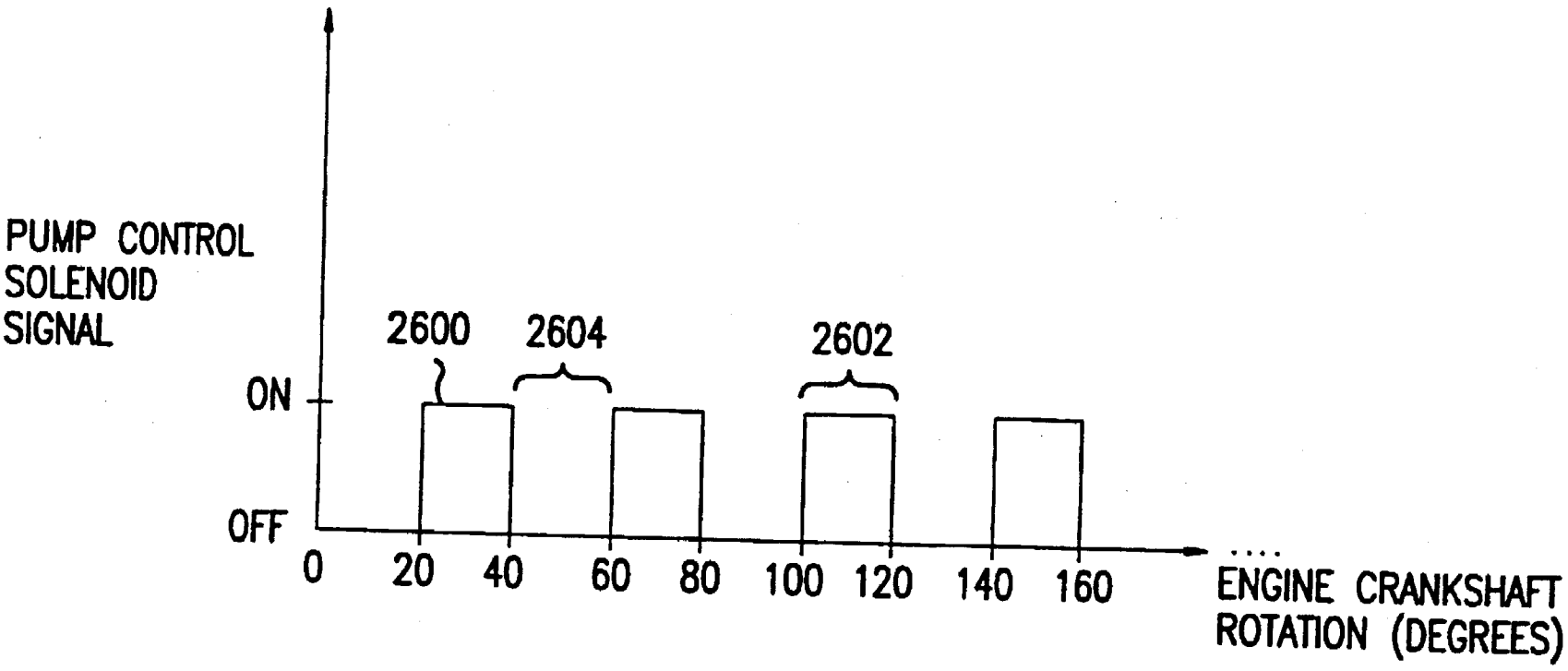
FIG. 26 illustrates a pulse waveform that could be used to achieve accumulator pressurization despite the absence of a positive engine position reference.

Therefore, in accordance with the present invention, ECM 13 produces a series of pulses that are supplied to control valves 18 and 19 during engine start up. These pulses should have a duration equivalent to approximately 20° of engine crankshaft rotation and a duty cycle of approximately 50%. A sample waveform showing this pulse train is set forth in FIG. 26. As shown in FIG. 26, pump control actuating signal 2600 has a substantially square waveform having a ON period 2602 equal to approximately 20° of engine crankshaft rotation and an OFF period 2604 of approximately 20° of engine crankshaft rotation. If one of these pulses occurs during the downstroke of the piston pump 14, then the flow fuel from low pressure pump 15 to high pressure pump 14 will momentarily be interrupted, but will resume as soon as the pulse from ECM 13 terminates. If, however, the pulse occurs during the compression stroke of high pressure pump 14, then the fuel pressure generated by the appropriate pump 14 will hold pump control valve 18 or 19 closed and high pressure fuel will thus be added to accumulator 12.

Returning to FIG. 6, if a position reference has been established in block 600, then execution continues in block 606. In block 606 a control system generates a specific engine speed value for the interval just previous to the current interrupt. This speed value is determined by analyzing the general purpose timer in the 68331 microprocessor and the difference in the number of timer counts as calculated in block 416. The algorithm in block 606 determines the difference between the current reading of the general purpose timer of the microprocessor, and the reading in the general purpose timer at the last interrupt. The result of this calculation is a number of timer pulses that have occurred during the last interval. This time period, represented by the number of timing pulses counted by the general purpose timer during the last interval, is then stored so that it can be used for later fuel system timing calculations.

The algorithm then proceeds in block 608 and increments the position counter by one. Since a pulse was generated by speed sensor 33, indicating that another tooth or interval of the crankshaft gear had passed, the position counter needs to be incremented by one in order to ensure that the exact rotational engine position can be calculated.

The algorithm continues in block 610 by checking to determine whether cranking of the internal combustion engine is currently occurring. If the engine is currently being cranked (i.e., a user is attempting to start the internal combustion engine), then control is passed to block 612, continues to block 614 and returns at block 618. If however an engine cranking condition is not indicated at block 610, control passes through block 616 and on to block 618. As can been seen by referring to FIG. 6, one of two paths will be executed in transitioning between block 610 and block 618. The algorithm will either execute blocks 612 and 614, or it will execute block 616. The decision as to which path is to be executed is based upon whether or not the engine is currently in a cranking status and will be described more fully as follows.

In operation, the control system of the present invention, operates during each interrupt to determine whether or not a fueling event or pumping event will be necessary at any time prior to the next interrupt. During each execution of the algorithm, the program checks to see if a fueling or pumping event will be necessary within the next 30° of engine crankshaft rotation. Furthermore, due to delays in processing by the control algorithms, it is necessary to ensure that a pumping or fueling event will not occur within the next 30° of engine crankshaft rotation plus an additional margin to compensate for the delay necessary for the control algorithm to perform the appropriate processing during the next interrupt interval.

In block 616, an adjusted prediction of the time period during which the control algorithm must check to see if a fueling or pumping event will occur is determined. In the most preferred embodiment of the invention, this period of time is determined by analyzing the previous interrupt interval and using this length of time as a base line for predicting the subsequent interrupt interval. Furthermore, as mentioned above, a predetermined offset is allocated to allow for computational delays by the control algorithm. Once this predicted value of the subsequent interrupt interval is determined, processing continues in block 618.

However, if the engine is in a cranking state, as determined in block 610, the position sensor data from the previous interrupt interval will be inaccurate and may not accurately reflect the appropriate time until the following interrupt interval. Under these circumstances, the control algorithm in block 612 relies upon the more general engine speed algorithm or ESA value. The use of the ESA speed reference in block 612 is desirable during engine cranking because of torsional fluctuations in the engine crankshaft and rapidly fluctuating speed changes. Although this value is not as accurate as the value determined in block 606 because it represents an average speed value, during engine start up this value results in improved starting characteristics. Control then flows to block 614, where the ESA speed value is converted to an equivalent number of timer counts indicating a 30° and 1 ° rotation of the engine crankshaft. This conversion causes the ESA speed reference to be in the same units as the speed value determined in block 616, and therefore execution can continue in block 618 independent of the path used to arrive at that block.

The algorithm continues in block 618 with the execution of the FCA algorithm. The FCA algorithm is discussed in more detail below in connection with FIG. 7. Next, control transfers to block 620 with the execution of the PCA algorithm, which is also discussed in more detail below in connection with FIG. 8. Finally, control transfers to block 604 and the speed processing algorithm is complete.

Figure 7:
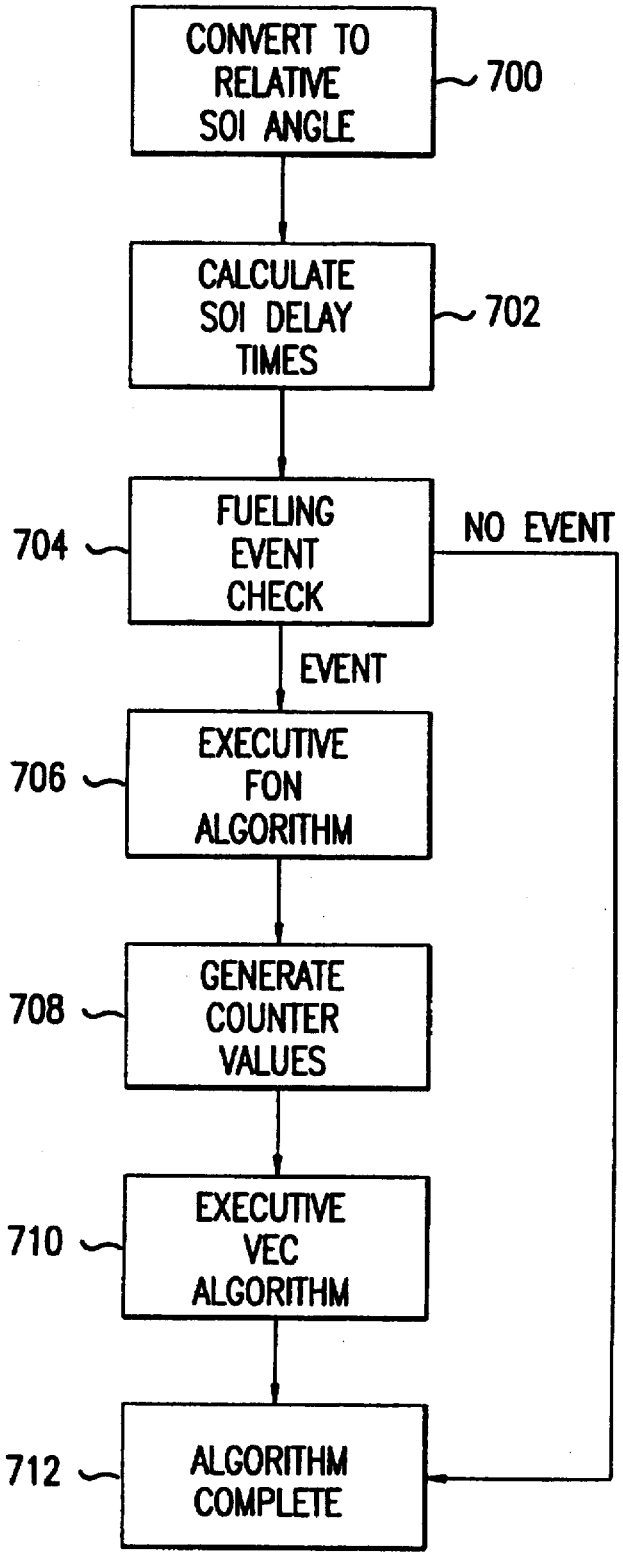
FIG. 7 is a flowchart of a fueling command conversion algorithm (FCA) according to the present invention.

Referring next to FIG. 7, the FCA algorithm shown schematically in FIG. 3 as block 312, will be discussed and illustrated in more detail. The function of the fueling control algorithm shown in FIG. 7 is to determine if a fueling event is to occur during the current interrupt interval. If it is determined that a fueling event is to occur, the FCA algorithm determines a start of injection timing value and a duration of the injection timing value. The FCA algorithm further converts these values into timer values that are sufficient to control the injection control valve 20 shown in FIG. 1, and initiates a fueling event.

The fueling control algorithm begins in block 700 with the conversion of a crank absolute start of injection value for each of the engine cylinders to a cylinder relative start of injection value that is based on the TDC for each engine cylinder. The algorithm accesses the absolute top dead center values for each cylinder, which are stored in memory. The timing angles and the cylinder specific calibrations are added to each of the predetermined cylinder top dead center values, while the valve and line delays are subtracted from each of these values. The results of this calculation yield engine positions indicating when fueling events are to occur for at least the next two engine cylinders and possibly for every cylinder within the engine.

These six engine positions indicating the appropriate start of a fueling event will be represented as angular degrees of engine crankshaft rotation, i.e., from 0° to 719° . Following this calculation of the appropriate start of injection angle, processing continues in block 702. In block 702, the start of injection delay times are calculated. That is, the time (in GPT counts) until the next fuel injection event is to occur is generated by subtracting the current engine position in degrees from each of the calculated fueling event engine positions (in engine crankshaft degrees). The result of this calculation yields the number of engine degrees until the start of injection for that cylinder will occur. This value is then multiplied by the number of timer counts that are received for each crank degree of rotation to yield the number of GPT timer counts until a start of injection is to occur. The result is an estimate of the time (in GPT timer counts) until each injection event is to occur.

Execution then continues with block 704, where the algorithm determines whether a fueling event is to occur during the current interval. That is, if the number of timer counts until the start of injection calculated in block 702 is less than the number of timer counts before completion of the present interrupt interval (as predicted in block 616), then a fueling event will occur during the current interval. As discussed above, speed interrupts typically occur from speed sensor 33 approximately every 30° of crankshaft rotation. Therefore, if a fueling event is determined to be necessary before 30 additional degrees of engine crankshaft rotation have occurred, then it will be necessary to perform an engine fueling event. As can be seen in FIG. 7, if an engine fueling event is determined to be necessary, execution continues in block 706. However, if no engine fueling event is determined to be necessary during this period, execution transfers to block 712 and the fueling control algorithm terminates.

Execution continues in block 706 with the execution of a fueling to on-time (FON) conversion algorithm. Execution of the FON algorithm is used to determine a value representing the desired duration for which injection solenoid valve 20 shown in FIG. 1 should remain open for during the fueling event. The duration is a factor of the accumulator pressure and the desired fueling quantity, and therefore the FON algorithm receives, as inputs, the fueling quantity and the measured accumulator pressure which is detected from sensor 22 by ECM 13 shown in FIG. 1. The algorithm uses the fueling quantity and accumulated pressure to access a three dimensional look up table containing injection solenoid duration values.

In the most preferred embodiment of the present invention, the FON algorithm receives the desired fueling quantity as a percentage of the maximum possible fueling quantity and receives the measured accumulator pressure as a percentage of the maximum possible accumulator pressure. The three dimensional look up table produces a fueling duration, or on-time, that is a percentage of the maximum possible duration. This percentage of maximum possible duration is then converted to GPT timer counts. Furthermore, in the most preferred embodiment of the present invention, the three dimensional look up table currently consists of a 20×20 matrix of accumulator pressure and fueling quantity values. Of course, if more resolution is desired, the size of this table could easily be expanded and addition duration values provided.

Execution then continues in block 708 where the counter values that will actually be used to control the solenoid injection valve 20 are generated. In block 708 the actual value of the free running GPT at the start of injection and at the end of injection are calculated. These values will be used by the VEC algorithm discussed below to control actuation of the solenoid injection valve 20. The calculated duration value is compared to a minimum injection duration value and, if the duration is less than this minimum value, the duration will be set to be equal to the minimum. This minimum duration is used to ensure that a sufficient amount of fuel is pass through solenoid injection valve 20 to adequately lubricate the distributor and other components of the fuel system.

Execution then continues in block 710 where the valve event control (VEC) algorithm is executed. The VEC algorithm is used to control both the solenoid injection valve 20 and the pumping valves 18 and 19 shown in FIG. 1. If a fueling or pumping event are to occur within a given interrupt cycle, the VEC algorithm will generate the appropriate pumping commands. The VEC algorithm is discussed in more detail below in connection with FIG. 9. Following completion of the VEC algorithm in block 710, the fueling command conversion algorithm (FCA) continues in block 712 and is complete.

Referring again to FIG. 6, execution then continues in block 620 where the pumping command conversion algorithm (PCA) is executed. The PCA algorithm calculates an appropriate valve close angle for the pump control valves 18 and 19 of pumps 14 shown in FIG. 1, and converts the valve close angle to an appropriate number of GPT timer counts until the pump control valve should be closed. A more detailed flow chart of the PCA algorithm can be seen in FIG. 8.

Figure 8:
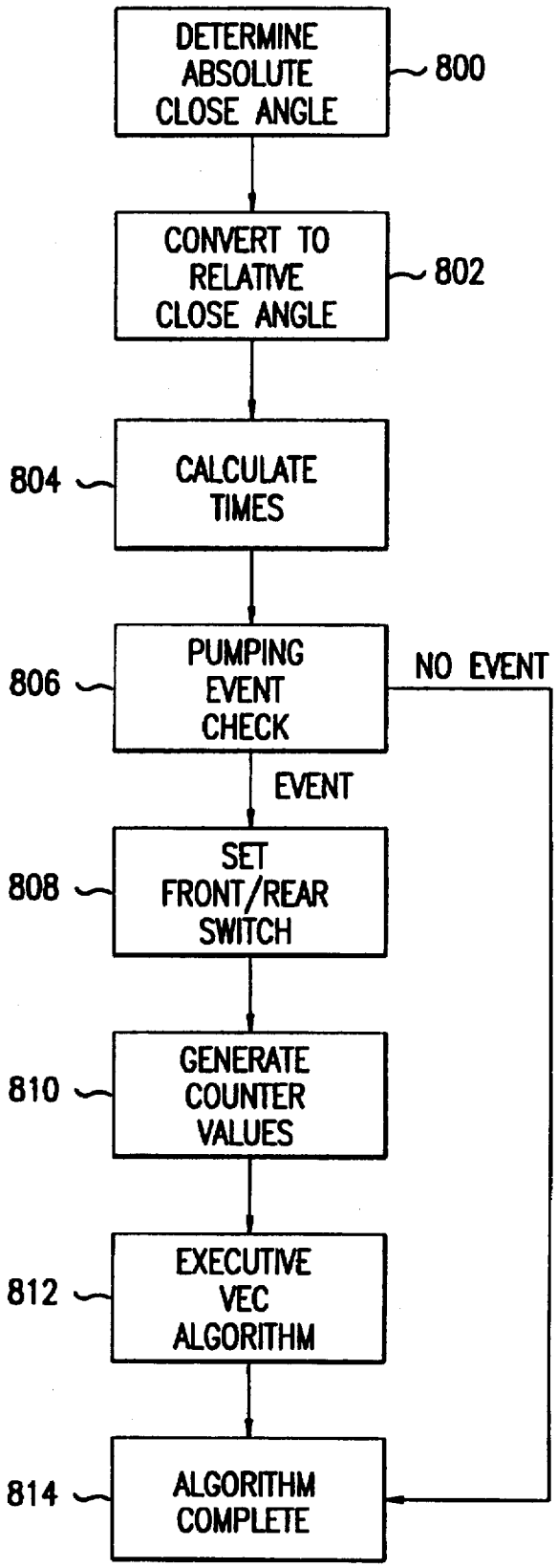
FIG. 8 is a flowchart of a pumping command conversion algorithm (PCA) according to the present invention.

In FIG. 8, processing begins in block 800 with the determination of an absolute pump control valve close angle. During a full 720° of crankshaft rotation, 6 pumping events are possible (i.e. pumps 14 will each execute three potential compression strokes). Therefore, a complete cycle of the cylinder in one of the pumps 14 will take 240° of crankshaft revolution. Thus, three complete cycles will take the entire 720° of crankshaft revolution. Furthermore, 120° of each cycle of the cylinders of pumps 14 will be during the compression stroke of the pump 14. Therefore, the valve close angle determined by the PCA algorithm will range from 120° , indicating a full sweep pumping action, to 0° , indicating no pumping action.

The result of the calculation performed in block 800 yields a valve close angle or VCA in crank degrees. Processing then continues in block 802 where the VCA is convened to a relative close angle based on each pumping event's pump-cam-absolute top dead center. This relative valve close angle is then convened in block 804 to a GPT timer count that indicates when the appropriate pump control valve 18 or 19 is to be closed to achieve the desired pumping action.

From this point, the operation of the PCA algorithm is similar to that of the FCA algorithm discussed above. In block 806, the GPT timer count value calculated in block 804 is compared with the predicted time count value from block 616 to determine if a pumping event is to occur during the current interrupt interval. If no event is to occur, the execution transfers to block 814, and the PCA algorithm terminates.

If a pumping event is to occur, execution continues in block 808 with the selection of the appropriate pump 14 for the pumping action. Based on the engine position and the TDC values for the pumping pistons, the appropriate pump 14 will be selected. TDC values of 0°, 240° and 480° correspond to the front pump 14, while TDC values of 120°, 360° and 600° correspond to the rear pump 14.

Execution continues in block 810 with the generation of the appropriate values to be used to actually control the pump control valve through the VEC algorithm. Block 810 also checks a pump enable register to ensure that the selected pump is operable. If the pump enable register indicates that the pump is not operable, then no pumping time value will be generated and the VEC algorithm will not be executed.

In block 812, the PCA algorithm executes the pump valve event control algorithm, which assigns the correct GPT timer count to the appropriate output compare register of the 68331. When the GPT matches the count in the output compare, the microprocessor will close the pump control solenoid and thus effect pumping of fuel into the accumulator 12. Following completion of the VEC algorithm, the PCA algorithm terminates in block 814.

Figure 9:
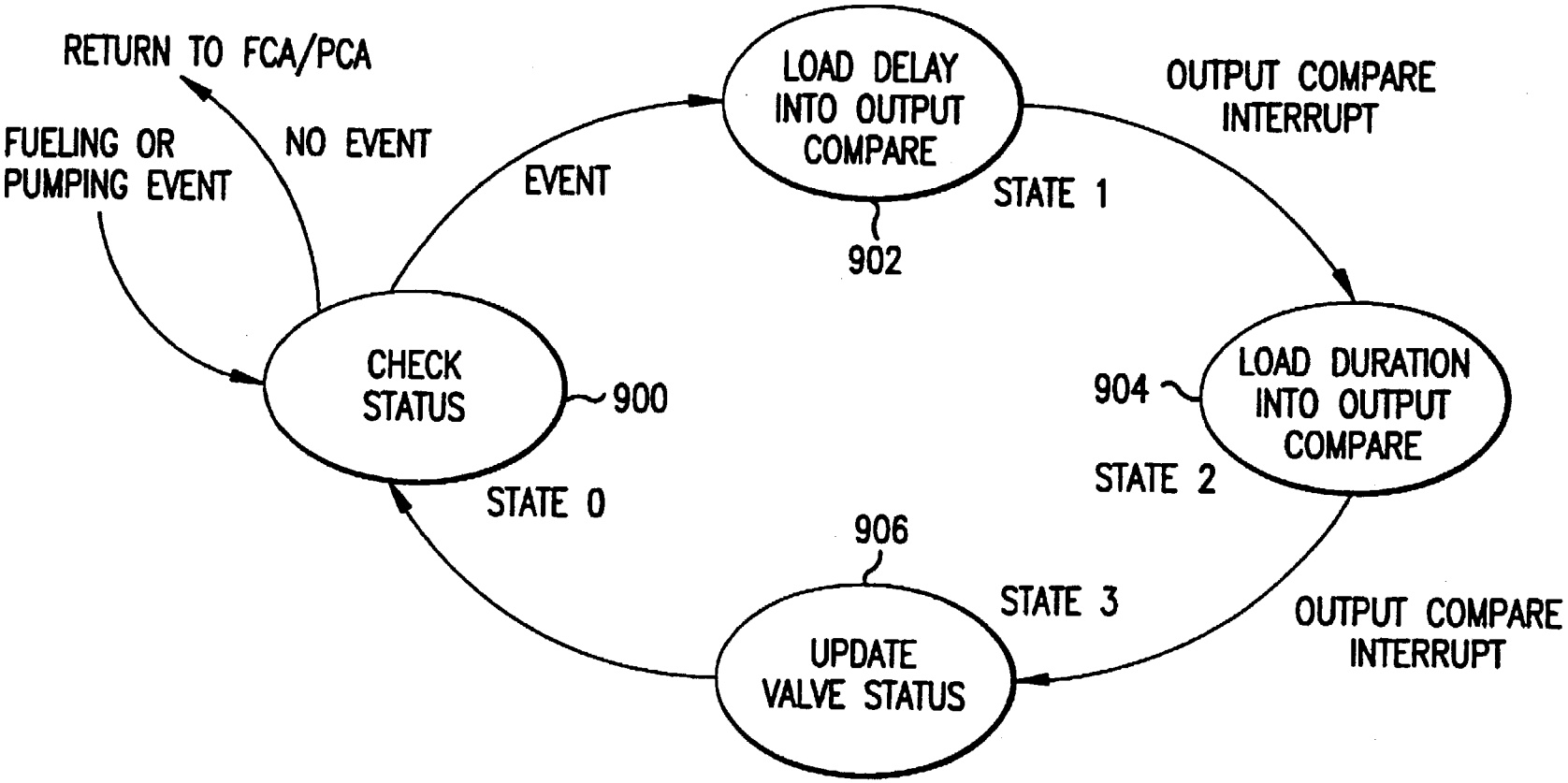
FIG. 9 is a state diagram of the valve event control algorithm (VEC) according to the present invention.

Referring next to FIG. 9, a state diagram of the VEC algorithm used by the FCA and PCA algorithms is illustrated. Although only a single VEC algorithm will be discussed, the preferred embodiment of the preset invention actually includes two software implementations of the VEC algorithm. The first implementation controls the operation of the injection control valve 20, while the second implementation controls the pump control valves 18 and 19. Since it is possible for a fueling event and pumping event to occur very close to each other, it is desirable to employ two separate VEC algorithms in this manner.

As can be seen in FIG. 9, the algorithm begins in state 0 900. This state should be the state that the VEC algorithm is in whenever a call is made from the FCA or PCA algorithms.

If, however, the VEC algorithm is not in state 0 900, then the algorithm will make an indication that the event could not be processed and that the event is currently waiting processing. When the algorithm enters state 3, the VEC algorithm will check to see if there is an event waiting and, if there is such an event waiting, then the VEC algorithm determines if the waiting event should still be processed (i.e. if the rotational position of the engine has not advanced beyond the waiting event). If the event is to be processed, and the initialization of the event has not passed, then the VEC algorithm will transition directly to state 1 to service the waiting event. If the leading edge, or initialization of the waiting event has been missed, then the output of the event will be forced to an active state and the algorithm will transition to state 2 to load the duration value. If the leading edge of the event is missed, the VEC algorithm will also log the event as a diagnostic. Similarly, if both edges are missed, then the VEC algorithm will log the event as a diagnostic and a diagnostic algorithm can executed.

During normal operation, in state 0 900 the output compare of the 68331 microprocessor that will be used to control the fueling or pumping event is programmed to go to an inactive state, to ensure that the output compare is ready to receive a command. The VEC algorithm then transitions to state 1 902.

In state 1 902, the algorithm loads the appropriate delay value until the start of a fueling or pumping event into the appropriate output compare register. For example, in the preferred embodiment, the pumping events use output compare 3, while the fueling events use output compare 1. When the GPT counter equals the value in the output compare register, then the output will become active, thus starting the fueling or pumping event and issuing an interrupt. Upon receipt of the interrupt, the VEC algorithm will transition to state 2 904.

State 2 904 will load the appropriate duration for the pumping or fueling event into the output compare register. In this manner, when the GPT counter equals the value int he output compare, then the pumping or fueling event will terminate. Upon this termination, an interrupt is issued, and the VEC algorithm will transition to state 3 906. State 3 906 merely updates the status of the valves and clears the appropriate control registers and then returns to state 0 900 to await another fueling or pumping event command.

Figure 10:
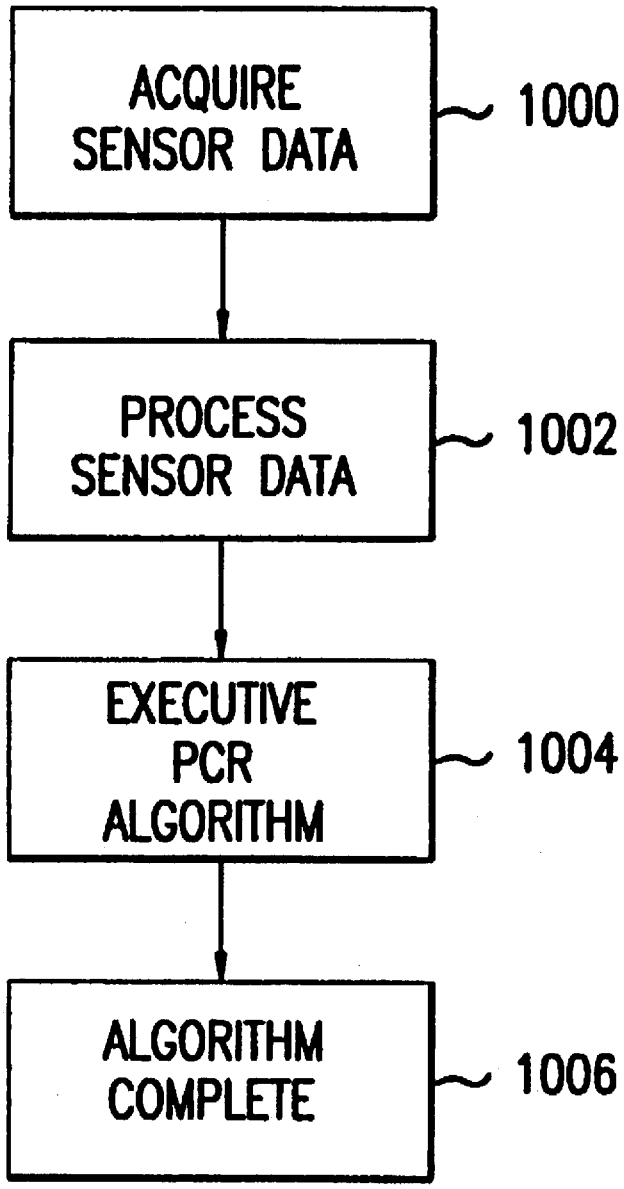
FIG. 10 is a flowchart of an accumulator pressure sensor sampling (PSS) algorithm according to the present invention.

The accumulator pressure sensing and controlling algorithms shown in FIG. 3, blocks 302, 304 and 306 will now be discussed in connection with FIG. 10. FIG. 10 shows a flowchart of the accumulator pressure sensor sampling (PSS) algorithm. This algorithm performs all of the engine speed synchronous activities used to control the pressure in the accumulator 12. These activities include the acquiring and processing of the accumulator pressure sensor 22 data and execution of the pressure controller. In accordance with the present invention, these events are executed synchronously with the engine rotation since all pressure events occur as a function of engine speed.

The PSS algorithm begins in block 1000 with the acquisition of the pressure sensor data. This is accomplished by sampling the data from pressure sensor 22 and converting this data to a digital signal using an analog-to=digital converter. This digital representation of the pressure in the accumulator is then storm for later use by the pressure algorithms.

Execution continues in block 1002, where the raw pressure data sampled in block 1000 is processed. This processing includes range checking and filtering of the sampled accumulator pressure data. The result of this calculation is a filtered pressure sensor value that is suitable for use by the remaining pressure algorithms.

In block 1004, the PSS algorithm executes the accumulator pressure control (PCR) algorithm, which calculates an appropriate valve close angle (VCA) based on a desired pressure setpoint reference and the measured accumulator pressure. The VCA is output as a percentage of total pumping volume desired. Therefore, an output 0% indicates that no pumping is required, while a value of 100% indicates that the maximum (full swept) pumping available should be performed. To calculate the VCA, the PCR algorithm uses a proportional integral derivative (PID) controller, that operates in a manner familiar to those of skill in the art to track the desired pressure setpoint.

Once the appropriate VCA has been established, the PSS algorithm terminates at block 1006. The pumping action required is analyzed by the PCA algorithm and a pumping event is initiated if necessary in response to the VCA calculated by the PSS algorithm. From the above, it will be readily apparent to those of skill in the art that the present invention provides a system and method by which the accumulator pressure is monitored and supplemented as required to maintain a constant pressure setpoint.

The above description of the software together with the source code set forth in the microfiche software appendix will allow one of skill in the art to implement a fuel system controller in accordance with the present invention and to achieve the advantages associated therewith.

Several additional specific features of the invention will now be discussed. First, referring to FIGS. 11*a* and 11*b*, one device which may be incorporated into an internal combustion engine fuel system to provide rate shaping capability in accordance with the present invention is illustrated. By reducing the rate at which fuel pressure increases at the nozzle assembly during the initial phase of injection and, therefore, reducing the initial fuel quantity injected into the combustion chamber, the various embodiments of the present invention are better able to achieve various objectives such as more efficient and complete fuel combustion with reduced emissions.

Figure 11A:
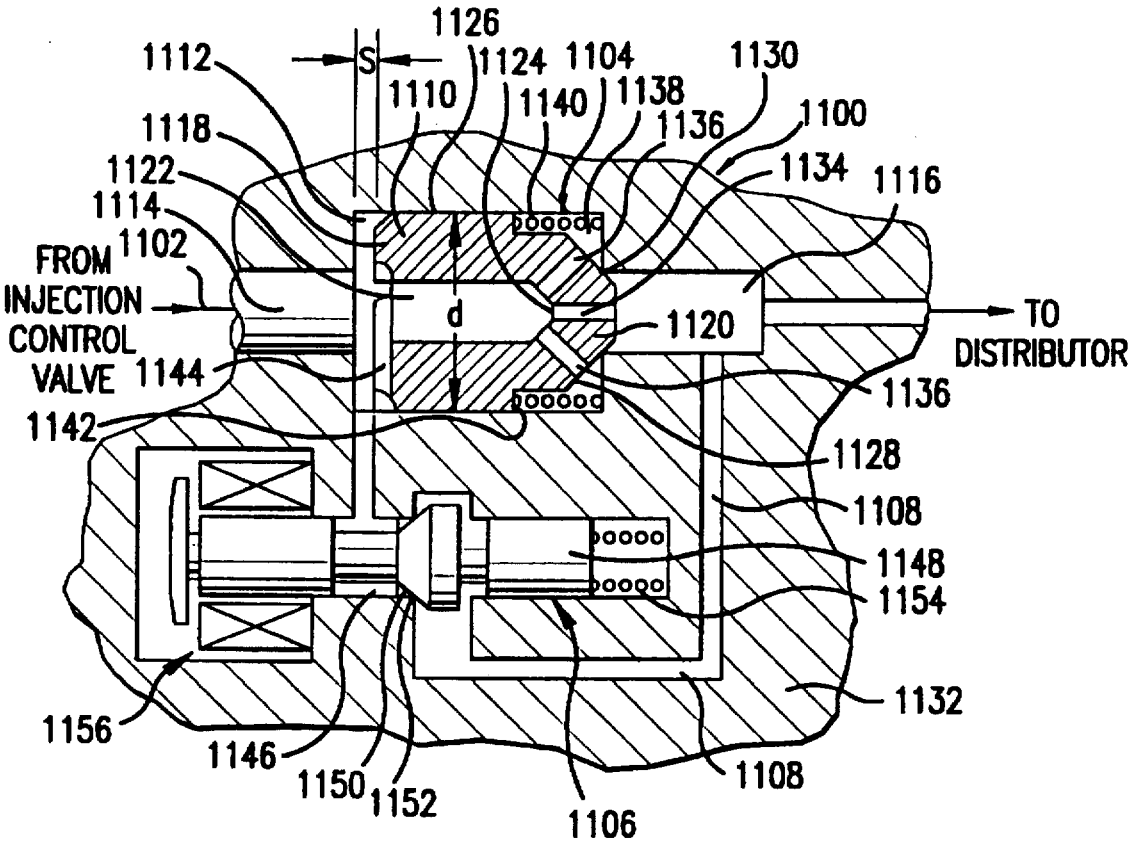
FIG. 11*a* is a cross sectional view of a rate shaping device controlled by the present invention.

Referring initially to the embodiment shown in FIG. 11*a*, a rate shaping device indicated generally at 1100 is positioned along the fuel transfer circuit 1102 (located between the fuel injection control valve 20 and the distributor 16 of FIG. 1). However, rate shaping device 1100 could be utilized successfully in any type of fuel delivery system.

As shown in FIG. 11*a*, rate shaping device 1100 includes a flow limiting valve 1104 positioned within fuel transfer circuit 1102 and a rate shaping by-pass valve 1106 positioned in a by-pass passage 1108. Flow limiting valve 1104 includes a slidable piston 1110 mounted for sliding movement within a piston chamber 1112 formed in fuel transfer circuit 1102 so as to create a fuel inlet 1114 and a fuel outlet 1116. Slidable piston 1110 includes a first end 1118 positioned adjacent fuel inlet 1114, a second end 1120 positioned adjacent fuel outlet 1116 and a central bore 1122 extending from first end 1118 inwardly to terminate at an inner end 1124. Slidable piston 1110 also includes an outer cylindrical surface 1126 having a sufficiently close sliding fit with the inside surface of piston chamber 1112 to form a fluid seal between surface 1126 and the inside surface of piston chamber 1112. Second end 1120 of slidable piston 1110 includes a conical surface 1128 for engaging an annular valve seat 1130 formed on distributor housing 1132 at fuel outlet 1116 when slidable piston 1110 is moved to the right as shown in FIG. 11*a*.

Slidable piston 1110 also includes a central orifice 1134 extending through second end 1120 to fluidically connect central bore 1122 with fluid outlet 1116 regardless of the position of slidable piston 1110. A plurality of first stage orifices 1136 extend through second end 1120 from central bore 1122. First stage orifices 1136 are oriented in relation to valve seat 1130 so that when flow limiting valve 1104 is in the position shown in FIG. 11*a*, hereinafter called the second stage position, fuel flow from first stage orifices 1136 to fuel outlet 1116 is blocked by the abutment of conical surface 1128 and valve seat 1130. Flow limiting valve 1104 includes a spring cavity 1138 formed between piston 1110 and distributor housing 1132 for housing a biasing spring 1140. An annular step 1142 formed on piston 1110 functions to provide a spring seat for spring 1140 which biases piston 1110 leftward as illustrated in FIG. 11*a* into a first stage position.

Bypass passage 1108 communicates at one end with fuel inlet 1114 via piston chamber 1112 and at an opposite end with fuel outlet 1116. Slidable piston 1110 includes radial grooves 1144 in the end surface of first end 1118 for permitting fuel to flow between fuel inlet 1114 and bypass passage 1108 when flow limiting valve 1104 is in the first stage position. Rate shaping bypass valve 1106 is positioned along bypass passage 1108 in a rate shaping valve cavity 1146. Rate shaping bypass valve 1106 includes an elongated valve element 1148 having a conical valve surface 1150 for engaging an annular valve seat 1152 formed in distributor housing 1132. Rate shaping bypass valve 1106 is preferably a two-position, two-way pressure balanced solenoid-operated valve which includes a bias spring 1154 positioned to bias valve element 1148 into the closed position against valve seat 1152. Solenoid assembly 1156 is used to move valve element 1148 to the right in FIG. 11*a* into a full flow, open position, separating conical valve surface 1150 from annular valve seat 1152, thus establishing flow through bypass passage 1108.

Figure 11B:
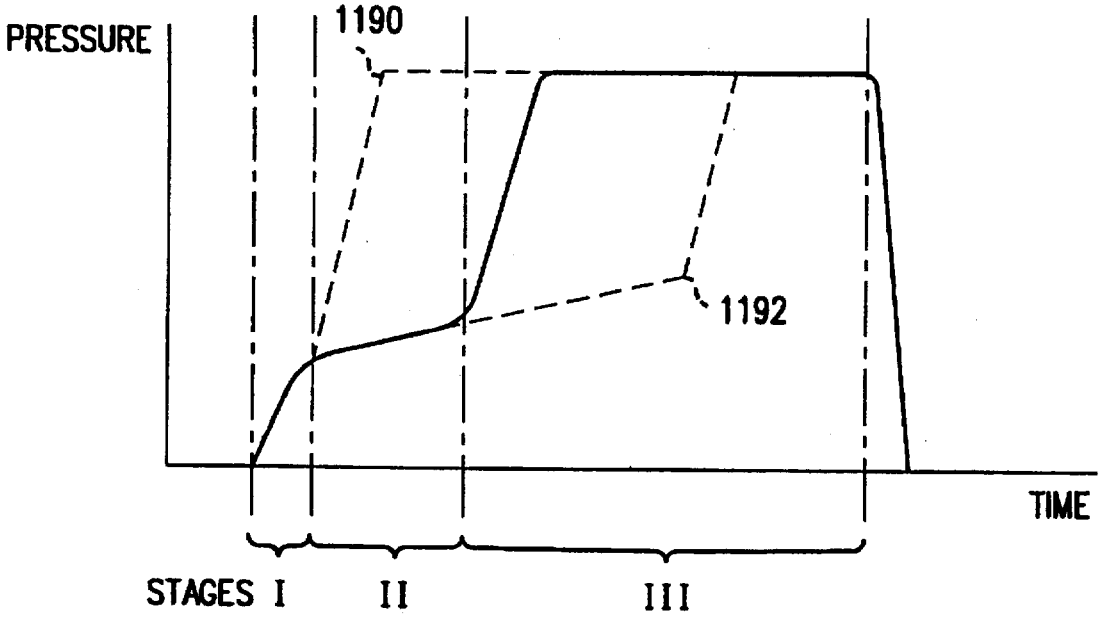
FIG. 11*b* is a graph showing a fuel injection pressure waveform which can be generated by the present invention using the device of FIG. 11*a*.

In general, flow limiting valve 1104 functions to control or shape the pressure rate increase at the nozzle assembly during the initial stages of an injection event, as represented by stages I and II in FIG. 11*b*, while also controlling the return flow of fuel through the transfer circuit at the end of the injection event when the injection control valve 20 is connected to drain thereby minimizing cavitation in the fuel transfer circuit and associated fuel injection lines. Rate shaping bypass valve 1106 functions primarily to allow a rapid increase in the pressure rate when it is desirable to achieve maximum pressure at the nozzle assembly by providing an unrestricted flow path through fuel transfer circuit 1102 after the initial injection period as represented by stage III in FIG. 11*b*.

More specifically, during operation, just before the start of an injection event, injection control valve 20 is in the closed position connecting fuel transfer circuit 1102 to drain. At this time, flow limiting valve 1104 is in its first stage position with first end 1118 in abutment against distributor housing 1132 permitting fluidic communication between fuel inlet 1114 and fuel outlet 1116 via both central orifice 1134 and first stage orifices 1136. Rate shaping bypass valve 1106 is in the closed position under the force of bias spring 1154 blocking flow through bypass passage 1108. Once injection control valve 20 is energized to connect accumulator pressure to fuel transfer circuit 1102, high pressure fuel initially flows through both central orifice 1134 and first stage orifices 1136 creating an initial pressure increase downstream of flow limiting valve 1104 and at the respective nozzle assembly as represented by stage I in FIG. 11*b*. However, accumulator fuel pressure at fuel inlet 1114 acts on the end surface of first end 1118 and on inner end 1124 of central bore 1122 to move slidable piston 1110 to the right in FIG. 11*a*, placing slidable piston 1110 in the second stage position with conical surface 1128 in abutment with valve seat 1130. Thus, fuel flow through first stage orifices 1136 is blocked while a limited amount of fuel passes through central orifice 1134 to fuel outlet 1116 thus decreasing the rate at which fuel pressure at the nozzle assembly is increasing as represented by stage II in FIG. 11*b*.

After a predetermined period of time as determined by ECM 13, rate shaping bypass valve 1106 is energized to the open position allowing full flow of fuel through bypass passage 1108, causing a sharp increase in the fuel delivery pressure as represented by the upwardly sloping pressure rate of stage III in FIG. 11*b*. The pressure at the nozzle assembly quickly reaches a maximum level until the end of the injection event as determined by the closing of injection control valve 20. Consequently, as shown in FIG. 11*b*, rate shaping device 1100 creates an first stage of fuel injection (stage I) having a high pressure rate increase, a second stage of fuel injection (stage II) having a reduced pressure rate less than stage I and a third stage wherein the pressure rate increase is initially greater than stage II. By reducing the pressure rate increase at the nozzle assembly during the initial stages of injection, i.e. stage II, rate shaping device 1100 also reduces the quantity of fuel delivered to the combustion chamber during the initial stage which, in turn, advantageously reduces the level of emissions generated by the combustion process.

Upon closing, injection control valve 20 blocks fuel from the accumulator while connecting fuel transfer circuit 1102 to drain. After a predetermined period of time, again determined by ECM 13, rate shaping bypass valve 1106 is de-energized and moved to the closed position by bias spring 1154. However, note that the pressure relief of fuel transfer circuit 1102 downstream of rate shaping device 1100 can be controlled or shaped in a variety of ways depending on the timing of closing of rate shaping bypass valve 1106 in relation to the closing of injection control valve 20. If the closing of rate shaping bypass valve 1106 is retarded or delayed until a significant amount of time after the closing of fuel injection control valve 20, bypass passage 1108 will function as the primary relief passage allowing an intensive return flow of fuel to drain, thus quickly relieving a substantial amount of fluid pressure from the downstream transfer circuit and respective fuel injection line while a secondary relief flow is established through flow limiting valve 1104. However, by closing rate shaping bypass valve 1106 simultaneously with, or immediately after, the closing of injection control valve 20, primary relief occurs through flow limiting valve 1104. In both instances, once rate shaping bypass valve 1106 closes, the fuel pressure at fuel inlet 1114 becomes less than the fuel pressure in fuel outlet 1116. As a result, the fluid forces acting on the end surface of piston 1110 at second end 1120, combined with the biasing force of spring 1140, become greater than the fluid forces acting on piston 1110 which tend to move piston 1110 to the right in FIG. 11*a*. Consequently, slidable piston 1110 of flow limiting valve 1104 will immediately move leftward in FIG. 11*a* into the first stage position communicating first stage orifices 1136 with fuel outlet 1116, thus permitting fuel flow through flow limiting valve 1104 via orifices 1134 and 1136. Central orifices 1134 and first stage orifices 1136 are large enough in diameter so that their combined cross-sectional flow area create the necessary return flow during the drain event to insure sufficient fuel pressure relief at the nozzle assembly to prevent secondary injections. On the other hand, central orifice 1134 and first stage orifices 1136 are small enough to provide a combined flow area designed to limit the return flow to a predetermined level necessary to minimize cavitation in the circuit and injection lines between flow limiting valve 1104 and the nozzle assemblies.

Therefore, flow limiting valve 1104 functions as a variable flow valve when moved between the first stage and second stage positions to advantageously utilize the flow limiting feature of central orifice 1134 during the injection event to shape the pressure rate increase while advantageously controlling the return flow during the drain event to both prevent secondary injections and minimize cavitation.

One advantage of this design is realized by locating rate shaping bypass valve 1106 downstream of the injection control valve. This arrangement minimizes the leakage loss occurring through valve 1106. This leakage is four times less than it would be if valve 1106 were placed upstream of the injection control valve (assuming the duration is 30 degrees crank angle and the engine is a six cylinder four stroke engine).

From the above discussion, it will be apparent to one of skill in the art that the combination of the injection control valve 20 (shown in FIG. 1) and the rate shaping device 1100 allow ECM 13 to control the fuel pressure in a variety of methods. For example, as shown in FIG. 11*b*, the duration of stage II can be varied by ECM 13 to allow for a longer or shorter period of intermediate pressure injection. This is accomplished since the control of the rate shaping bypass valve 1106 can be performed by ECM 13.

By altering the opening of the bypass valve 1106, pressure waveforms as shown by the dotted lines in FIG. 11*b* could, for example, be achieved. Curve 1190, for example, would result when rate shaping bypass valve 1106 is opened at, or soon after, the time that piston 1110 seats against seat 1130. Curve 1192, for example, illustrates the pressure waveform when the rate shaping bypass valve 1106 remains closed for a longer duration, and is opened at a later time.

Furthermore, the use of a single injection valve 20 facilitates the ability to provide rate shaping capability to the present control system. The use of a single injection valve is particularly advantageous in that it ensures a uniform, consistent pressure response during an injection event. Variations that could occur sue to the provision of multiple injection valves are not introduced with the present invention, and furthermore, more precise control over the injection pressure shape can be achieved.

This concept will be illustrated in connection with FIG. 12*a*, which depicts a injection pressure rate that is characterized in that it has a first small injection pressure pulse, followed by a larger, longer duration injection pulse. This injection pressure waveform could be produced, for example, by pulse the injection valve 20 for a short duration to generate the smaller pressure pulse, and then operating injection valve 20 to produce the larger injection pressure waveform.

Figure 12A:
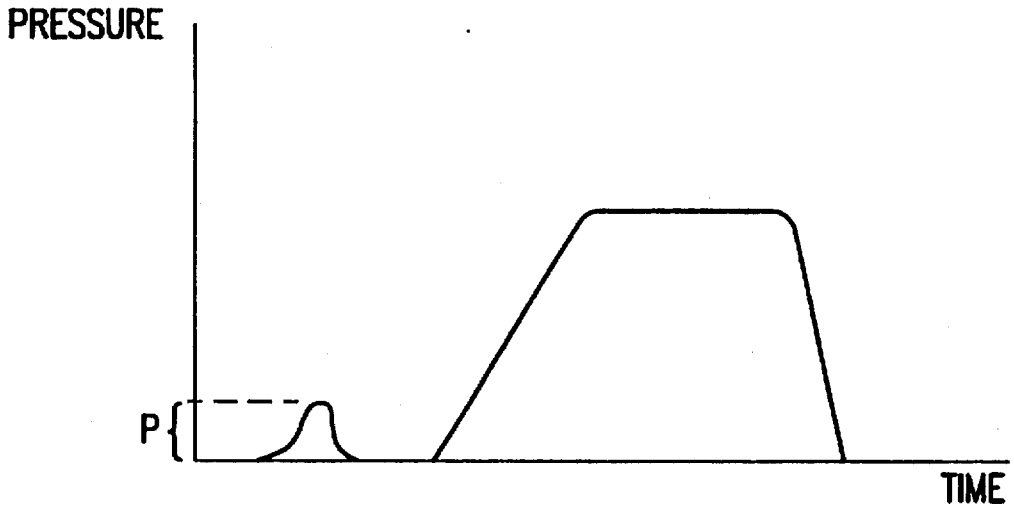
FIG. 12*a* is a graph showing a second fuel injection pressure waveform which can be generated by the present invention using the injection valve of FIG. 1.
Figure 12B:
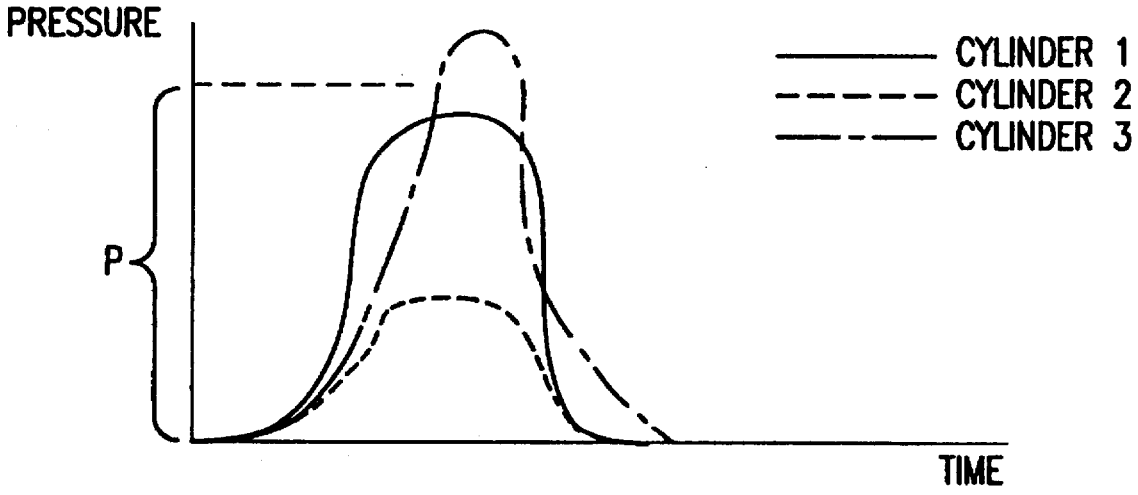
FIG.12b (PRIOR ART)
FIG. 12*b* is a graph showing variations in waveforms due to differing solenoid valve responses in prior art systems.

Since the present invention only utilizes a single injection solenoid, the pressure waveform shown in FIG. 12*a* will be consistent and uniform for all engine cylinders. As shown using an expanded pressure axis in FIG. 12*b*, however, manufacturing tolerances and variations occurring between different injection valves in the prior art led to inconsistencies in the pressure waveform where multiple injection valves are employed for fuel injection. This phenomenon would be particularly apparent in the pressure waveform of the preliminary pressure pulse of the present invention (shown in FIG. 12*a*), since minor manufacturing variations will effect this pulse to a greater extent then the larger, longer duration injection waveform.

The combination of the single injection control valve 20 and the pressure rate shaping device 1100 can also used to create additional pressure waveforms that again will be uniform and consistent between engine cylinders due to the provision of a single injection control valve 20 and a single rate shaping bypass valve 1106. For example, the pressure waveform shown in FIG. 13 could be achieved through the combination of rate shaping techniques discussed above.

Figure 13:
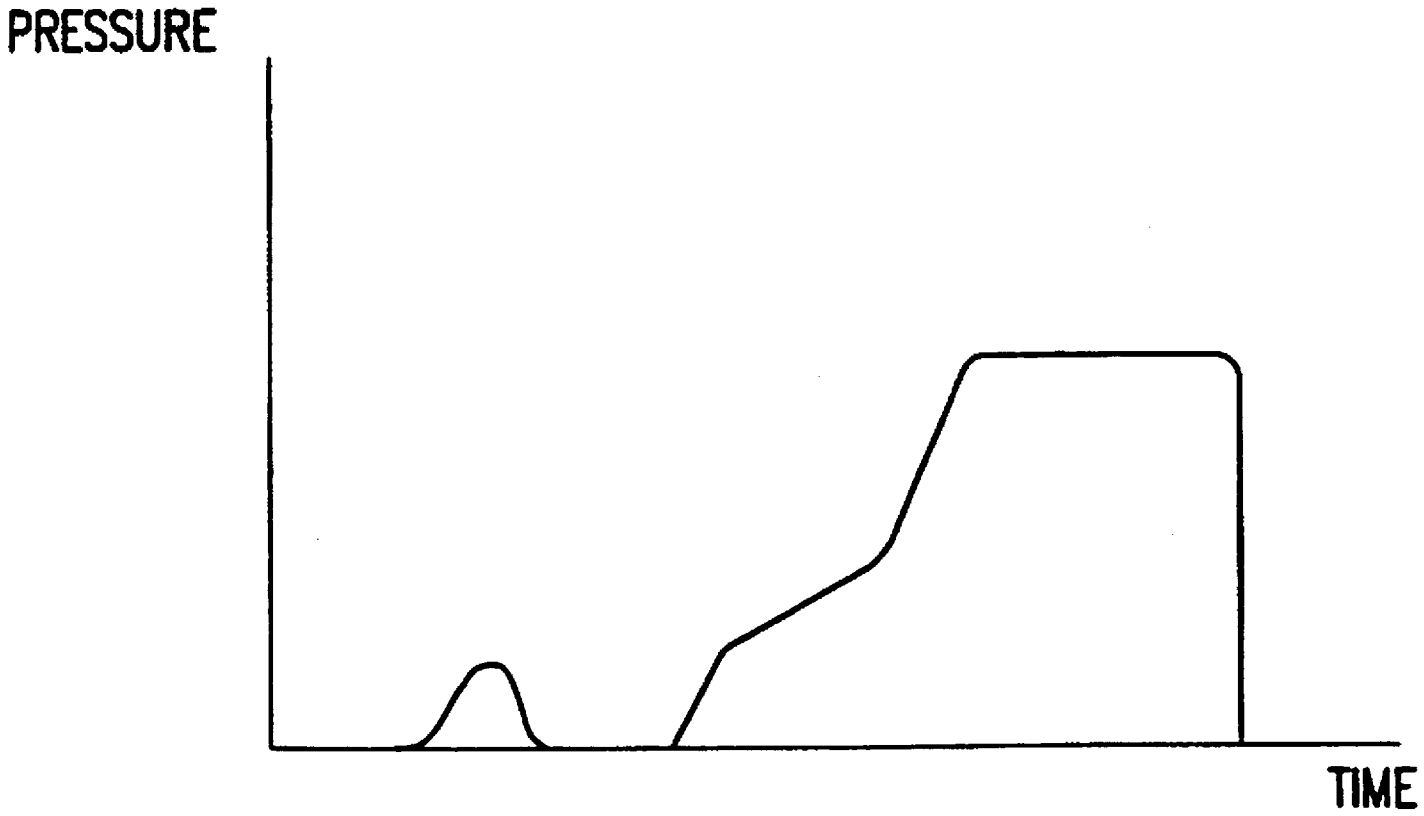
FIG. 13 is a graph showing a further injector pressure waveform which can be generated by the present invention using both the device of FIG. 11*a* and the injection valve shown in FIG. 1.

FIG. 13 shows a pressure waveform that includes a single, relatively smaller initial pressure pulse, followed by a larger multiple level pressure waveform. The initial pressure pulse is achieved through pulsing of the injection control valve 20, while the later, multiple level pressure waveform is achieved through the use of rate shaping bypass valve 1106. Other novel combination of these two components to achieve pressure waveforms in accordance with the present invention will also be readily apparent to those of skill in the art.

In a preferred embodiment of the invention, the fuel injection solenoid valve driver circuit may be provided with a back EMF detection circuit which electrically detects the opening of the solenoid valve based on the back-EMF generated by the movement of the valve's mass through the solenoid's magnetic field. With this back EMF circuit, it may be possible in some cases to eliminate the solenoid boost circuit.

Figure 14:
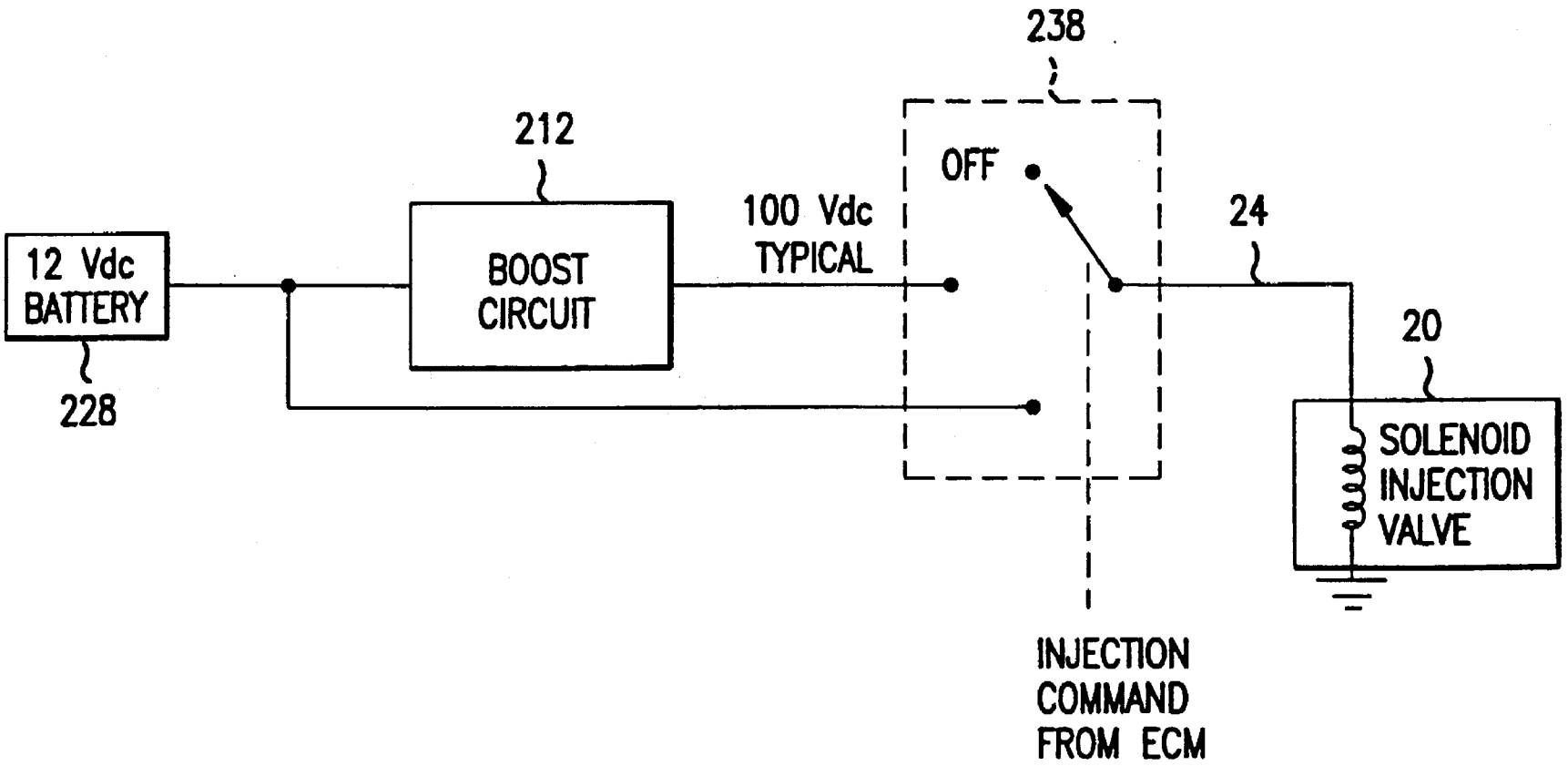
FIG. 14 is a block schematic diagram of a boost circuit of the type used in the present invention.

As noted previously, because of the criticality of timing the injected fuel into the cylinder relative to piston position, it is considered desirable to open the valve very quickly, to minimize the delay from the decision to inject to the time the fuel actually enters the cylinder. Increased speed of valve operation may be obtained by providing a "boost circuit" as described before, which steps the battery voltage up to a much larger voltage. When the control system determines that it is time to inject fuel to the cylinder, it applies this large voltage to the solenoid coil for a brief period of time, which causes a rapid current rise through the coil, resulting in a rapid opening time. The valve is then held open using the conventional battery voltage. FIG. 14 shows, in block schematic form, the operation of the boost circuit. Battery 228 is connected to boost circuit 212 which is connected to one input of driver circuit 238. The battery 228 is also connected to an input of driver circuit 238. In response to an injection command from the ECM 13, driver circuit 238 first switches the 100 to 175 volt DC output of the boost circuit 212 to line 24 and thus to solenoid injection valve 20 to quickly open injection valve 20. Then, after a predetermined time, driver circuit 238 disconnects boost circuit 212 and connects battery voltage to solenoid injection valve 20 instead to hold solenoid injection valve 20 open.

While boost circuits are necessary in some cases, there are some significant disadvantages associated with the use of boost circuits. The circuitry required to step up the battery voltage typically requires several components, with cumulative costs in the tens of dollars. In high production volumes, this is a substantial cost. In addition, the driver circuit consumes a disproportionate amount of physical space. Because large components are needed to convert a low DC voltage to a large one (typically one inductor and several capacitors, along with power semiconductor components), it increases the size of the electronic control module (ECM), making engine mounted applications more challenging. Boost circuits also have a relatively high failure rate. Power electronics, because it experiences higher electrical stresses, runs at higher temperatures. This results in higher failure rates than the ECM's digital components, increasing maintenance costs and equipment downtime. Finally, the use of a boost circuit causes increased stress in the valve. Because the goal is to accelerate the valve very quickly, the valve impacts its seat with a high force. This tends to wear the valve out more quickly than if the valve could be allowed to open more slowly. Thus, in another preferred embodiment of the invention, the boost circuit is eliminated.

Figure 15:
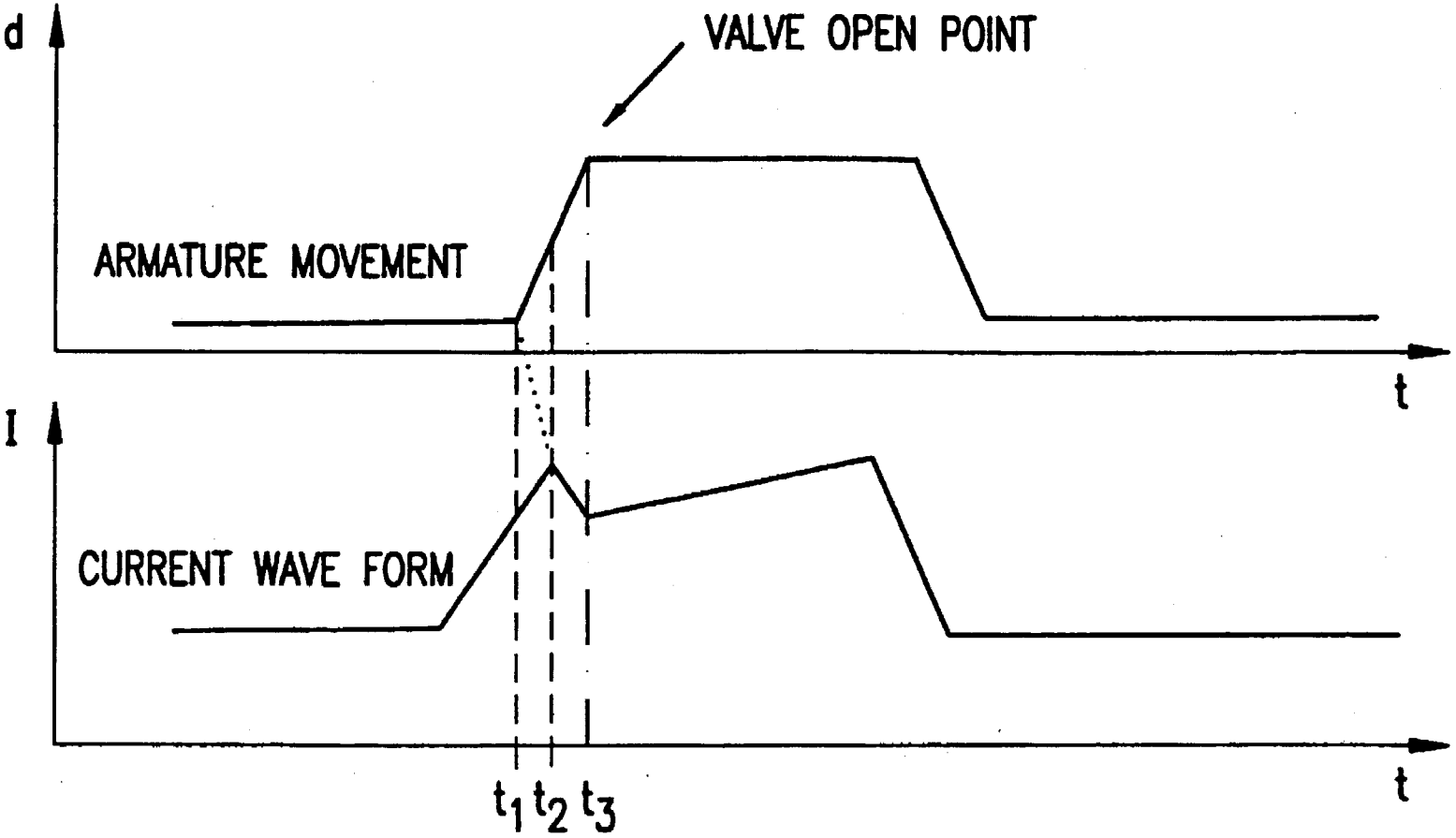
FIG. 15 is a graph showing a current dip during valve transition which can be measured using back EMF techniques as disclosed in the present invention.

In this alternative embodiment, a back EMF sensor is provided in the injection solenoid driver circuit. By knowing the opening time of the valve under all of its operating and varying lifetime conditions, ECM 13 can dynamically compensate for the delay, thus injecting the fuel at a correct time regardless of valve opening speed. The back EMF sensor detects valve opening by monitoring the back-EMF generated by valve 20 as it passes through the magnetic field set up by its coil. This back-EMF will always oppose the valve motion, and therefore manifest itself in a current dip during the valve transition. A typical example of this current dip is shown in FIG. 15. The point that the valve has opened, and motion has seized, will always be the point where the dip's negative slope returns to positive, shown in the Figure at $t_3$.

Figure 16:
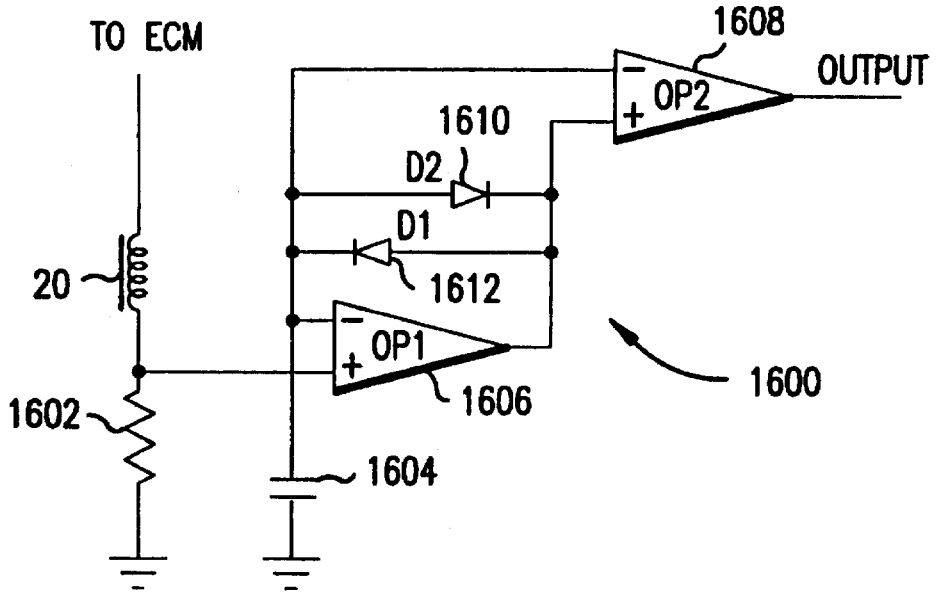
FIG. 16 is a schematic diagram of a back EMF detection circuit according to the present invention.

FIG. 16 shows a back EMF detection circuit 1600 according to the present invention. Back EMF detection circuit 1600 comprises sensing resistor 1602, capacitor 1604, operational amplifiers 1606 and 1608, and diodes 1610 and 1612. Sensing resistor 1602 is connected in the circuit of the coil of solenoid valve 20 between the coil and ground. Capacitor 1604 is connected between the negative input of operational amplifier 1606 and ground. The positive input of operational amplifier 1606 is connected to the terminal of sensing resistor 1602 at its connection to the coil of solenoid valve 20. The negative input of operational amplifier 1608 is connected to the negative input of operational amplifier 1606, and the output of operational amplifier 1606 is connected to the positive input of operational amplifier 1608. Diodes 1610 and 1612 are connected with opposing polarities between the positive input of operational amplifier 1608 and the negative inputs of the operational amplifiers. The back EMF sensing output of back EMF sensing circuit 1600 is taken at the output of operational amplifier 1608.

Figure 17:
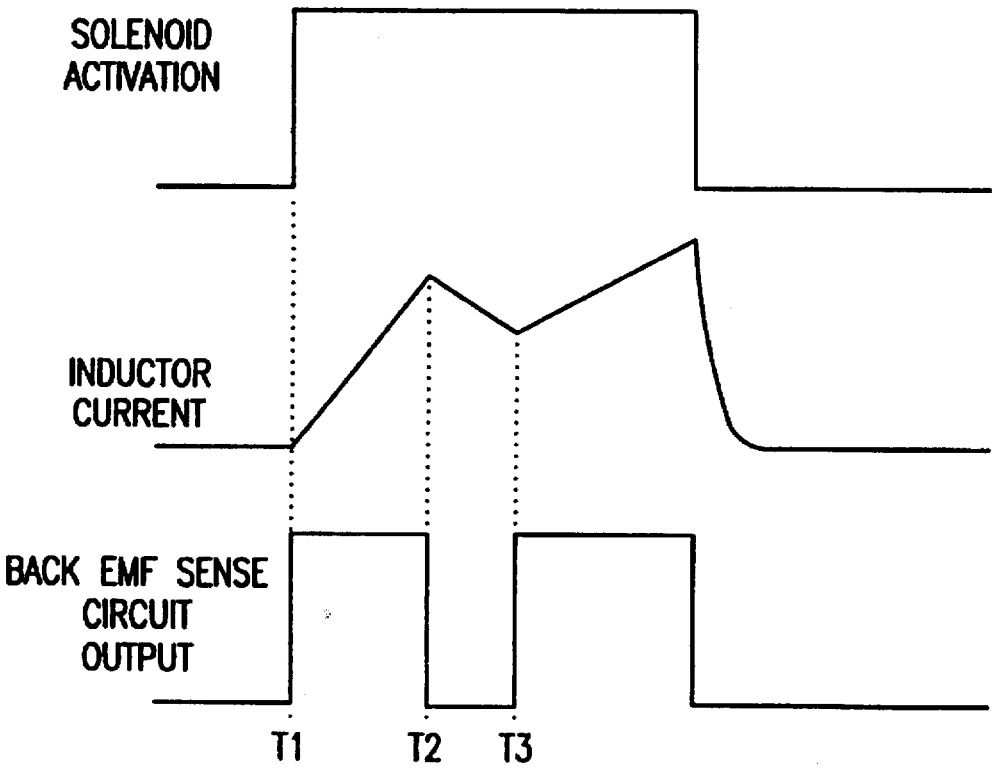
FIG. 17 is a graph of the waveforms associated with the operation of the solenoid valve and back EMF sensing circuit of the present invention.

FIG. 17 shows the waveforms associated with the operation of the solenoid valve 20 and back EMF sensing circuit 1600. At times prior to T1, there is no injection operation in process, so that the current through the solenoid inductor is zero, and therefore there is no voltage across sensing resistor 1602. On startup, noise present in circuit 1600 may cause operational amplifier 1606 to oscillate briefly, until capacitor 1604 is charged to a value above the noise floor, saturating operational amplifier 1606 low. Preferably, the software in ECM 13 will be programmed to ignore such oscillation at times when no injection is in process to avoid false readings caused by noise.

At time T1, ECM 13 actuates solenoid valve 20. Current rises exponentially through the inductor (coil) of solenoid valve 20, causing a voltage rise across sensing resistor 1602 equal to the current through the solenoid times the value of sensing resistor 1602. As the current rises, diode 1612 is forward biased, causing the voltage at the positive input of operational amplifier 1608 to be a diode drop higher that its negative input, forcing its output high. This state is maintained until the current dip due to the back-EMF from the valve transition begins at time T2. At time T2, operational amplifier 1606 continues to make the voltage across capacitor 1604 track the voltage drop across sensing resistor 1602, so diode 1610 becomes forward biased. This causes the negative input of operational amplifier 1608 to be at a higher potential than its positive input, causing its output to transition low. When the valve transition stops at time T3, the positive slope of the injector current begins again, resulting in a positive transition of operational amplifier 1608 output. Thus a valve opening will result in two distinct edges, the first falling edge (T2) indicating that motion has begun, the second rising edge (T3) indicating that motion has been completed. The output of operational amplifier 1608 is connected to the microprocessor in ECM 13, which monitors these edges to detect and measure the events. The time measured to open the valve during an event is stored ($T_{open}$=T3–T1), and this valve delay time measurement is used to compensate in timing the command to open the valve for the next event. The ECM can also measure time from command to initial valve motion (T2–T1) and time for valve to travel (T3–T2) and store these time values for prognostic and diagnostic purposes. For example, these quantities could be stored over time and analyzed using statistical control techniques to provide advance warning of changing valve operating conditions that may lead to problems in operation.

This circuit has particular advantages in the context of the present invention. The cost for the components necessary to build this circuit are a fraction of what is normally utilized in the industry to accomplish similar results. The fact that it will provide absolute detection of valve motion and opening time without any added sensors, or even adding wires to the valve, provides a significant cost savings. The amount of space needed in ECM 13 to accommodate these circuits is less than one square inch, while the space to accommodate a boosted system, or a non-boosted system with a sensor, is several square inches, resulting in larger required ECM chassis. By eliminating the power circuitry without adding a sensor, the failure rate of the overall control system will be decreased. Since the valve is moving more slowly, its life will also be extended. In addition, this back EMF sensing method inherently provides timing data on the system that can be used to detect mechanical and electrical degradation and failures. This information can be used to warn the operator of impending malfunctions before they become mission disabling, or assist the technician to diagnosing problems.

Additional benefits of this embodiment include reduced probability of EMI problems, decreased shock hazard internal to the controls, and a less noisy fuel system due to decreased valve forces.

In cases where multiple position valves are used, loss of valve acceleration may cause the valve to dwell in undesirable states for longer than desired. In these cases, the boost circuit cannot be eliminated. In the prior art, such a back EMF sensor circuit could not be used when a boost circuit is also used, because the solenoid coil is often saturated to achieve maximum speed, obscuring the back-EMF characteristic. Specifically, a certain amount of force is needed to provide a certain acceleration to move the valve through the undesirable or undefined state quickly (F=mA). Since force is proportional to the square of the flux density (B), flux density is maximized by increasing the field intensity (H). Field intensity equals the number of turns of coil multiplied by the current through the coil, divided by the length of the core: H=(N*I)/L. The relationship between B and H for a typical solenoid valve is shown in FIG. 18.

Figure 18:
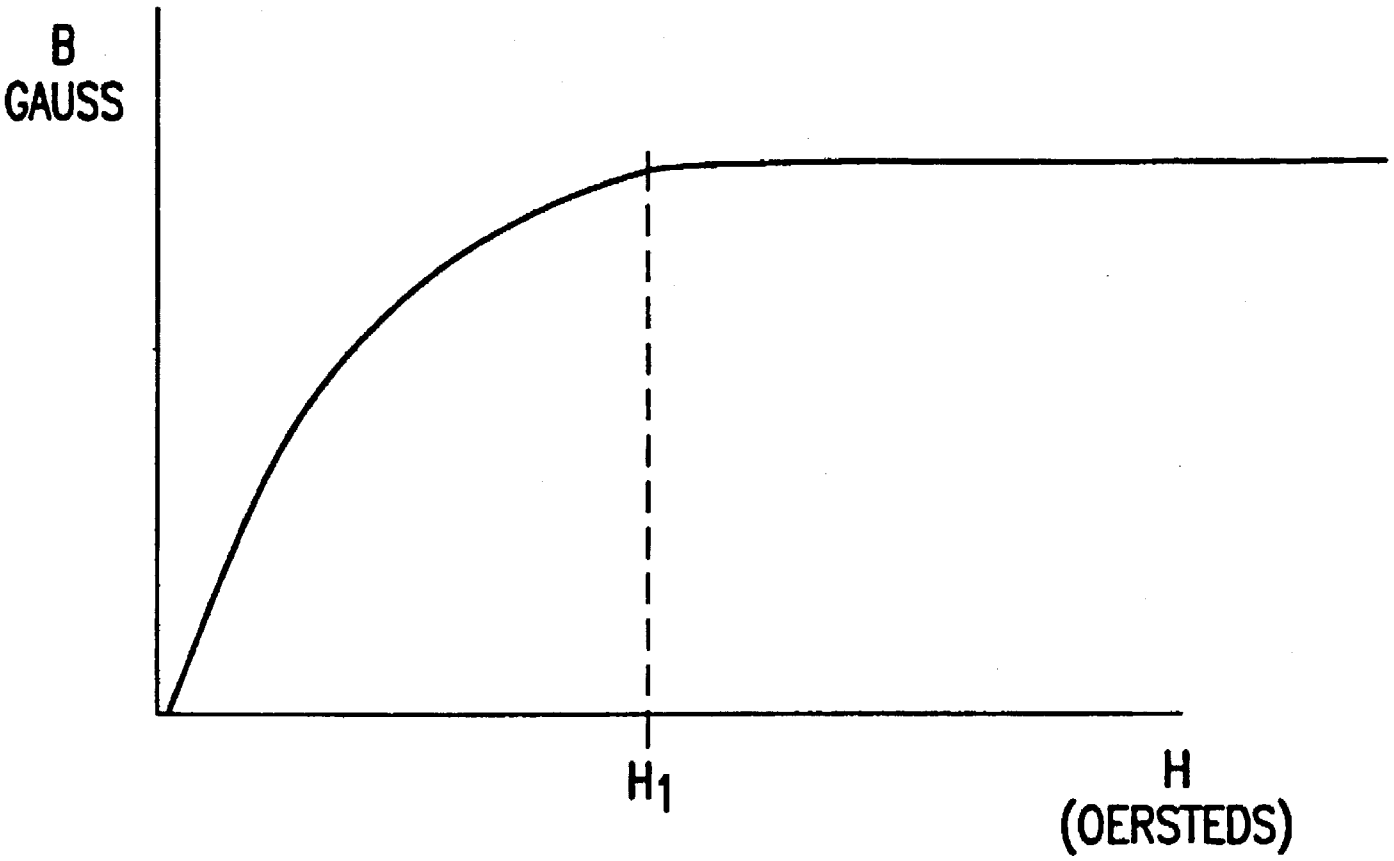
FIG. 18 is a graph showing the relationship between B and H for a typical solenoid valve.

As previously stated, often, in an effort to get the most force in the quickest amount of time, current is increased at a rate that results in the core saturating (operating on the horizontal part of the B/H curve, at $H > H_1$ as shown in FIG. 18) before the valve opens. Since it is saturated, no additional force is generated, and the back-EMF of the valve is not apparent on the current trace for position feedback.

Figure 19:
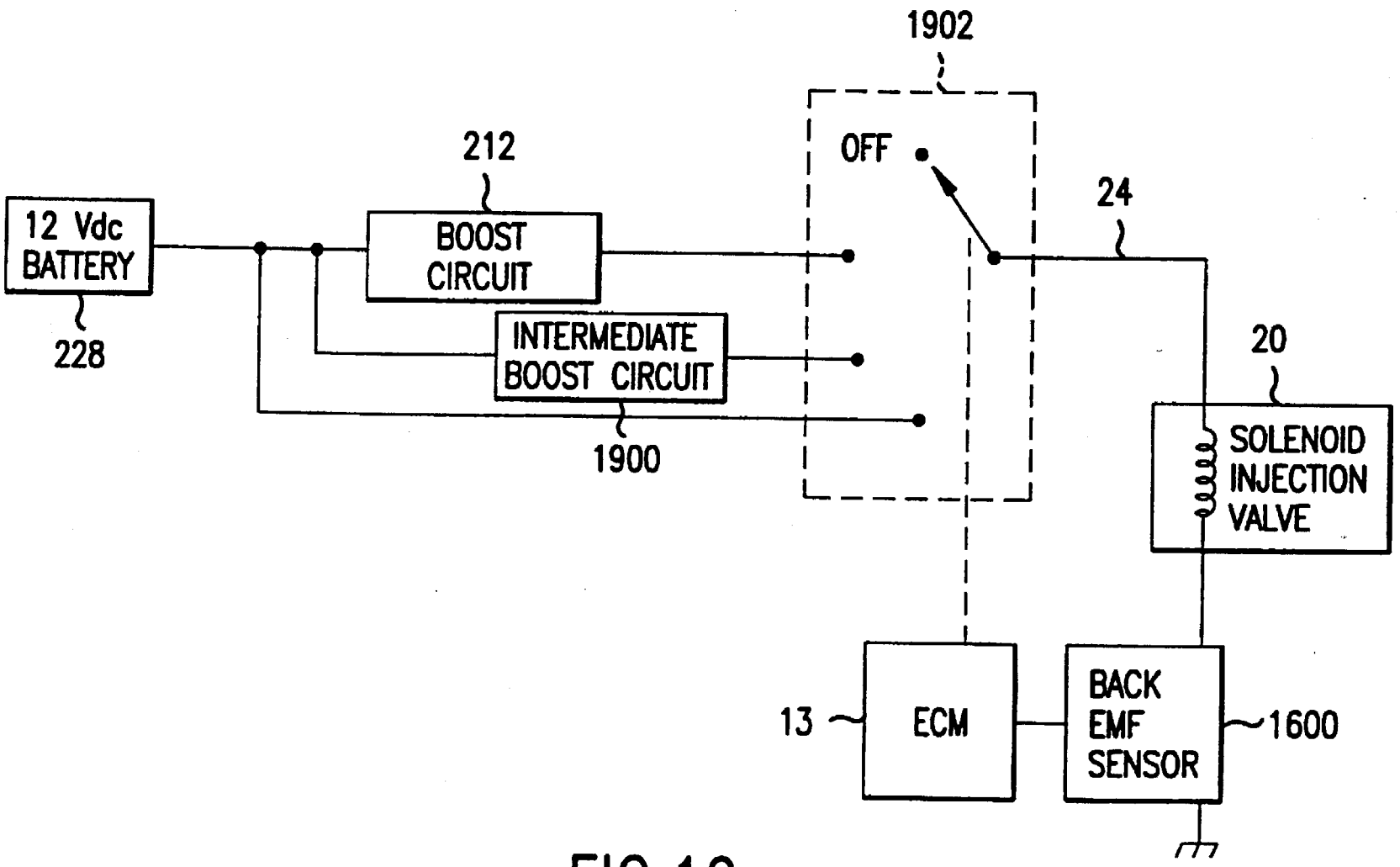
FIG. 19 is a block schematic diagram of a circuit for providing three different voltage levels to the solenoid injection valve according to the present invention.

In another aspect of the invention, a technique has been developed which allows the use of a boost circuit to provide increased force levels, while avoiding core saturation which would prevent back EMF monitoring. In this technique, the ECM and boost circuits are constructed to selectively provide one of three different voltage levels to the solenoid injection valve. As shown in FIG. 19, a switching means 1902 selectively connects voltage from a first boost circuit 212, voltage from an intermediate boost circuit 1900, or battery voltage to the solenoid injection valve 20 under control of ECM 13. In a single injection event, the three different voltages are provided to the valve 20 in sequence, starting with the full boost voltage from boost circuit 212, progressing to the intermediate voltage from intermediate boost circuit 1900, and then to the lower battery voltage.

Figure 20:
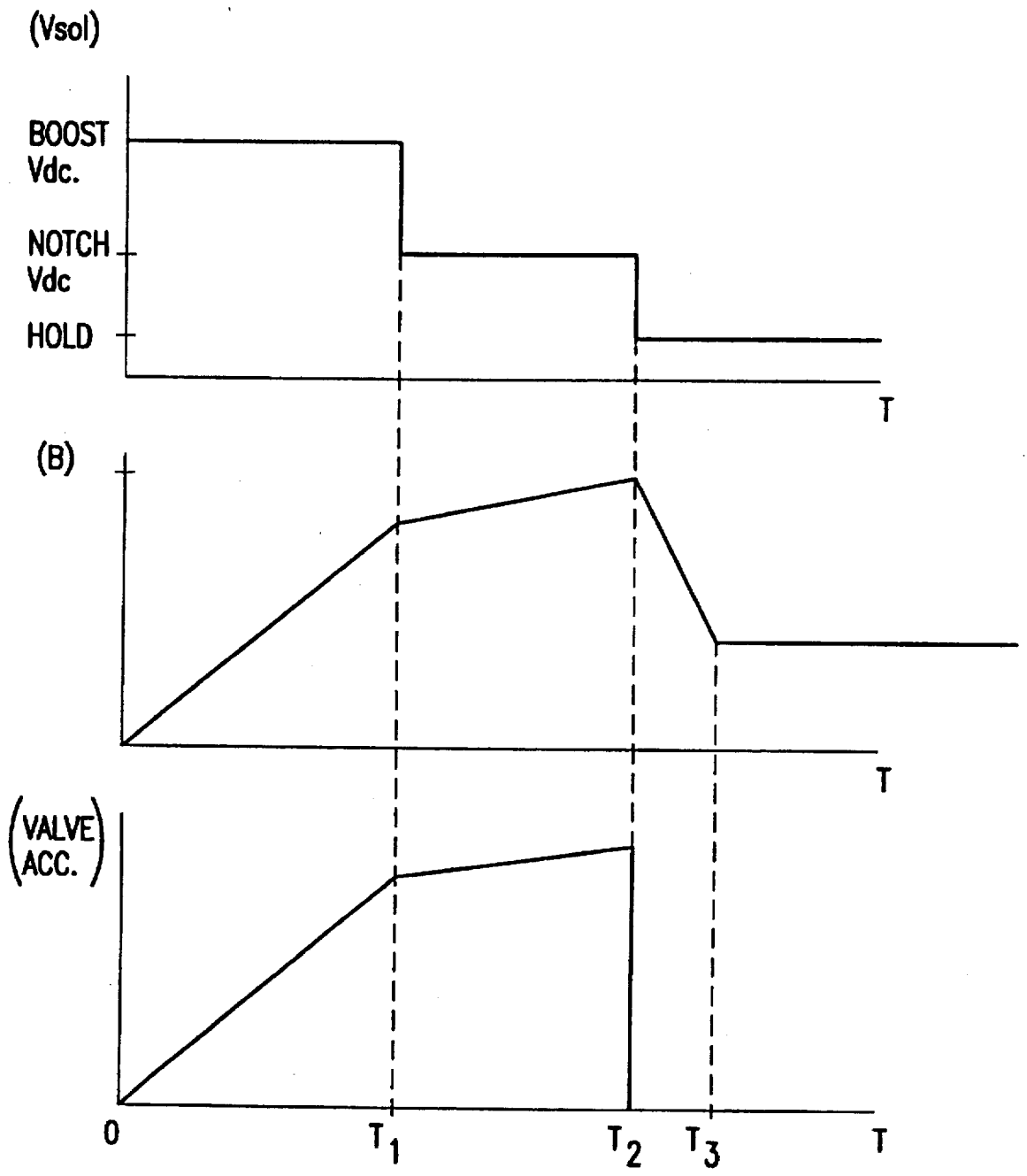
FIG. 20 is a timing diagram showing the application of the sequential solenoid voltages relative to the movement of the solenoid valve.

The timing of these sequential voltage applications relative to the movement of the solenoid valve is particularly important in achieving the desired result. Referring to FIG. 20, at time T=0, the ECM commands the valve to open, and applies the boost voltage. B begins to ramp at a rapid rate, therefore causing the valve acceleration to do the same. At time $T_1$, the ECM decreases the voltage across the core in anticipation of the valve opening. The time $T_1$ is selected to be less than the minimum delay time for opening of the valve after initiation of voltage to the valve. Through the voltage reduction to the intermediate boost voltage, the slope of the B curve is decreased, avoiding saturation prior to valve motion. By time $T=T_2$, the valve has opened. Since the core has not yet saturated, this valve opening can be detected by back-EMF detection circuit 1600 (shown in detail in FIG. 16). In response to detection of valve opening, the ECM then cuts back the voltage to a level corresponding to the force necessary to hold the valve open (always less than that required to move the valve), which may typically be battery voltage. Since the valve has opened, its acceleration is zero. Thus, valve speed is maximized by quick initial acceleration, with the added benefit of avoiding core saturation, permitting back-EMF detection for diagnostic and control purposes.

Figure 21:
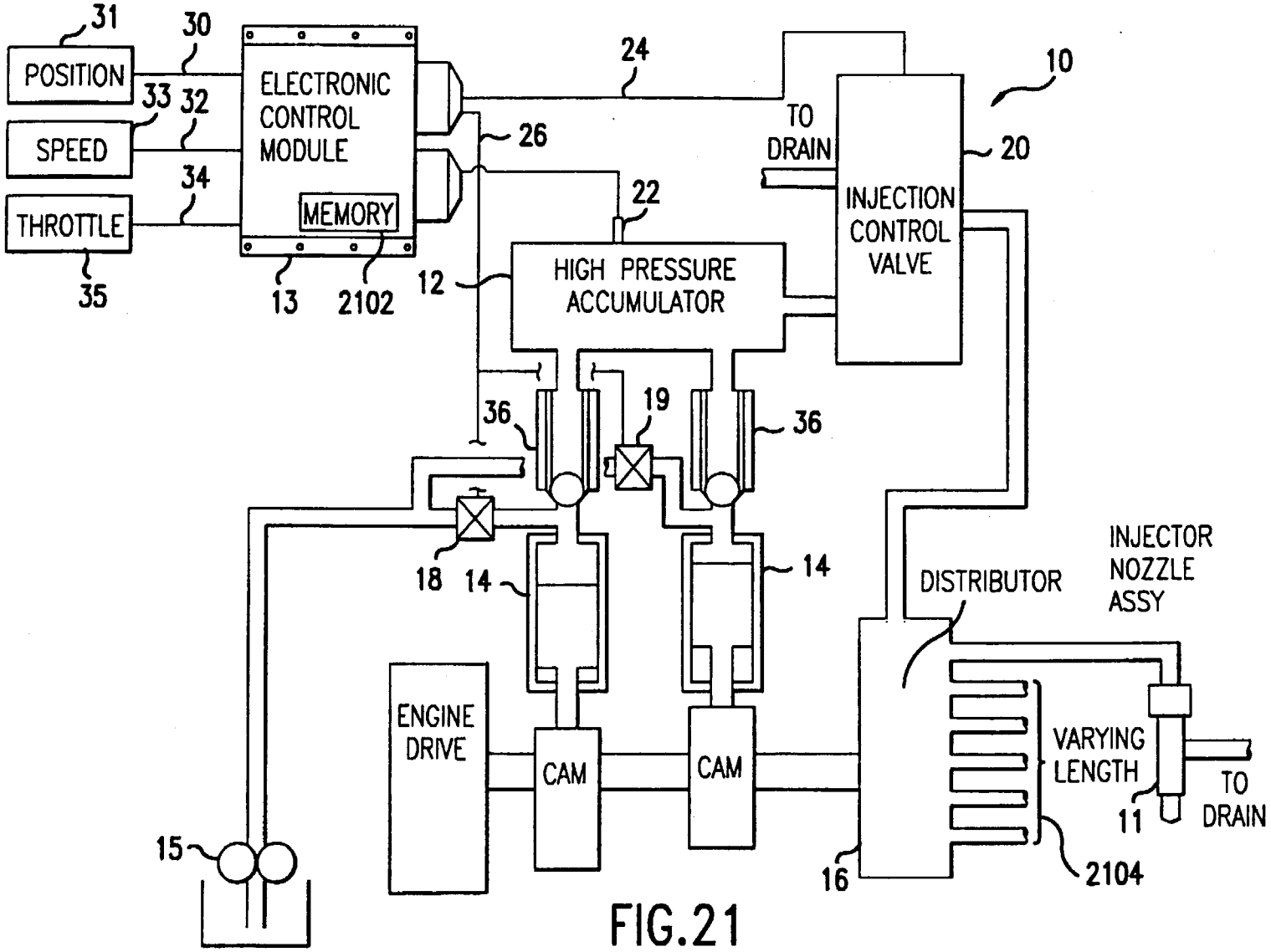
FIG. 21 is a block schematic diagram of an embodiment of the present invention in which the control system compensates for uneven fuel line lengths between the distributor and the cylinder injection nozzles.
Figure 22:
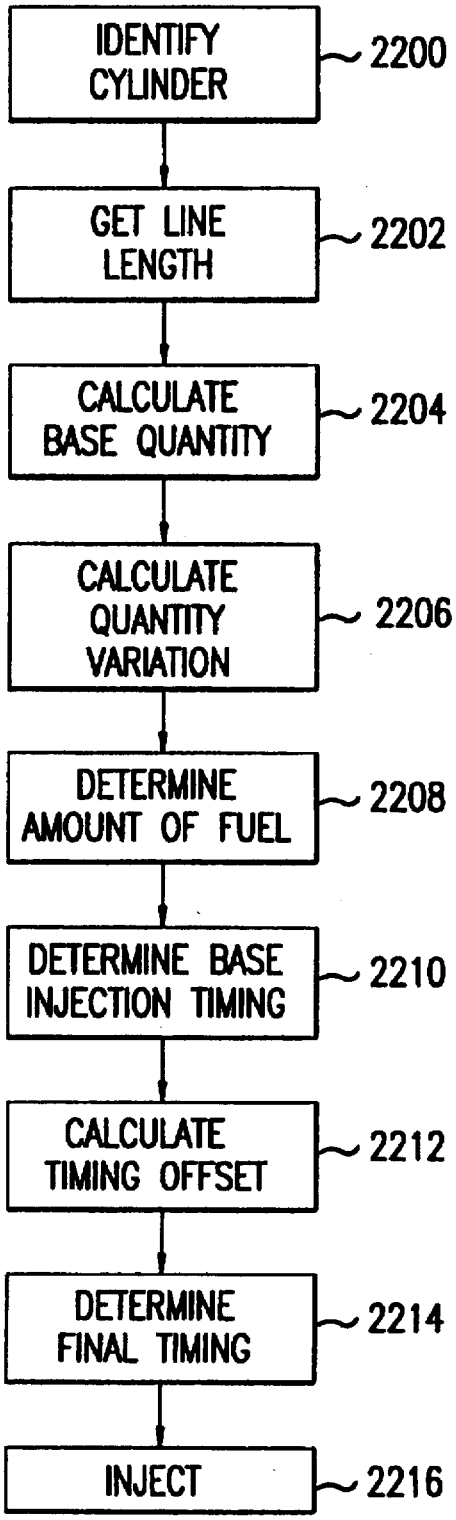
FIG. 22 is a flowchart of the fuel line length compensation algorithm of the present invention.

In another preferred embodiment of the invention, shown in FIG. 21, the control system can be provided with means for compensating for uneven fuel line lengths 2104 between the distributor and the cylinder injection nozzles. Specifically, ECM 13 is provided with a line length memory 2102 connected to the main processor of ECM 13, which stores a line length value associated with each cylinder. The stored line length value represents the difference in length of the fuel lines used for the respective cylinders. The program in the ECM uses this information to compensate for the different fuel line lengths. The program may vary both the quantity of fuel injected, and the timing of the sequential activation signals sent to injection control valve 20 over line 24. FIG. 22 is a flowchart of the fuel line length compensation algorithm of the present invention. The first step (shown in block 2200 of FIG. 22) is to determine which cylinder is next in line for fuel injection. As explained above with reference to FIGS. 1 and 2, in the present invention cylinder identification is determined by reading the position of the cam gear using a Hall effect sensor, and the ECM can readily determine the angular position of the engine and thus which cylinder will be fueled next. Once the cylinder to be fueled has been identified, in the system shown in FIG. 21, control passes to block 2202 and the microprocessor of ECM 13 retrieves the line length information associated with that cylinder from memory 2102. Next, in block 2204, the ECM calculates the base quantity of fuel required for that cylinder as a function of engine operating parameters (speed, load, temperature, etc.) using the methods described in detail above. A quantity variation factor is then calculated relative to the base value as a function of the line length for the cylinder in block 2206. In general, at the high pressures established in the fuel lines during injection, the fuel tends to be compressible so that it acts as a spring member. Thus, in general a greater quantity of fuel should be released into the line as the line length increases, in order to obtain a given desired pressure at the other end of the line, at the injector nozzle. Thus, the quantity variation factor will be a function of the base fuel amount, the length of the line, and in some cases the existing accumulator pressure. In block 2208, a new value for the amount of fuel to be delivered is calculated, determined by the base fuel value as increased or decreased by the fuel quantity variation value. This new value will be the amount of fuel delivered.

In block 2210, a base value is determined for the timing of the injection event as a function of the engine operating parameters according to the methods described previously. In block 2212, a timing offset is calculated based on the length of the line for the particular cylinder. In general, it will take the fuel pressure longer to propagate through the fuel line to the cylinder as its length increases. Thus, if the timing were not adjusted, an injector nozzle at the distal end of a longer fuel line would tend to open slightly later than a nozzle connected by a shorter fuel line, all else being equal. The timing offset is calculated to be equal to the difference between a standard line length and the actual line length of the specific cylinder. In block 2214, the precise timing of the injection signal is determined by starting with the base timing value and advancing or retarding the time of injection signal generation by the calculated timing offset to compensate for the length of the fuel line to the particular cylinder. Then, in block 2216, the injection is performed in the manner described previously, but using the timing and fuel quantity values adjusted to compensate for the length of the fuel line to the individual cylinder injection nozzle.

In this way, the injection control signals for the plurality of cylinders are sequentially transmitted through line 24 to injection control valve 20 (as shown in FIG. 21). The timing of each of the activation signals is independently adjusted in accordance with the physical structure of the fuel line connecting the centralized injection control valve to an individual cylinder. While this compensation feature is particularly useful in enabling the use of different fuel line lengths, it could also be used to compensate for other physical variations in the fuel lines, such as different bends or diameters. The ability to compensate for different fuel line physical layout permits material and cost savings in that excess fuel lines need not be provided merely to equalize fuel line lengths to all cylinders. In addition, a more desirable routing of the lines can be obtained in terms of aesthetics, serviceability, and safety. Fuel rate shaping advantages can also be obtained through this embodiment of the invention.

Another alternative embodiment of the invention provides an apparatus and method for controlling a solenoid valve at high speed without a high voltage boost circuit, that is, using a battery voltage driver circuit. As noted before, boost circuits have a number of disadvantages, and it is therefore desirable to eliminate the boost circuit where possible, to reduce failure modes and decrease costs. With prior art systems, this is not always possible, due to valve designs and system limitations not being tolerant of slower valve speeds.

In this alternative embodiment, a circuit is provided to pre-bias the valve so that the valve can be quickly actuated without a large current flow at the time of actuation. The ECM 13 is provided with a variable current generating circuit capable of providing at least two current levels: a pre-bias level and a valve actuation level. At a defined time prior to a desired valve opening, the ECM selectively increases current to the solenoid, ramping the current up to a level which equates to a force some margin short of that required to overcome the spring force and static friction of the valve. When the time to open the valve arrives, the pre-biased current is further increased to meet or exceed the pull-in value. Since the current was already near that value, the time for valve opening measured from the time of increasing the current is short, even though the forcing function of the current is only battery voltage. This time is very comparable to the time a boosted circuit takes to ramp from 0 to pull-in, with a higher boost voltage as the forcing function.

Figure 23:
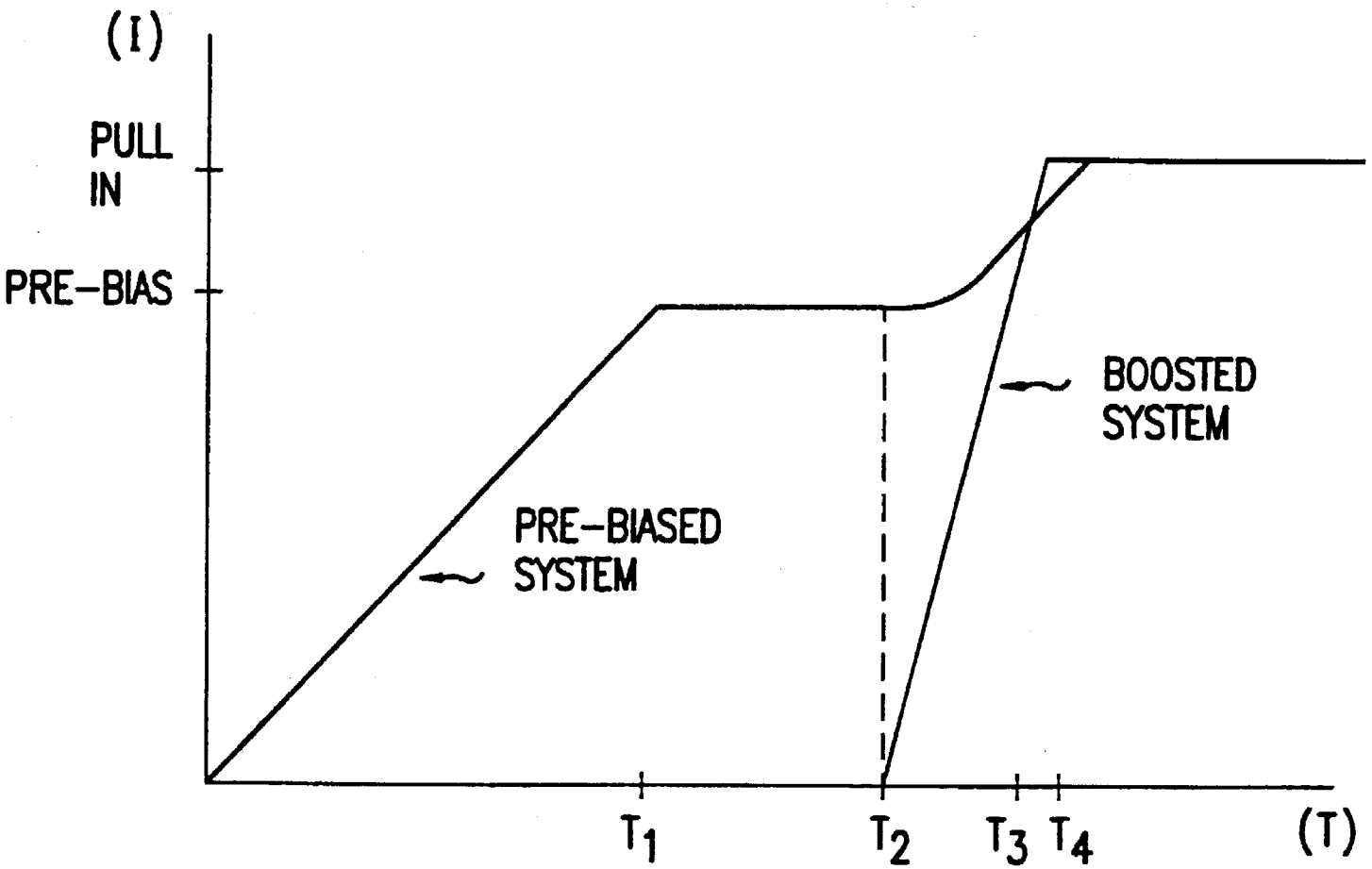
FIG. 23 is a graph comparing the actuation current over time of a boosted system to that of a pre-biased system according to an alternative embodiment of the present invention.

FIG. 23 is a graph comparing the actuation current over time of a boosted system to that of a pre-biased system according to this alternative embodiment of the present invention. As shown in FIG. 23, the boosted-type system is activated at the programmed time for injection $T_2$ and rises quickly to a pull in current level by time $T_3$. The pre-biased system of the present invention generates a pre-bias current using battery voltage prior to time $T_1$. When the programmed injection signal is generated at time $T_2$, the current is further increased using battery voltage as the motive force so that the current reaches pull-in current by time $T_4$, only shortly after the time achieved by the boosted system. Of course, as the system is designed to create a pre-bias current closer to the pull-in current, the time lag of the pre-biased system will be reduced, and it may be possible to meet or even exceed the response time of a boosted system. In addition, it is possible to adjust the time of the programmed injection signal to compensate for any increased delay resulting from the pre-biased system compared to a boosted system. If this pre-bias method is combined with the back EMF sensing methods discussed above, the timing could be dynamically adjusted by the system to open the valve at the same time it would have been opened by a boosted system.

Figure 24A:
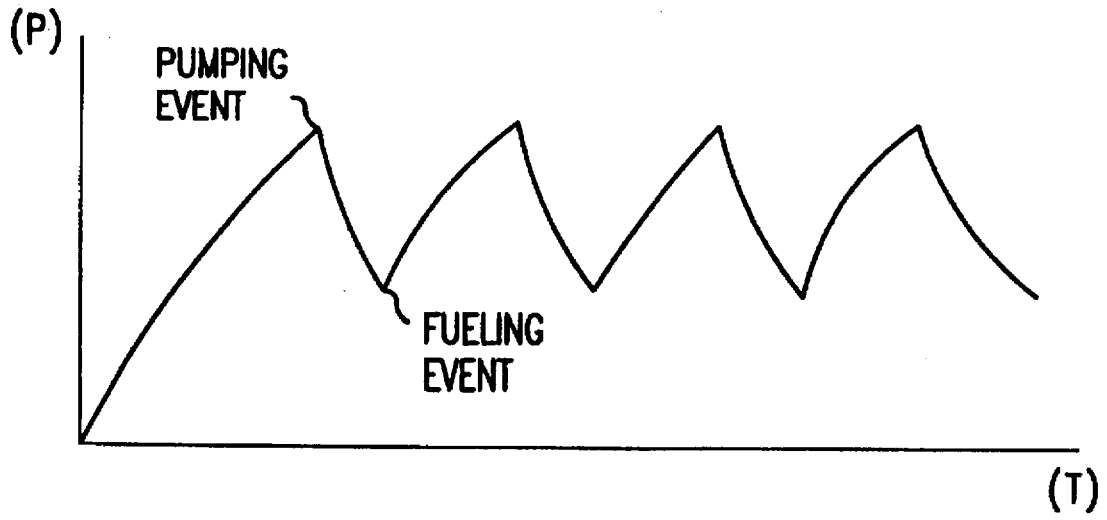
FIG. 24*a* is a graph showing normal accumulator pressure variations over time resulting from alternating pumping and fueling events.
Figure 24B:
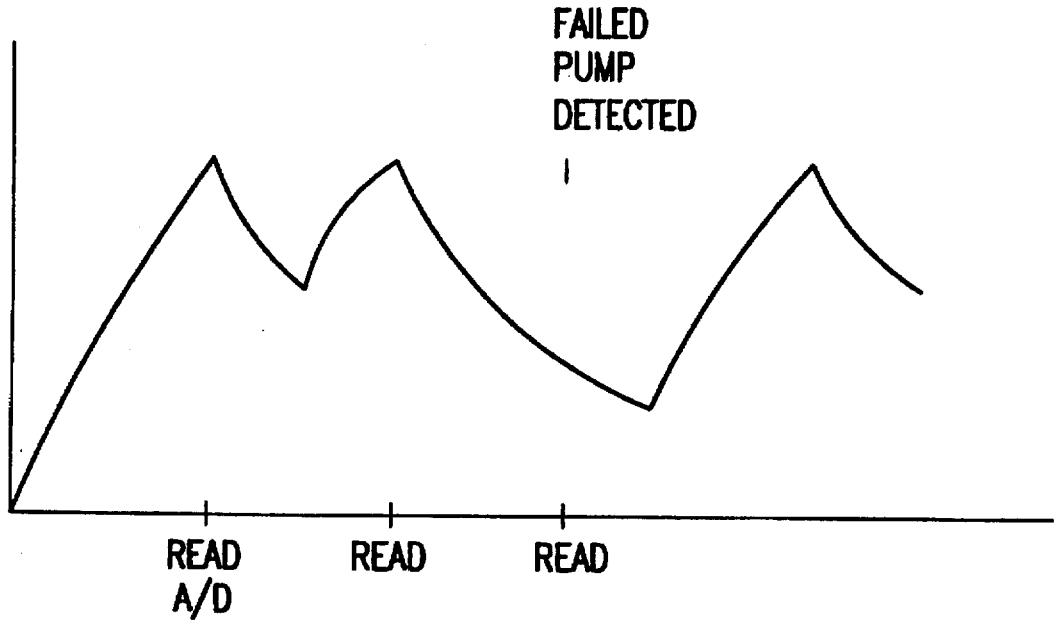
FIG. 24*b* is a graph illustrating an unusual deviation from the standard pressures during operation.

In another embodiment of the invention, the control system is provided with software for monitoring the pressure in the accumulator over time and analyzing the pressure-time waveform to detect and diagnose failures associated with the piston pumps. FIG. 24*a* shows normal accumulator pressure variations resulting from alternating pumping and fueling events. FIG. 24*b* shows an unusual deviation from the standard pressures during operation, which indicates that one of the pumps is not operating properly.

A typical pressure signal, as it would appear on the output of the pressure transducer in the system, is shown in FIG. 24*a*. As with the operations described previously, there is one pumping event for each fueling event, and the pumps are sized such that all fueling events can be compensated for entirely by the next pumping event.

Should one of the pumping devices fail, the waveform will appear as in FIG. 24*b*. The difference between the reading at the time of the fault, and the previous reading, will be significantly different. The ECM can confirm this by noting the repeatability of the phenomenon, i.e., every time piston pump "n" is used, there is a difference in pressure compared to that produced by piston pump "n–1". The ECM will then record the failure for communication to a mechanic, and light an appropriate warning lamp on the dashboard to alert the operator.

Figure 25:
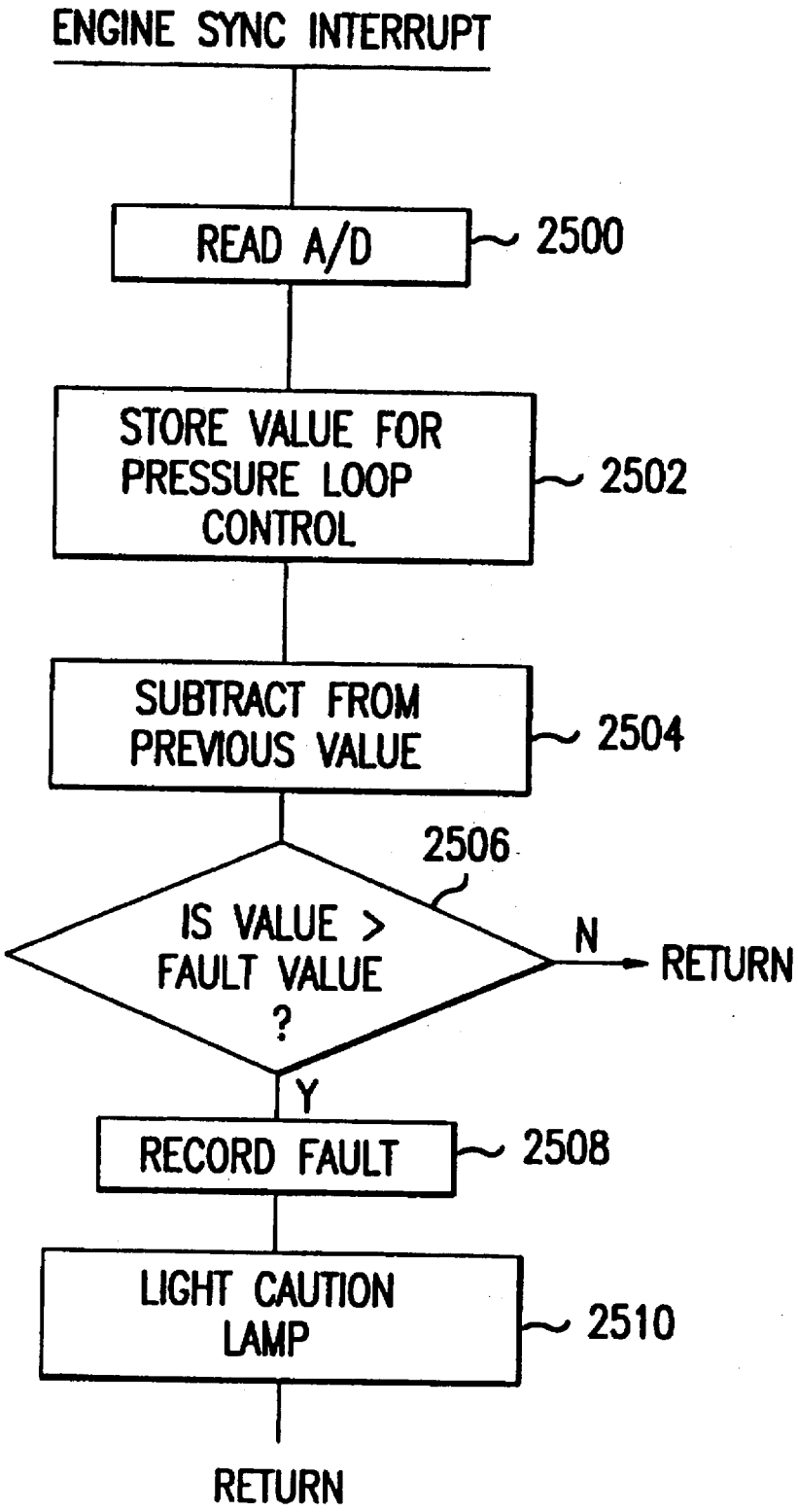
FIG. 25 is a flowchart of an algorithm used by the present invention for detecting a failed pump without extensive waveform filtering, analysis, and processing.

This embodiment of the invention takes advantage of the design feature described above in which pressure readings are collected synchronously with engine position, that is, at the same points in each engine revolution. Thus, a failed pump can be detected without extensive waveform filtering, analysis, and processing using the algorithm shown in the flowchart of FIG. 25. As shown in FIG. 25, in this embodiment, the software for reading accumulator pressure is modified so that upon activation by the engine synchronization interrupt, block 2500 is executed and the accumulator pressure is read in the manner described above and transmitted to the microprocessor through an A/D converter. The current pressure value is stored in a memory in block 2502 for at least another pumping cycle. Control is then passed to block 2504, in which the current pressure value is subtracted from the last measured pressure value stored in the memory. In block 2506, the absolute value of the difference in sequentially measured pressure values is compared to a predetermined fault threshold value. If the difference is greater than the fault value, control passes to block 2508 and 2510, in which a fault is recorded and a warning is issued to the operator, respectively. If the difference is less than the fault value, no failure is reported and operation of the accumulator pressure monitoring and control algorithm continues in the manner described previously. The fault value is selected to be larger than any expected operating fluctuations in accumulator pressure, to avoid false alarms. However, the fault value is set small enough that a failure of one pump will be detected using the algorithm just described.

Figure 27:
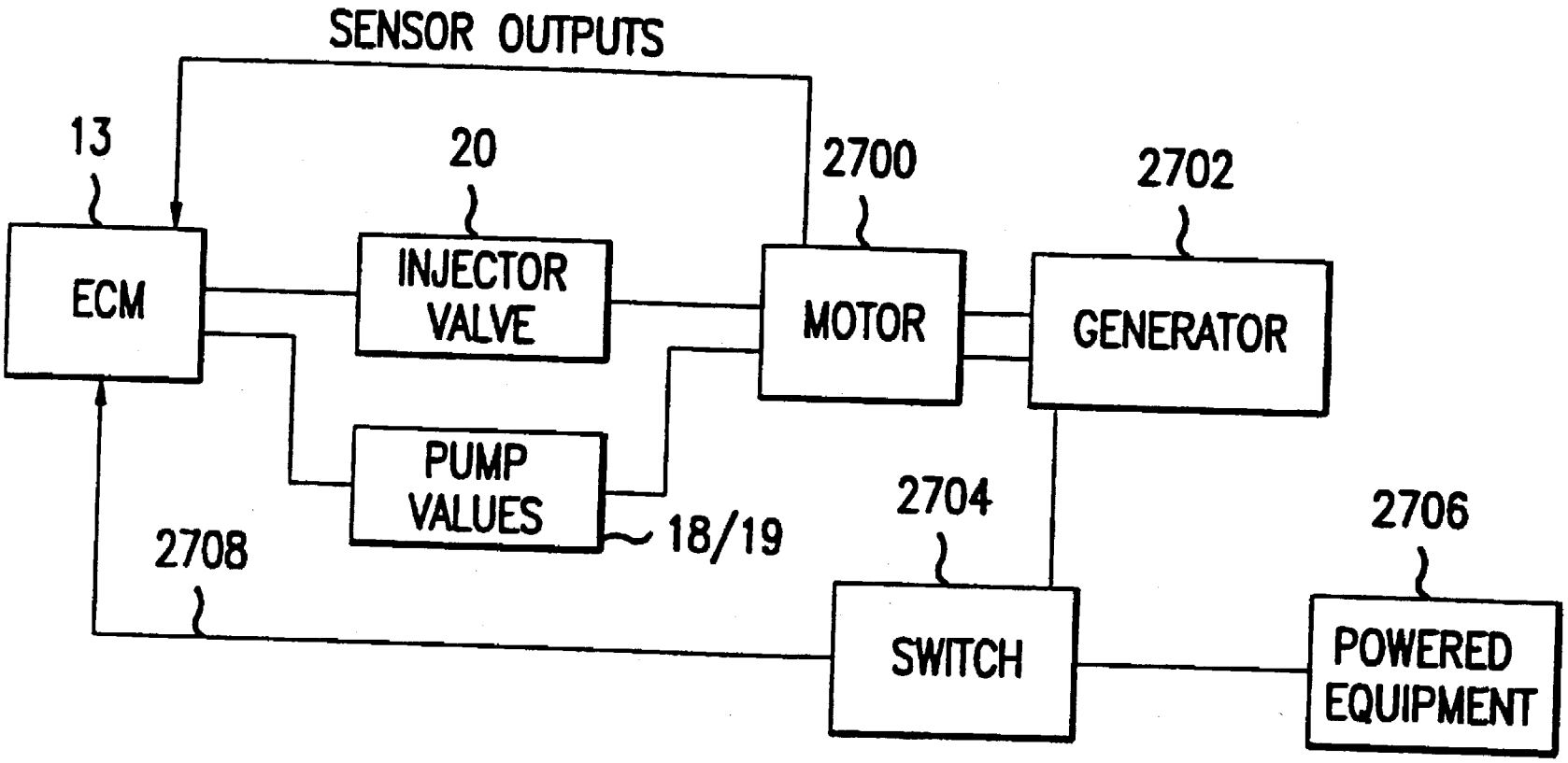
FIG. 27 is a block schematic diagram of a control system for use with a non-vehicular mounted internal combustion engine, such as an engine for use with a generator set.

Another embodiment of the invention, illustrated in FIG. 27, provides improved engine control, primarily in applications other than vehicle propulsion, such as synchronous speed internal combustion engine generator sets. As shown in FIG. 27, such a generator set may include a motor 2700, and a generator 2702 connected through switch 2704 to power drawing equipment 2706. The motor 2700 is provided with a fuel system and an electronic injection control system of the type disclosed herein, although only the ECM 13, injector valve 20, and pump valves 18/19 are shown, for clarity. Sensor outputs are connected from the motor to ECM 13 as described previously. Significantly, there is provided a control signal line 2708 from switch 2704 to ECM 13.

In this type of application, sharply increased loading of motor 2700 occurs when switch 2704 is thrown to start drawing substantial power from the generator 2702. Typically, the motor 2700 is controlled by ECM 13 using feedback control techniques to maintain the engine at a desired speed, such as 1800 rpm. When loading is substantially increased, the motor 2700 must produce much more power to maintain the desired speed. The inventors have found that with more convention systems there is usually a momentary slowing of the motor when the load is added, until the feedback controller detects the reduced speed, and the resulting control signals propagate through the control and fueling system to actually deliver more fuel to the cylinders. In the improvement contemplated by the present invention, the state of controls for adding the load (such as switch 2704 connecting generator 2702 to equipment 2706) is provided as an input to ECM 13 through line 2708, and ECM 13 monitors the state of the load connection. Immediately upon receiving a signal that the load is being added, the ECM 13 overrides the fuel level established by its synchronous control program for a predetermined period of time, and establishes a predetermined increased fueling level during this period, taking effect with the next cylinder injection event to occur. In this way, engine power is immediately increased, synchronously with the increased loading of the engine, rather than merely responding to engine operating changes resulting from the load. With the present highly responsive fueling system and this immediate control response, it is possible to proactively increase engine power synchronously with the increase in load, whereas this would not be possible with systems using less sophisticated control techniques or having greater propagation delays for fueling control signals and actual movement of fuel and pressure increase within the fuel delivery system. Thus, this concept is particularly advantageous in the context of the improved fueling and control system disclosed herein.

We claim:

1. An integrated electronic control system for an internal combustion engine fuel injection system in which at least first and second pumping chambers selectively supply fuel to a high pressure accumulator in pumping events of variable duration having a variable starting time and a defined termination time relative to an angular position of engine rotation, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively initiating said pumping events transferring fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals and transmitting said plurality of solenoid valve control signals over said control line at calculated times synchronous with said angular position when injection of fuel into one of the combustion chambers is required, and selectively generating said pump control signals to start said pumping events at calculated times varying relative to an angular position of engine rotation, thus varying the duration of said pumping events to maintain a desired pressure range in said accumulator.

2. The system of claim 1 wherein said microprocessor receives said position signals at standard intervals during rotation of the engine and, depending on the angular position of the engine at each said interval, selectively actuates (1) a valve timer function for generating said solenoid valve control signal after a programmed elapsed time and (2) a pumping timer function for generating one of said pump control signals after a programmed elapsed time.

3. The system of claim 2 further comprising interrupt means for generating a microprocessor interrupt periodically based on said position signals.

4. The system of claim 3 wherein said interrupt means interrupts said microprocessor after the passage of thirty engine rotational degrees.

5. The system of claim 2 further comprising engine operating condition sensing means connected to the control means for providing information on current engine operating parameters.

6. The system of claim 5 further comprising variable timing means associated with said microprocessor for dynamically varying the programmed elapsed times before generation of said control signals of said valve timer function and said pump timer function in response to said information provided by said engine operating condition sensing means.

7. The system of claim 1 wherein said engine position sensor means comprises position detection means for generating a signal at a specified position of a rotating shaft, rotational speed detection means for generating a signal indicating engine speed, and position calculating means for receiving said position detection means signal and said rotational speed detection means signal and generating said position signal indicating the angular position of engine rotation relative to a point of reference.

8. An integrated electronic control system for an internal combustion engine fuel injection system in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of referencel;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

startup activation means for generating a repeated series of said pump control signals to activate at least one of said first and second pumping chambers to pressurize the accumulator during engine startup, prior to a time when said engine position sensor means begins to provide an accurate indication of engine angular position; and control means including memory means for storing a program, and a micrprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for; monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator.

9. The electronic control system of claim 1, wherein the fuel injection system comprises rate shaping means positioned between said electrically controlled solenoid valve and said individual combustion chambers for dynamically varying the pressure of fuel delivered to the combustion chamber during an injection event, wherein said control means further comprises rate shaping control means connected to said rate shaping means for generating control signals to dynamically vary the pressure of fuel delivered to the combustion chamber during an injection event.

10. The system of claim 1 further comprising back EMF detection means connected to said solenoid valve actuating means for electrically detecting initiation and cessation of mechanical movement of the solenoid valve based on driving current flow to the solenoid valve.

11. The system of claim 10 wherein said back EMF detection means comprises two operational amplifiers each having positive and negative inputs and an output, the positive input of the first operational amplifier connected to a sense resistor in the circuit of a coil of the solenoid valve, the positive input of the second operational amplifier connected to the output of the first operational amplifier, the negative inputs of the first and second operational amplifiers connected through a blocking device to ground, the positive and negative inputs of the second operational amplifier connected by a diode network allowing current to flow from either of said positive and negative inputs of the second operational amplifier to the other of said inputs, and the output of the second operational amplifier connected to provide an output signal indicative of solenoid valve movement.

12. The circuit of claim 1 wherein said solenoid valve actuating means further comprises multiple level boost means for selectively providing one of three voltage levels to a coil of the solenoid valve: a first level which is provided upon receipt of the valve control signal; a second level lower than said first level which is substituted for said first level prior to the opening of the valve, with said second level established at a voltage which does not saturate the coil, and a third level lower than said second level which is substituted for said second level after opening of the solenoid valve to hold said solenoid valve in an open position.

13. The circuit of claim 12 further comprising back EMF detection means connected to said solenoid valve actuating means for electrically detecting initiation and cessation of mechanical movement of the solenoid valve based on driving current flow to the solenoid valve.

14. The circuit of claim 1 wherein the fuel injection system has a plurality of fuel lines between the distributor and the individual combustion chambers at least two of which have different lengths, wherein the control means further comprises means for storing a value associated with each combustion chamber varying with fuel line length between the distributor and that combustion chamber and injection command varying means for varying the valve control signal to compensate for the different fuel line lengths.

15. The circuit of claim 1 wherein the solenoid valve actuating means further comprises pre-bias means for selectively providing one of two current levels to a coil of the solenoid valve: a first current level less than a pull-in current of the solenoid valve which is applied to the coil during a time immediately prior to an anticipated activation of said solenoid valve, and a second current level equal to or greater than the pull-in current which is applied to the coil in response to the valve control signal indicating that fuel injection is desired.

16. The circuit of claim 1 further comprising pump operation monitoring means connected to the control means for storing at least one previous measured accumulator pressure value associated with one of said first and second pumping chambers and comparing said previous value to a current accumulator pressure value associated with the other of said first and second pumping chambers, and providing an indication if the difference between said current and previous values exceeds a predetermined stored value.

17. The circuit of claim 1 further comprising: speed control means for varying fueling levels to maintain a constant engine speed in response to application and removal of a fixed engine load; operator input means for receiving an indication that the fixed load is being applied; and load event response means for electronically increasing fueling levels to the engine in response to the indication that the fixed load is being applied.

18. An integrated electronic control system for an internal combustion engine fuel injection system in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator, wherein said microprocessor receives said position signals at standard intervals during rotation of the engine and, depending on the angular position of the engine at each said interval, selectively actuates (1) a valve timer function for generating said solenoid valve control signal after a programmed elapsed time and (2) a pumping timer function for generating one of said pump control signals after a programmed elapsed time.

19. The system of claim 18 further comprising interrupt means for generating a microprocessor interrupt periodically based on said position signals.

20. The system of claim 19 wherein said interrupt means interrupts said microprocessor after the passage of thirty engine rotational degrees.

21. The system of claim 18 further comprising engine operating condition sensing means connected to the control means for providing information on current engine operating parameters.

22. The system of claim 21 further comprising variable timing means associated with said microprocessor for dynamically varying the programmed elapsed times before generation of said control signals of said valve timer function and said pump timer function in response to said information provided by said engine operating condition sensing means.

23. An integrated electronic control system for an internal combustion engine fuel injection system in which at least first and second pumping chambers selectively supply fuel to a high pressure accumulator, and in which fuel flows from the high pressure accumulator to individual combustion chambers at selected times upon activation of an electrically controlled solenoid valve, through a distributor and a rate shaping means positioned between said electrically controlled solenoid valve and said individual combustion chambers for dynamically varying the pressure of fuel delivered to the combustion chamber during an injection event, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator; and rate shaping control means associated with the control means and connected to said rate shaping means, for generating control signals to dynamically vary the pressure of fuel delivered to the combustion chamber during an injection event.

24. An integrated electronic control system for an internal combustion engine fuel injection system in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

back EMF detection means connected to said solenoid valve actuating means for electrically detecting initiation and cessation of mechanical movement of the solenoid valve based on driving current flow to the solenoid valve; and control means including memory means for storing a program, and a microprocessor having electrical inputs and outputs and connected to said memory means to read and execute said program, with said control means connected to said engine position sensor means, said accumulator pressure sensor means, said pressure transfer actuating means, said back EMF detection means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator.

25. The system of claim 24 wherein said back EMF detection means comprises two operational amplifiers each having positive and negative inputs and an output, the positive input of the first operational amplifier connected to a sense resistor in the circuit of a coil of the solenoid valve, the positive input of the second operational amplifier connected to the output of the first operational amplifier, the negative inputs of the first and second operational amplifiers connected through a blocking device to ground, the positive and negative inputs of the second operational amplifier connected by a diode network allowing current to flow from either of said positive and negative inputs of the second operational amplifier to the other of said inputs, and the output of the second operational amplifier connected to provide an output signal indicative of solenoid valve movement.

26. An integrated electronic control system for an internal combustion engine fuel injection system in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal, comprising multiple level boost means for selectively providing one of three voltage levels to a coil of the solenoid valve: a first level which is provided upon receipt of the valve control signal; a second level lower than said first level which is substituted for said first level prior to the opening of the valve, with said second level established at a voltage which does not saturate the coil, and a third level lower than said second level which is substituted for said second level after opening of the solenoid valve to hold said solenoid valve in an open position;

a control line connected to said solenoid valve actuating means for carrying said valve control signal; and control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator.

27. The circuit of claim 26 further comprising back EMF detection means connected to said solenoid valve actuating means for electrically detecting initiation and cessation of mechanical movement of the solenoid valve based on driving current flow to the solenoid valve.

28. An integrated electronic control system for an internal combustion engine fuel injection system in which at least first and second pumping chambers selectively supply fuel to a high pressure accumulator, and in which fuel flows from the high pressure accumulator to individual combustion chambers upon activation of an electrically controlled solenoid valve at selected times, through a distributor and a plurality of fuel lines between the distributor and the individual combustion chambers at least two of which have different lengths, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, selectively generating a plurality of said pump control signals synchronously with said angular position to maintain a desired pressure range in said accumulator, and storing a value associated with each combustion chamber varying with fuel line length between the distributor and that combustion chamber, and varying the valve control signal to compensate for the different fuel line lengths.

29. An integrated electronic control system for an internal combustion engine fuel injection system in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal, and further comprising pre-bias means for selectively providing one of two current levels to a coil of the solenoid valve: a first current level less than a pull-in current of the solenoid valve which is applied to the coil during a time immediately prior to an anticipated activation of said solenoid valve, and a second current level equal to or greater than the pull-in current which is applied to the coil in response to the valve control signal indicating that fuel injection is desired;

a control line connected to said solenoid valve actuating means for carrying said valve control signal; and control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator.

30. An integrated electronic control system for an internal combustion engine fuel injection system in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator; and pump operation monitoring means connected to the control means for storing at least one previous measured accumulator pressure value associated with one of said first and second pumping chambers and comparing said previous value to a current accumulator pressure value associated with the other of said first and second pumping chambers, and providing an indication if the difference between said current and previous values exceeds a predetermined stored value.

31. An integrated electronic control system for an internal combustion engine fuel injection system driving a fixed load in which at least first and second pumping chambers selectively supply fuel to a high pressure accumulator, and in which fuel flows from the high pressure accumulator to individual combustion chambers at selected times through a distributor upon activation of an electrically controlled solenoid valve, comprising:

engine position sensor means for generating a position signal indicating the angular position of engine rotation relative to a point of reference;

accumulator pressure sensor means for generating a pressure signal indicative of fuel pressure in said high pressure accumulator;

pressure transfer actuating means for selectively enabling the supply of fuel to said high pressure accumulator from said first and second pumping chambers, respectively, in response to pump control signals;

solenoid valve actuating means for opening said electrically controlled solenoid valve in response to a valve control signal;

a control line connected to said solenoid valve actuating means for carrying said valve control signal;

control means including memory means for storing a program, and a microprocessor having electrical inputs and outputs and connected to said memory means to read and execute said program, with said control means connected to said engine position sensor means, said accumulator pressure sensor means, said pressure transfer actuating means, and through said control line to said solenoid valve actuating means, for: monitoring said engine rotation angular position and monitoring said accumulator pressure synchronously with said angular position and selectively generating a plurality of said solenoid valve control signals for a plurality of the combustion chambers respectively and transmitting said plurality of solenoid valve control signals over said control line at calculated times synchronous with said angular position when injection of fuel into one of the combustion chambers is required, and selectively generating a plurality of said pump control signals synchronously with said angular position to maintain a desired pressure range in said accumulator;

speed control means associated with the control means for varying fueling levels to maintain a constant engine speed in response to application and removal of the fixed engine load;

operator input means connected to the control means for receiving an indication that the fixed load is being applied; and load event response means associated with the control means for electronically increasing fueling levels to the engine in response to the indication that the fixed load is being applied.

32. The system of claim 8 wherein said repeated series of pump control signals generated by said startup activation means is a pulse train having a defined duty cycle.

33. The system of claim 32 wherein said duty cycle is substantially equal to 50 percent and the duration of the pulse train is substantially equivalent to 20° of engine crankshaft rotation.

* * * * *